US011181284B2

(12) United States Patent
Yoshioka et al.

(10) Patent No.: US 11,181,284 B2
(45) Date of Patent: Nov. 23, 2021

(54) HEAT EXCHANGER OR REFRIGERATION APPARATUS

(71) Applicant: DAIKIN INDUSTRIES, LTD., Osaka (JP)

(72) Inventors: Shun Yoshioka, Osaka (JP); Yoshiyuki Matsumoto, Osaka (JP); Shouta Agou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/498,724

(22) PCT Filed: Mar. 22, 2018

(86) PCT No.: PCT/JP2018/011531
§ 371 (c)(1),
(2) Date: Sep. 27, 2019

(87) PCT Pub. No.: WO2018/180931
PCT Pub. Date: Oct. 4, 2018

(65) Prior Publication Data

US 2020/0386419 A1 Dec. 10, 2020

(30) Foreign Application Priority Data

Mar. 27, 2017 (JP) ..... JP2017-061233

(51) Int. Cl.
*F24F 1/0067* (2019.01)
*F24F 1/0047* (2019.01)
(Continued)

(52) U.S. Cl.
CPC ..... *F24F 1/0067* (2019.02); *F24F 1/0014* (2013.01); *F24F 1/0047* (2019.02); *F25B 40/00* (2013.01)

(58) Field of Classification Search
CPC ..... F24F 1/0067; F25B 40/00; F25B 40/02; F25B 40/04; F28D 1/05391
See application file for complete search history.

(56) References Cited

U.S. PATENT DOCUMENTS 5,509,272 A * 4/1996 Hyde ..... F24F 3/153 62/176.5
9,377,225 B2 * 6/2016 Song ..... F24F 1/14
(Continued)

FOREIGN PATENT DOCUMENTS

CN 103256757 A 8/2013
CN 203396065 U 1/2014
(Continued)

OTHER PUBLICATIONS

International Search Report issued in corresponding International Application No. PCT/JP2018/011531 dated Jun. 5, 2018 (4 pages).
(Continued)

*Primary Examiner* — Christopher R Zerphey
(74) *Attorney, Agent, or Firm* — Osha Bergman Watanabe & Burton LLP

(57) ABSTRACT

A heat exchanger in which a refrigerant and air flow exchange heat includes a first heat-exchanging unit. The first heat-exchanging unit includes: a first header including a first gas refrigerant inlet/outlet; a second header including a first liquid refrigerant inlet/outlet; a plurality of first flat tubes disposed side by side in a longitudinal direction of the first header and the second header; and a first communication path formation portion that is connected to the first header and the second header and that forms a first communication path.

7 Claims, 25 Drawing Sheets

(51) Int. Cl.
*F24F 1/0014* (2019.01)
*F25B 40/00* (2006.01)

(56) References Cited

U.S. PATENT DOCUMENTS

| | | | | |
|---|---|---|---|---|
| 2009/0084131 | A1 | 4/2009 | Reifel et al. | |
| 2009/0314020 | A1* | 12/2009 | Yoshioka | F28D 1/0475 62/238.6 |
| 2013/0306285 | A1 | 11/2013 | Jindou et al. | |
| 2015/0059400 | A1 | 3/2015 | Okazaki et al. | |
| 2016/0054010 | A1 | 2/2016 | Suhara | |
| 2016/0327343 | A1 | 11/2016 | Hwang et al. | |
| 2018/0135900 | A1 | 5/2018 | Jindou et al. | |

FOREIGN PATENT DOCUMENTS

| | | | |
|---|---|---|---|
| EP | 3015808 | A1 | 5/2016 |
| JP | 2000-329486 | A | 11/2000 |
| JP | 2001-336896 | A | 12/2001 |
| JP | 2006-329511 | A | 12/2006 |
| JP | 2010-107102 | A | 5/2010 |
| JP | 2012-163319 | A | 8/2012 |
| JP | 2014-215011 | A | 11/2014 |
| JP | 2016-038192 | A | 3/2016 |
| WO | 2016/174830 | A1 | 11/2016 |

OTHER PUBLICATIONS

Written Opinion and International Preliminary Report on Patentability issued in corresponding International Application No. PCT/JP2018/011531 dated Oct. 1, 2019 (9 pages).

Extended European Search Report issued in corresponding European Application No. 18777704.0 dated Mar. 31, 2020 (7 pages).

* cited by examiner

HEAT EXCHANGER OR REFRIGERATION APPARATUS

TECHNICAL FIELD

The present invention relates to a heat exchanger or a refrigeration apparatus.

BACKGROUND

Hitherto, a flat-tube heat exchanger in which flat tubes through which a refrigerant flows are laminated is known. For example, Patent Literature 1 (Japanese Unexamined Patent Application Publication No. 2012-163319) discloses an air-conditioner flat-tube heat exchanger in which a plurality of flat tubes that extend in a horizontal direction are laminated in a vertical direction and in which a plurality of heat transfer fins that extend in the vertical direction and that contact the flat tubes are arranged side by side in the horizontal direction.

However, when the flat-tube heat exchanger of Patent Literature 1 is used as a condenser of a refrigerant, a superheating area (flat-tube group where a gas refrigerant in a superheated state is assumed to flow) and a subcooling area (flat-tube group where a liquid refrigerant in a subcooled state is assumed to flow) are adjacent to each other one above another. Therefore, depending upon the situation, heat is exchanged via the heat-transfer fins between the refrigerant that passes through the superheating area and the refrigerant that passes through the subcooling area. In relation to this, there may be cases in which the degree of subcooling of the refrigerant is not properly ensured. That is, a reduction in performance may occur.

PATENT LITERATURE

Patent Literature 1 Japanese Unexamined Patent Application Publication No. 2012-163319

SUMMARY

Accordingly, one or more embodiments of the present invention provide a flat-tube heat exchanger that suppresses a reduction in performance.

A heat exchanger according to one or more embodiments of the present invention is a heat exchanger in which a refrigerant and an air flow exchange heat and that includes a first heat-exchanging unit. The first heat-exchanging unit includes a first header, a second header, a plurality of first flat tubes, and a first communication path formation portion. The first header has a gas refrigerant inlet/outlet. The second header has a liquid refrigerant inlet/outlet. One end of each first flat tube is connected to the first header. Another end of each first flat tube is connected to the second header. The plurality of first flat tubes are arranged side by side in a longitudinal direction of the first header and the second header. The first communication path formation portion is connected to the first header and the second header. The first communication path formation portion forms a first communication path. The first communication path allows the first header and the second header to communicate with each other. In the first heat-exchanging unit, when a gas refrigerant in a superheated state that has flown in from the gas refrigerant inlet/outlet exchanges heat with the air flow and flows out from the liquid refrigerant inlet/outlet as a liquid refrigerant in a subcooled state, a first superheating area and a first subcooling area are formed. The first superheating area is an area in which the gas refrigerant in the superheated state flows. The first subcooling area is an area in which the liquid refrigerant in the subcooled state flows. The first header has a first space and a second space formed in the first header. The first space is a space that communicates with the first superheating area. The second space is a space that is partitioned from the first space. The second header has a third space and a fourth space formed in the second header. The third space communicates with the first space via the first flat tube. The fourth space is a space that is partitioned from the third space. The fourth space is a space that communicates with the first subcooling area. The first communication path allows the second space and the third space to communicate with each other.

In the heat exchanger according to one or more embodiments of the present invention, the first space that communicates with the first superheating area (area in which the gas refrigerant in the superheated state flows when the gas refrigerant in the superheated state that has flown in from the gas refrigerant inlet/outlet exchanges heat with the air flow and flows out from the liquid refrigerant inlet/outlet as the liquid refrigerant in the subcooled state) and the second space that is partitioned from the first space are formed in the first header. The third space that communicates with the first space via the first flat tube and the fourth space that is partitioned from the third space and that communicates with the first subcooling area (area in which the liquid refrigerant in the subcooled state flows when the gas refrigerant in the superheated state that has flown in from the gas refrigerant inlet/outlet exchanges heat with the air flow and flows out from the liquid refrigerant inlet/outlet as the liquid refrigerant in the subcooled state) are formed in the second header. The first communication path allows the second space and the third space to communicate with each other. Therefore, when the heat exchanger is used as a condenser of a refrigerant, the flat-tube heat exchanger can be formed so that the first superheating area and the first subcooling area are not adjacent to each other one above another. That is, the first superheating area and the first subcooling area can be formed so that heat exchange between the refrigerant that passes through the first superheating area and the refrigerant that passes through the first subcooling area is suppressed. In relation to this, this helps the degree of subcooling of the refrigerant to be properly ensured. Therefore, a reduction in performance is suppressed.

Here, "gas refrigerant inlet/outlet" refers to an opening that functions as an inlet for a gas refrigerant (primarily, a gas refrigerant in a superheated state) when the heat exchanger is used as a condenser. "Liquid refrigerant inlet/outlet" refers to an opening that functions as an outlet for a liquid refrigerant (primarily, a liquid refrigerant in a subcooled state) when the heat exchanger is used as a condenser. "First communication path formation portion" refers to a device that forms the first communication path, and is, for example, a space formation member in the refrigerant pipe or the header collecting pipe.

A heat exchanger according to one or more embodiments of the present invention further includes a second heat-exchanging unit in addition to the first heat-exchanging unit. The second heat-exchanging unit includes a third header, a fourth header, and a plurality of second flat tubes. The third header has a second gas refrigerant inlet/outlet. One end of each second flat tube is connected to the third header. Another end of each second flat tube is connected to the fourth header. The plurality of second flat tubes are arranged side by side in a longitudinal direction of the third header and the fourth header. In the second heat-exchanging unit, when a gas refrigerant in a superheated state that has flown in from the second gas refrigerant inlet/outlet exchanges heat with the air flow and flows out from a second liquid refrigerant inlet/outlet as a liquid refrigerant in a subcooled state, a second superheating area and a second subcooling area are formed. The second superheating area is an area in which the gas refrigerant in the superheated state flows. The second subcooling area is an area in which the liquid refrigerant in the subcooled state flows. The second liquid refrigerant inlet/outlet is formed in the third header or the fourth header in addition to the second gas refrigerant inlet/outlet. In an installed state, the second heat-exchanging unit is disposed beside the first heat-exchanging unit on an upwind side or on a downwind side of the first heat-exchanging unit so that a direction of flow of a refrigerant in the second subcooling area is same as a direction of flow of a refrigerant in the first subcooling area.

In the heat exchanger according to one or more embodiments of the present invention, in an installed state, the second heat-exchanging unit is disposed beside the first heat-exchanging unit on the upwind side or the downwind side of the first heat-exchanging unit so that the direction of flow of the refrigerant in the second subcooling area (area in which the liquid refrigerant in the subcooled state flows when the gas refrigerant in the superheated state that has flown in from the second gas refrigerant inlet/outlet exchanges heat with the air flow and flows out from the second liquid refrigerant inlet/outlet as the liquid refrigerant in the subcooled state) is the same as the direction of flow of the refrigerant in the first subcooling area of the first heat-exchanging unit. Therefore, in the flat-tube heat exchanger in which a plurality of heat-exchanging units are disposed side by side on the upwind side and on the downwind side, when used as a condenser of a refrigerant, of the first heat-exchanging unit and the second heat-exchanging unit, the superheating area on the upwind side and the subcooling area on the downwind side can be suppressed from partly overlapping each other or being close to each other when viewed in an air flow direction. As a result, passage of the air flow that has passed the superheating area of the heat-exchanging unit on the upwind side through the subcooling area of the heat-exchanging unit on the downwind side is suppressed. Therefore, in the subcooling area in the heat-exchanging unit on the downwind side, temperature differences between the refrigerant and the air flow is easily properly ensured, and cases in which heat exchange is not properly performed and a degree of subcooling is not properly ensured are reduced.

"Second gas refrigerant inlet/outlet" here refers to an opening that functions as an inlet of a gas refrigerant (primarily, a gas refrigerant in a superheated state) when the heat exchanger is used as a condenser. In addition "second liquid refrigerant inlet/outlet" refers to an opening that functions as an outlet of a liquid refrigerant (primarily, a liquid refrigerant in a subcooled state) when the heat exchanger is used as a condenser.

According to one or more embodiments, the second liquid refrigerant inlet/outlet is formed in the third header. The third header has a fifth space and a sixth space formed in the third header. The fifth space is a space that communicates with the second gas refrigerant inlet/outlet. The sixth space is a space that is partitioned from the fifth space. The sixth space is a space that communicates with the second liquid refrigerant inlet/outlet. The fourth header has a seventh space and an eighth space formed in the fourth header. The seventh space communicates with the fifth space via the second flat tube. The eighth space communicates with the sixth space via the second flat tube. The second heat-exchanging unit further includes a second communication path formation portion. The second communication path formation portion forms a second communication path. The second communication path allows the seventh space and the eighth space to communicate with each other.

In the heat exchanger according to one or more embodiments of the present invention, in the second heat-exchanging unit, the fifth space (space that communicates with the second gas refrigerant inlet/outlet) and the sixth space (space that is partitioned from the fifth space and that communicates with the second liquid refrigerant inlet/outlet) are formed in the third header, and the seventh space (space that communicates with the fifth space via the second flat tube) of the fourth header and the eighth space (space that communicates with the sixth space via the second flat tube) of the fourth header communicate with each other by the second communication path. Therefore, the superheating area that is formed at the first heat-exchanging unit and the superheating area that is formed at the second heat-exchanging unit can be arranged so as not to overlap each other in the air flow direction. As a result, of the air flow that has passed the first heat-exchanging unit and the second heat-exchanging unit, large differences in the proportions between air that has sufficiently exchanged heat with the refrigerant and air that has not sufficiently exchanged heat with the refrigerant depending upon portions where the air flow passes are suppressed. Therefore, temperature unevenness of air that has passed the heat exchanger is suppressed.

According to one or more embodiments, a direction of flow of a refrigerant that flows through the second superheating area is opposite to a direction of flow of a refrigerant that flows through the first superheating area. Therefore, the refrigerant in the superheating area of the first heat-exchanging unit and the refrigerant in the superheating area of the second heat-exchanging unit flow so as to oppose each other. As a result, of the air flow that has passed the first heat-exchanging unit and the second heat-exchanging unit, large differences in the proportions between air that has sufficiently exchanged heat with the refrigerant and air that has not sufficiently exchanged heat with the refrigerant depending upon portions where the air flow passes are further suppressed. Therefore, temperature unevenness of air that has passed the heat exchanger is further suppressed.

According to one or more embodiments, in an installed state, a longitudinal direction of the first flat tubes is a horizontal direction. In the installed state, the longitudinal direction of the first header and the second header is a vertical direction. In the installed state, the gas refrigerant inlet/outlet is positioned above the liquid refrigerant inlet/outlet. Therefore, in the installed state, in the flat-tube heat exchanger in which the flat tubes that extend in a horizontal direction are laminated in a vertical direction and the flow path through which the liquid refrigerant flows is disposed below the flow path through which the gas refrigerant flows, a reduction in performance is suppressed.

According to one or more embodiments, in an installed state, the first heat-exchanging unit includes a first portion and a second portion. In the first portion, the first flat tube extends in a first direction. In the second portion, the first flat tube extends in a second direction. The second direction is a direction that intersects the first direction. Therefore, in the flat-tube heat exchanger that includes the heat-exchanging unit including the first portion and the second portion extending in different directions, a reduction in performance is suppressed.

According to one or more embodiments is the heat exchanger, when viewed in a direction in which the first header and the second header extend, the first heat-exchanging unit is bent or curved at three or more locations and has a substantially square shape. When viewed in the direction in which the first header and the second header extend, the first header is disposed at one end portion of the first heat-exchanging unit. When viewed in the direction in which the first header and the second header extend, the second header is disposed at another end portion of the first heat-exchanging unit.

Therefore, in the flat-tube heat exchanger having a substantially square shape when viewed in a header extension direction, a reduction in performance is suppressed. In addition, a pipe that extends between the first header and the second header and a connection pipe that is connected to the first header and the second header is easily routed, and ease of assembly is increased.

A refrigeration apparatus according to one or more embodiments of the present invention includes the heat exchanger and a casing. The casing accommodates the heat exchanger. A connection pipe insertion port is formed in the casing. The connection pipe insertion port is a hole for inserting a refrigerant connection pipe therein. In the heat exchanger, the first heat-exchanging unit includes a third portion and a fourth portion. In the third portion, the first flat tube extends in a third direction. In the fourth portion, the first flat tube extends in a fourth direction. The fourth direction differs from the third direction. In the first heat-exchanging unit, one of the first header and the second header is positioned at a terminating end of the third portion. In the first heat-exchanging unit, another of the first header and the second header is positioned at a leading end of the fourth portion that is disposed apart from the terminating end of the third portion. In the first heat-exchanging unit, the terminating end of the third portion is disposed closer than a leading end of the third portion to the connection pipe insertion port. In the first heat-exchanging unit, the leading end of the fourth portion is disposed closer than a terminating end of the fourth portion to the connection pipe insertion port.

Therefore, in the refrigeration apparatus including the first heat-exchanging unit (flat-tube heat exchanger) including the third portion and the fourth portion extending in different directions, a pipe inside the casing (for example, the refrigerant connection pipe that is connected to the inlet or the outlet of the heat exchanger, or the flow path formation portion) can be made short in length. As a result, the pipe inside the casing is easily routed. In relation to this, the refrigeration apparatus has improved workability, is assembled more easily, and is more compact.

In the heat exchanger according to one or more embodiments of the present invention, when the heat exchanger is used as a condenser of a refrigerant, the flat-tube heat exchanger can be formed so that the first superheating area and the first subcooling area are not adjacent to each other one above another. That is, the first superheating area and the first subcooling area can be formed so that heat exchange between the refrigerant that passes through the first superheating area and the refrigerant that passes through the first subcooling area is suppressed. In relation to this, this helps the degree of subcooling of the refrigerant to be properly ensured. Therefore, a reduction in performance is suppressed.

Regarding the heat exchanger according to one or more embodiments of the present invention, in the flat-tube heat exchanger in which a plurality of heat-exchanging units are disposed side by side on the upwind side and on the downwind side, when used as a condenser of a refrigerant, of the first heat-exchanging unit and the second heat-exchanging unit, the superheating area on the upwind side and the subcooling area on the downwind side can be suppressed from partly overlapping each other or being close to each other when viewed in the air flow direction. As a result, passage of the air flow that has passed the superheating area of the heat-exchanging unit on the upwind side through the subcooling area of the heat-exchanging unit on the downwind side is suppressed. Therefore, in the subcooling area in the heat-exchanging unit on the downwind side, temperature differences between the refrigerant and the air flow is easily properly ensured, and cases in which heat exchange is not properly performed and a degree of subcooling is not properly ensured are reduced.

In the heat exchanger according to one or more embodiments of the present invention, temperature unevenness of air that has passed the heat exchanger is suppressed.

In the heat exchanger according to one or more embodiments of the present invention, temperature unevenness of air that has passed the heat exchanger is further suppressed.

Regarding the heat exchanger according to one or more embodiments of the present invention, in the installed state, in the flat-tube heat exchanger in which the flat tubes that extend in the horizontal direction are laminated in the vertical direction and the flow path through which the liquid refrigerant flows is disposed below the flow path through which the gas refrigerant flows, a reduction in performance is suppressed.

Regarding the heat exchanger according to one or more embodiments of the present invention, in the flat-tube heat exchanger that includes the heat-exchanging unit including the first portion and the second portion extending in different directions, a reduction in performance is suppressed.

Regarding the heat exchanger according to one or more embodiments of the present invention, in the flat-tube heat exchanger having a substantially square shape when viewed in the header extension direction, a reduction in performance is suppressed. In addition, ease of assembly is increased.

The refrigeration apparatus according to one or more embodiments of the present invention has improved workability, is assembled more easily, and is more compact.

DETAILED DESCRIPTION

An indoor heat exchanger 25 (heat exchanger) and an air conditioner 100 (refrigeration apparatus) according to one or more embodiments of the present invention are described below with reference to the drawings. The embodiments below are specific examples of the present invention, do not limit the technical scope of the present invention, and are changeable as appropriate within a scope that does not depart from the spirit of the invention. In the embodiments below, directions, such as up, down, left, right, front, or rear, mean directions shown in FIGS. 2 to 6.

In the description below, unless otherwise noted, the term "gas refrigerant" encompasses not only a gas refrigerant in a saturated state or a superheated state, but also a refrigerant in a gas-liquid two-phase state, and the term "liquid refrigerant" encompasses not only a liquid refrigerant in a saturated state or a subcooled state, but also a refrigerant in a gas-liquid two-phase state.

(1) Air Conditioner 100

Figure 1:
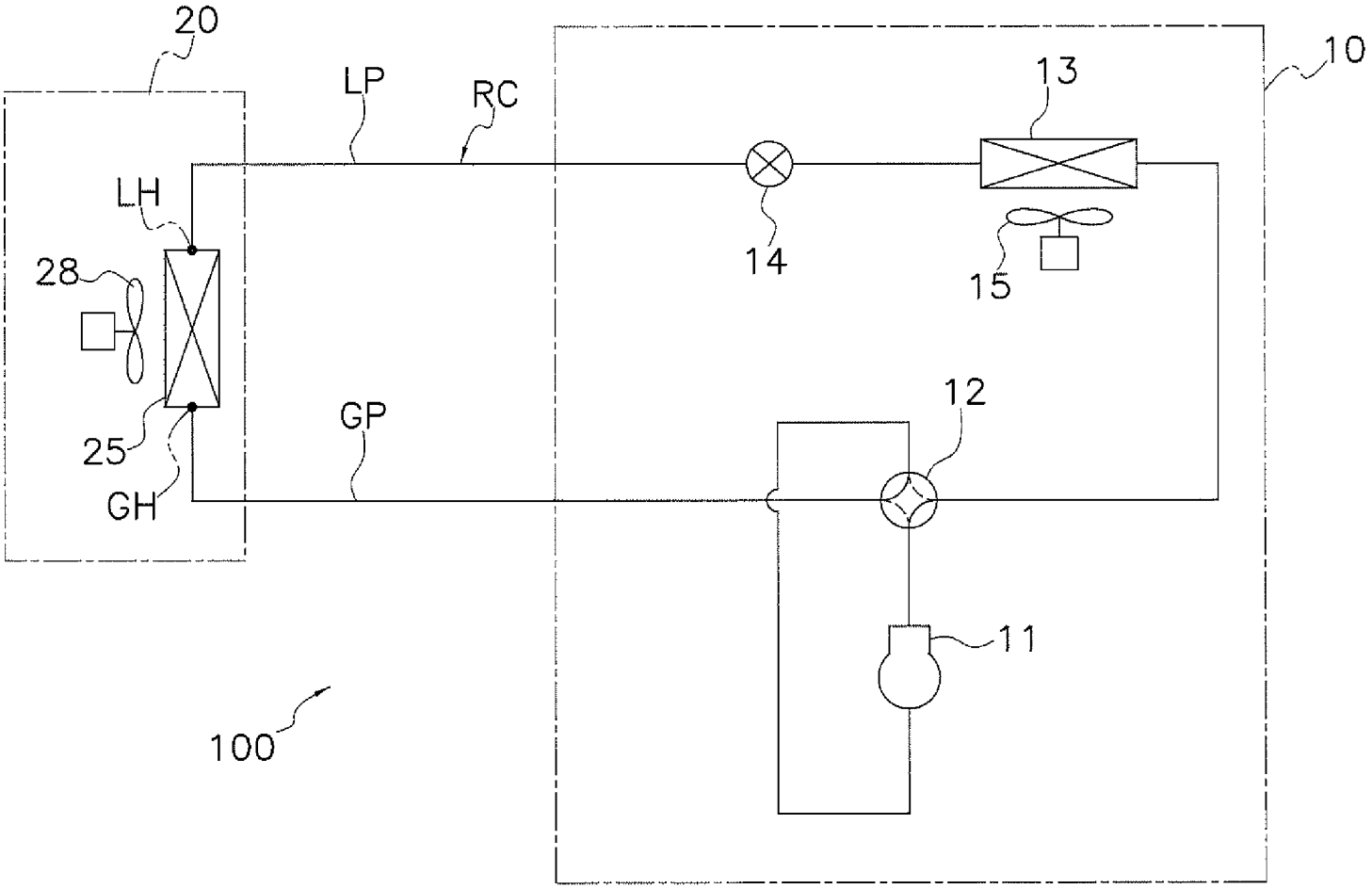
FIG. 1 is a schematic view of a configuration of an air conditioner including an indoor heat exchanger according to one or more embodiments of the present invention.

FIG. 1 is a schematic view of a configuration of the air conditioner 100 including the indoor heat exchanger 25 according to one or more embodiments of the present invention.

The air conditioner 100 is a device that performs a cooling operation or a heating operation and that air-conditions a target space. Specifically, the air conditioner 100 includes a refrigerant circuit RC, and performs a vapor-compression-type refrigeration cycle. The air conditioner 100 primarily includes an outdoor unit 10 that serves as a heat source unit, and an indoor unit 20 that serves as a usage unit. In the air conditioner 100, the refrigerant circuit RC is formed by connecting the outdoor unit 10 and the indoor unit 20 by a gas-side connection pipe GP and a liquid-side connection pipe LP. Although a refrigerant that is sealed in the refrigerant circuit RC is not limited, for example, a HFC refrigerant, such as R32 and R410A, is sealed in the refrigerant circuit RC.

(1-1) Outdoor Unit 10

The outdoor unit 10 is installed outdoors. The outdoor unit 10 primarily includes a compressor 11, a four-way switching valve 12, an outdoor heat exchanger 13, an expansion valve 14, and an outdoor fan 15.

The compressor 11 is a mechanism that sucks in a low-pressure gas refrigerant, compresses the gas refrigerant, and discharges the compressed gas refrigerant. During operation, the compressor 11 is controlled by an inverter to adjust the number of revolutions in accordance with the situation.

The four-way switching valve 12 is a switching valve for switching the direction of flow of a refrigerant when switching between a cooling operation (normal cycle operation) and a heating operation (reverse cycle operation). The four-way switching valve 12 switches a state (refrigerant flow path) in accordance with an operating mode.

The outdoor heat exchanger 13 is a heat exchanger that functions as a condenser of a refrigerant when a cooling operation is performed and that functions as an evaporator of a refrigerant when a heating operation is performed. The outdoor heat exchanger 13 includes a plurality of heat transfer tubes and a plurality of heat transfer fins (not shown).

The expansion valve 14 is an electrically operated valve that decompresses a high-pressure refrigerant that flows therein. The expansion valve 14 adjusts as appropriate an opening degree thereof in accordance with an operation state.

The outdoor fan 15 is a fan that generates an outdoor air flow that flows out of the outdoor unit 10 after flowing into the outdoor unit 10 from the outside and passing the outdoor heat exchanger 13.

(1-2) Indoor Unit 20

The indoor unit 20 is installed indoors (more specifically, the target space where air-conditioning is performed). The indoor unit 20 primarily includes the indoor heat exchanger 25 and an indoor fan 28.

The indoor heat exchanger 25 (corresponding to "heat exchanger" in the claims) functions as an evaporator of a refrigerant when a cooling operation is performed and functions as a condenser of a refrigerant when a heating operation is performed. In the indoor heat exchanger 25, the gas-side connection pipe GP is connected to inlets/outlets of a gas refrigerant (gas-side inlets/outlets GH), and the liquid-side connection pipe LP is connected to inlets/outlets of a liquid refrigerant (liquid-side inlets/outlets LH). The indoor heat exchanger 25 is described in detail below.

The indoor fan 28 is a fan that generates air flow (indoor air flow AF; see, for example, FIGS. 3 to 5 and FIGS. 7 and 8) that flows out of the indoor unit 20 after flowing into the indoor unit 20 from the outside and passing the indoor heat exchanger 25. During operation, driving of the indoor fan 28 is controlled by a control unit (not shown) to adjust as appropriate the number of revolutions.

(1-3) Gas-Side Connection Pipe GP, Liquid-Side Connection Pipe LP

The gas-side connection pipe GP and the liquid-side connection pipe LP are pipes that are installed at a construction site. The pipe diameter and the pipe length of each of the gas-side connection pipe GP and the liquid-side connection pipe LP are individually selected in accordance with design specifications and installation environments.

The gas-side connection pipe GP (corresponding to "refrigerant connection pipe" in the claims) is a pipe primarily for allowing passage of a gas refrigerant between the outdoor unit 10 and the indoor unit 20. The gas-side connection pipe GP branches into a first gas-side connection pipe GP1 and a second gas-side connection pipe GP2 on a side of the indoor unit 20 (see, for example, FIGS. 6, 9, and 12).

The liquid-side connection pipe LP (corresponding to "refrigerant connection pipe" in the claims) is a pipe primarily for allowing passage of a liquid refrigerant between the outdoor unit 10 and the indoor unit 20. The liquid-side connection pipe LP branches into a first liquid-side connection pipe LP1 and a second liquid-side connection pipe LP2 on the side of the indoor unit 20 (see, for example, FIGS. 6, 9, and 12).

(2) Flow of Refrigerant in Air Conditioner 100

In the air conditioner 100, when a cooling operation (normal cycle operation) is performed or a heating operation (reverse cycle operation) is performed, a refrigerant circulates so as to flow as indicated below in the refrigerant circuit RC.

(2-1) When Cooling Operation is Performed

When a cooling operation is performed, the state of the four-way switching valve 12 becomes a state indicated by a solid line in FIG. 1, a discharge side of the compressor 11 communicates with a gas side of the outdoor heat exchanger 13, and an intake side of the compressor 11 communicates with a gas side of the indoor heat exchanger 25.

When the compressor 11 is driven in such a state, a low-pressure gas refrigerant is compressed by the compressor 11 and becomes a high-pressure gas refrigerant. The high-pressure gas refrigerant is sent to the outdoor heat exchanger 13 via the four-way switching valve 12. Then, at the outdoor heat exchanger 13, the high-pressure gas refrigerant exchanges heat with an outdoor air flow and is thereby condensed to become a high-pressure liquid refrigerant (liquid refrigerant in a subcooled state). The high-pressure liquid refrigerant that has flown out from the outdoor heat exchanger 13 is sent to the expansion valve 14. A low-pressure refrigerant obtained by decompressing the high-pressure liquid refrigerant at the expansion valve 14 flows through the liquid-side connection pipe LP and flows into the indoor heat exchanger 25 from the liquid-side inlet/outlet LH. The refrigerant that has flown into the indoor heat exchanger 25 exchanges heat with the indoor air flow AF and thereby evaporates and becomes a low-pressure gas refrigerant (gas refrigerant in a superheated state). The low-pressure gas refrigerant flows out from the indoor heat exchanger 25 via the gas-side inlet/outlet GH. The refrigerant that has flown out from the indoor heat exchanger 25 flows through the gas-side connection pipe GP and is sucked into the compressor 11.

(2-2) When Heating Operation is Performed

When a heating operation is performed, the state of the four-way switching valve 12 becomes a state indicated by a broken line in FIG. 1, the discharge side of the compressor 11 communicates with the gas side of the indoor heat exchanger 25, and the intake side of the compressor 11 communicates with the gas side of the outdoor heat exchanger 13.

When the compressor 11 is driven in such a state, a low-pressure gas refrigerant is compressed by the compressor 11 and becomes a high-pressure gas refrigerant. The high-pressure gas refrigerant is sent to the indoor heat exchanger 25 via the four-way switching valve 12 and the gas-side connection pipe GP. The high-pressure gas refrigerant that has been sent to the indoor heat exchanger 25 flows into the indoor heat exchanger 25 via the gas-side inlet/outlet GH and exchanges heat with the indoor air flow AF and is thereby condensed to become a high-pressure liquid refrigerant (liquid refrigerant in a subcooled state). Then, the high-pressure liquid refrigerant flows out from the indoor heat exchanger 25 via the liquid-side inlet/outlet LH. The refrigerant that has flown out from the indoor heat exchanger 25 is sent to the expansion valve 14 via the liquid-side connection pipe LP. The high-pressure gas refrigerant that has been sent to the expansion valve 14 is decompressed in accordance with the valve opening degree of the expansion valve 14 when the gas refrigerant passes through the expansion valve 14. A low-pressure refrigerant obtained by the passage of the high-pressure gas refrigerant through the expansion valve 14 flows into the outdoor heat exchanger 13. The low-pressure refrigerant that has flown into the outdoor heat exchanger 13 exchanges heat with an outdoor air flow, evaporates, becomes a low-pressure gas refrigerant, and is sucked into the compressor 11 via the four-way switching valve 12.

(3) Details of Indoor Unit 20

Figure 2:
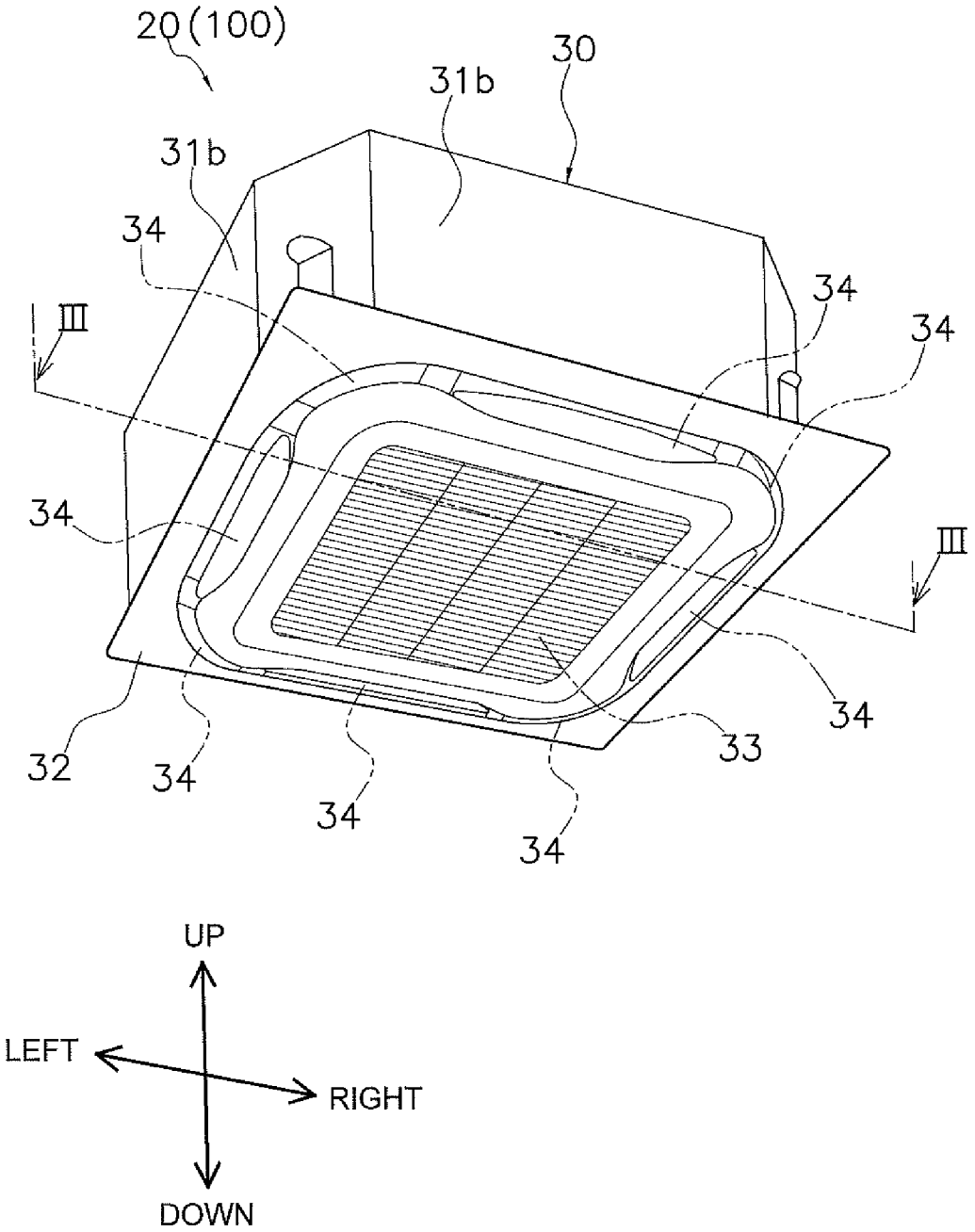
FIG. 2 is a perspective view of an indoor unit.
Figure 3:
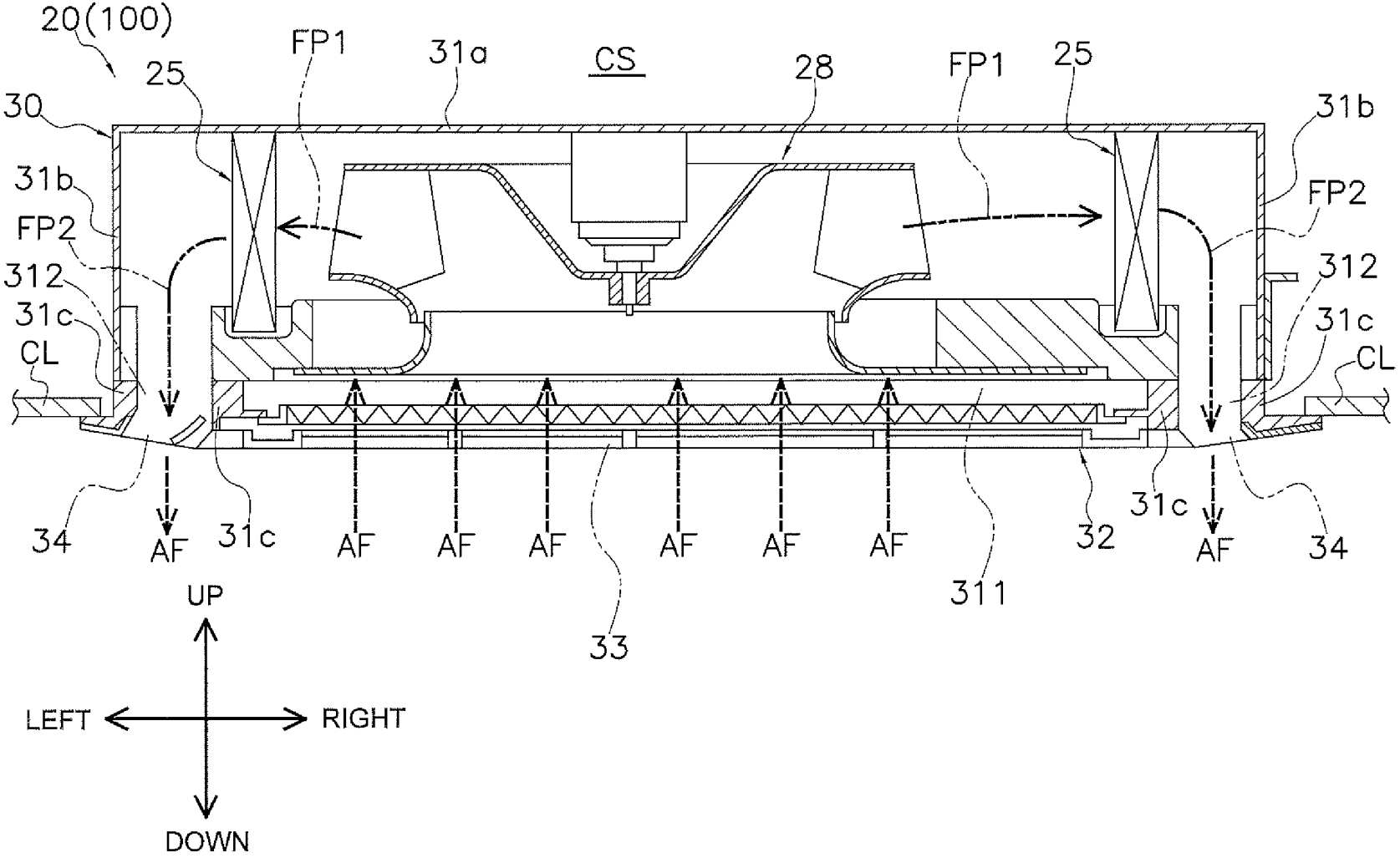
FIG. 3 is a schematic view of a section along line III-III in FIG. 2.
Figure 4:
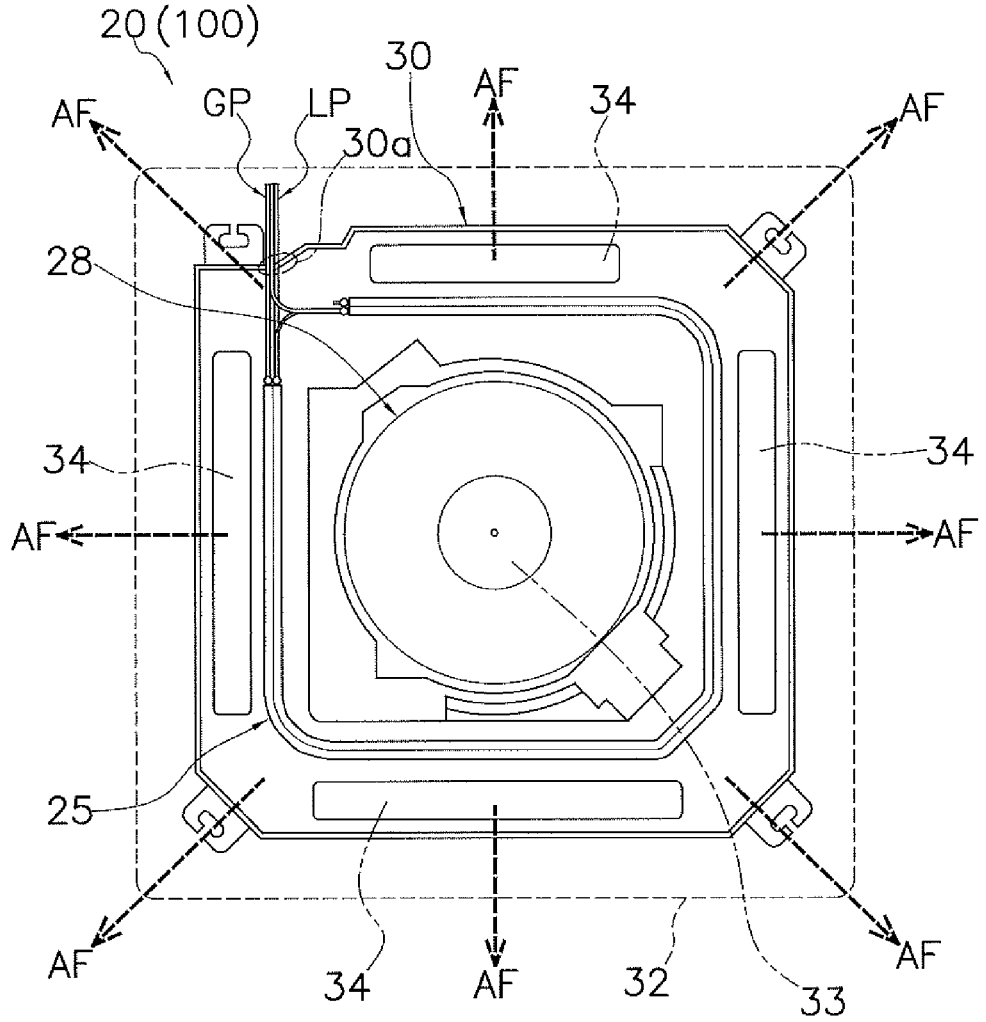
FIG. 4 is a schematic view schematically showing a configuration of the indoor unit when viewed from a lower surface.
Figure 4:
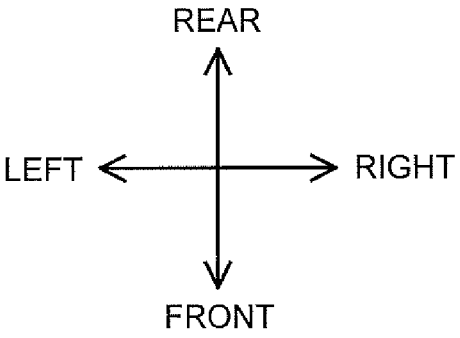

FIG. 2 is a perspective view of the indoor unit 20. FIG. 3 is a schematic view of a section along line III-III in FIG. 2. FIG. 4 is a schematic view schematically showing a configuration of the indoor unit 20 when viewed from a lower surface.

The indoor unit 20 is a so-called ceiling-embedded-type air-conditioning indoor unit, and is installed on a ceiling of the target space. The indoor unit 20 includes a casing 30 that forms the outer contour.

The casing 30 accommodates devices, such as the indoor heat exchanger 25 and the indoor fan 28. As shown in FIG. 3, the casing 30 is installed in a ceiling rear space CS via an opening formed in a ceiling surface CL of the target space, the ceiling rear space CS being formed between the ceiling surface CL and an upper-floor floor surface or a roof. The casing 30 includes a top panel 31*a*, side plates 31*b*, and a bottom plate 31*c*, and a decorative panel 32.

The top panel 31*a* is a member that constitutes a top-surface portion of the casing 30, and has a substantially octagonal shape in which long sides and short sides are alternately and continuously formed.

The side plates 31*b* are members that constitute side-surface portions of the casing 30, and include surface portions that correspond in a one-to-one ratio with the long sides and the short sides of the top panel 31*a*. An opening (connection pipe insertion port 30*a*) for inserting (bringing) the gas-side connection pipe GP and the liquid-side connection pipe LP into the casing is formed in the side plate 31*b* (see alternate long and short dashed line of FIG. 4).

The bottom plate 31*c* is a member that constitutes a bottom-surface portion of the casing 30. A large substantially square opening 311 is formed in the center of the bottom plate 31*c*, and a plurality of openings 312 are formed around the large opening 311. A lower surface side (target space side) of the bottom plate 31*c* is attached to the decorative panel 32.

The decorative panel 32 is a plate-shaped member that is exposed at the target space, and has a substantially square shape in plan view. The decorative panel 32 is fitted into and installed in the opening of the ceiling surface CL. An intake port 33 and blow-out ports 34 for the indoor air flow AF are formed in the decorative panel 32. The intake port 33 that is large and that has a substantially square shape is formed in a central portion of the decorative panel 32 and at a position where the intake port 33 overlaps the large opening 311 of the bottom plate 31*c* in plan view. The blow-out ports 34 are formed in the vicinity of the intake port 33 so as to surround the intake port 33.

An intake flow path FP1 for guiding the indoor air flow AF that has flown into the casing 30 via the intake port 33 to the indoor heat exchanger 25 and a blow-out flow path FP2 for sending the indoor air flow AF that has passed the indoor heat exchanger 25 to the blow-out ports 34 are formed in a space inside the casing 30. The blow-out flow path FP2 is disposed so as to surround the intake flow path FP1 on an outer side of the intake flow path FP1.

Inside the casing 30, the indoor fan 28 is disposed at a central portion thereof, and the indoor heat exchanger 25 is disposed so as to surround the indoor fan 28. In plan view, the indoor fan 28 overlaps the intake port 33. In plan view, the indoor heat exchanger 25 has a substantially square shape, and is disposed so as to surround the intake port 33 and so as to be surrounded by the blow-out ports 34.

In the indoor unit 20, in the above-described mode, the intake port 33, the blow-out ports 34, the intake flow path FP1, and the blow-out flow path FP2 are formed, and the indoor heat exchanger 25 and the indoor fan 28 are arranged. Therefore, during operation, the indoor air flow AF generated by the indoor fan 28 flows into the casing 30 via the intake port 33, is guided to the indoor heat exchanger 25 via the intake flow path FP1, and exchanges heat with a refrigerant inside the indoor heat exchanger 25, after which the air flow AF is sent to the blow-out ports 34 via the blow-out flow path FP2, and is blown out to the target space from the blow-out ports 34.

In the description below, the direction in which the indoor air flow AF flows when the indoor air flow AF passes the indoor heat exchanger 25 is called "air flow direction dr3". In one or more embodiments, the air flow direction dr3 corresponds to a horizontal direction.

(4) Details of Indoor Heat Exchanger 25

(4-1) Configuration of Indoor Heat Exchanger 25

Figure 5:
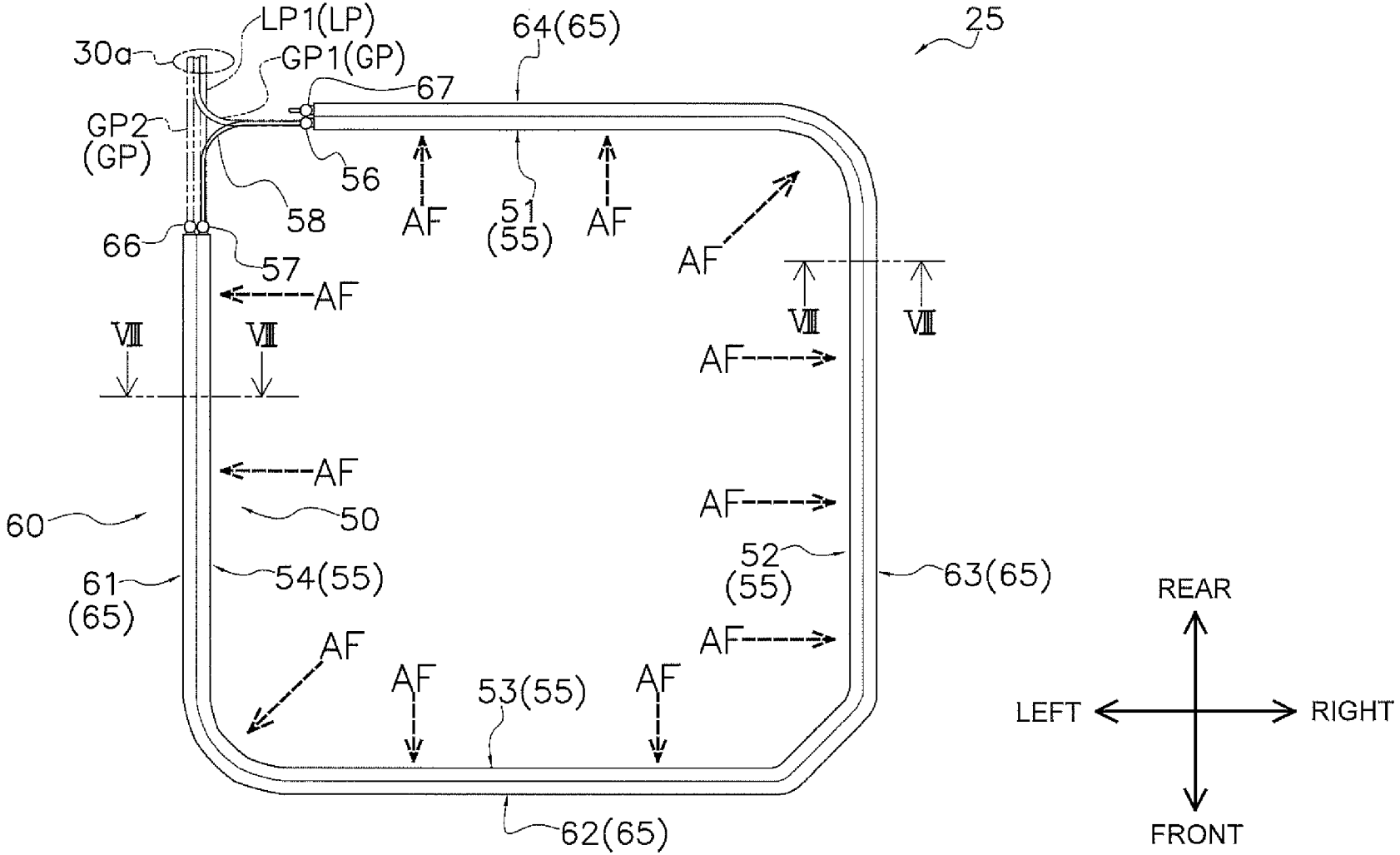
FIG. 5 is a schematic view schematically showing the indoor heat exchanger when viewed in a heat-transfer-tube lamination direction.
Figure 6:
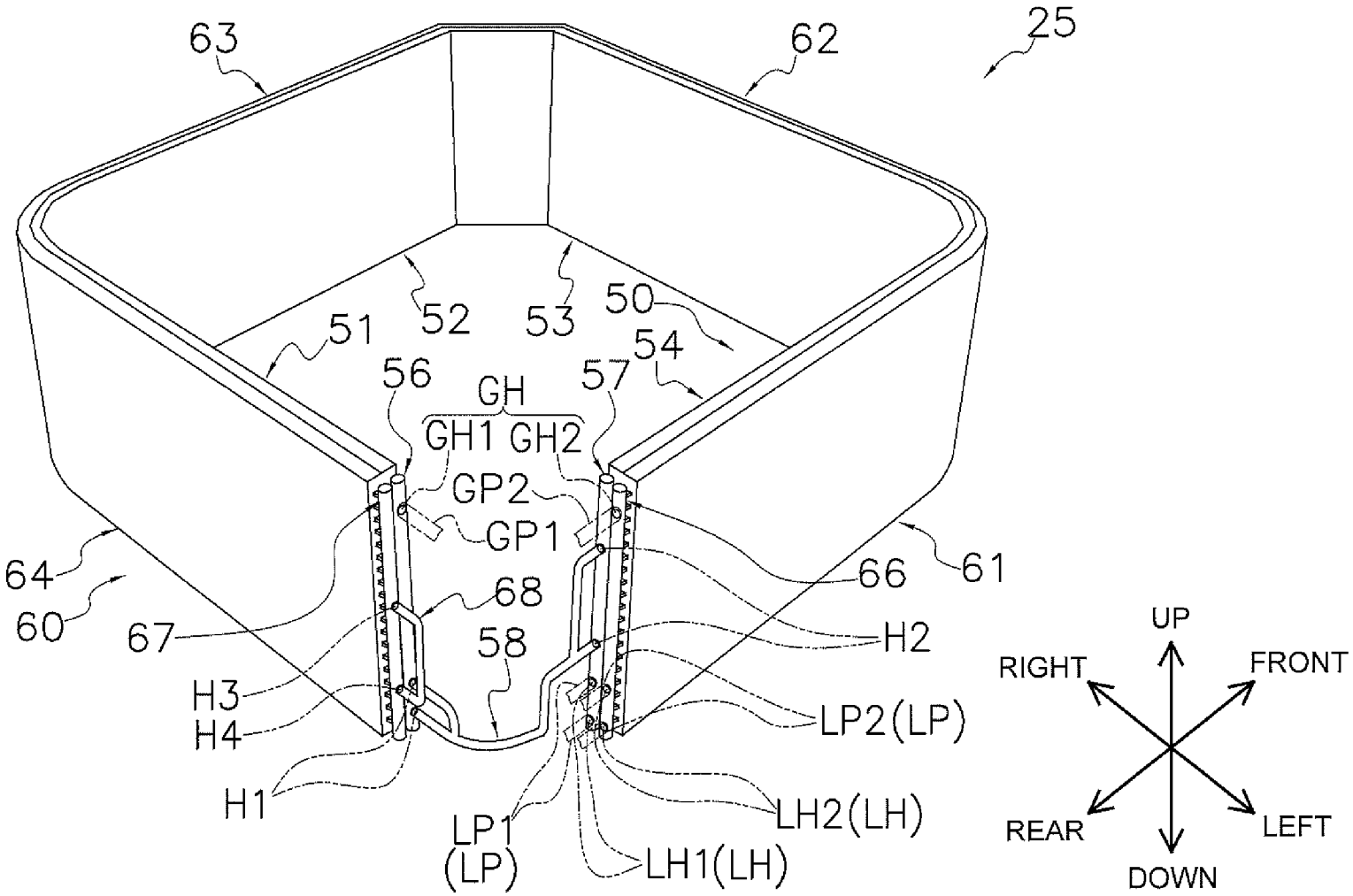
FIG. 6 is a perspective view of the indoor heat exchanger.
Figure 7:
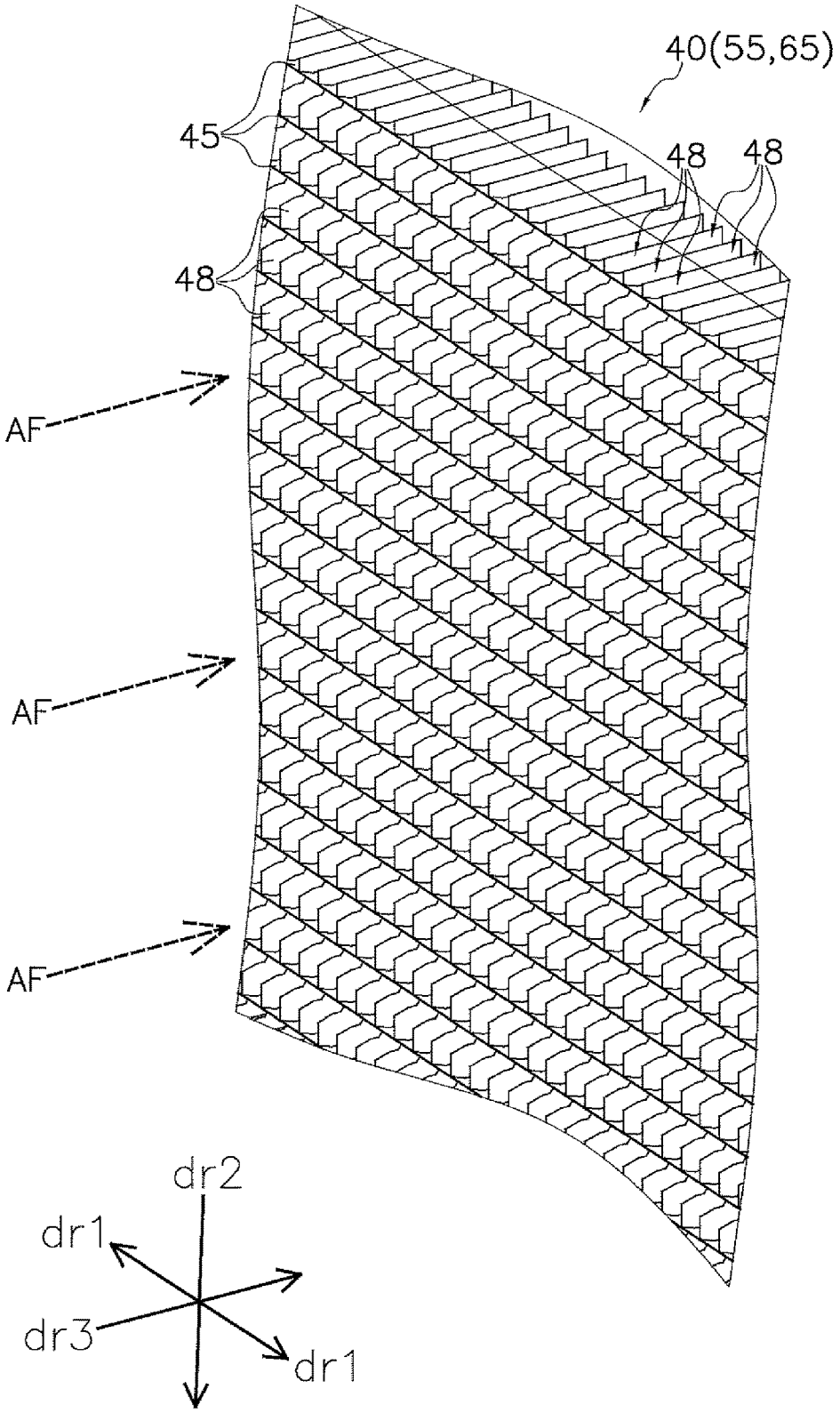
FIG. 7 is a perspective view showing a part of a heat-exchange surface.
Figure 8:
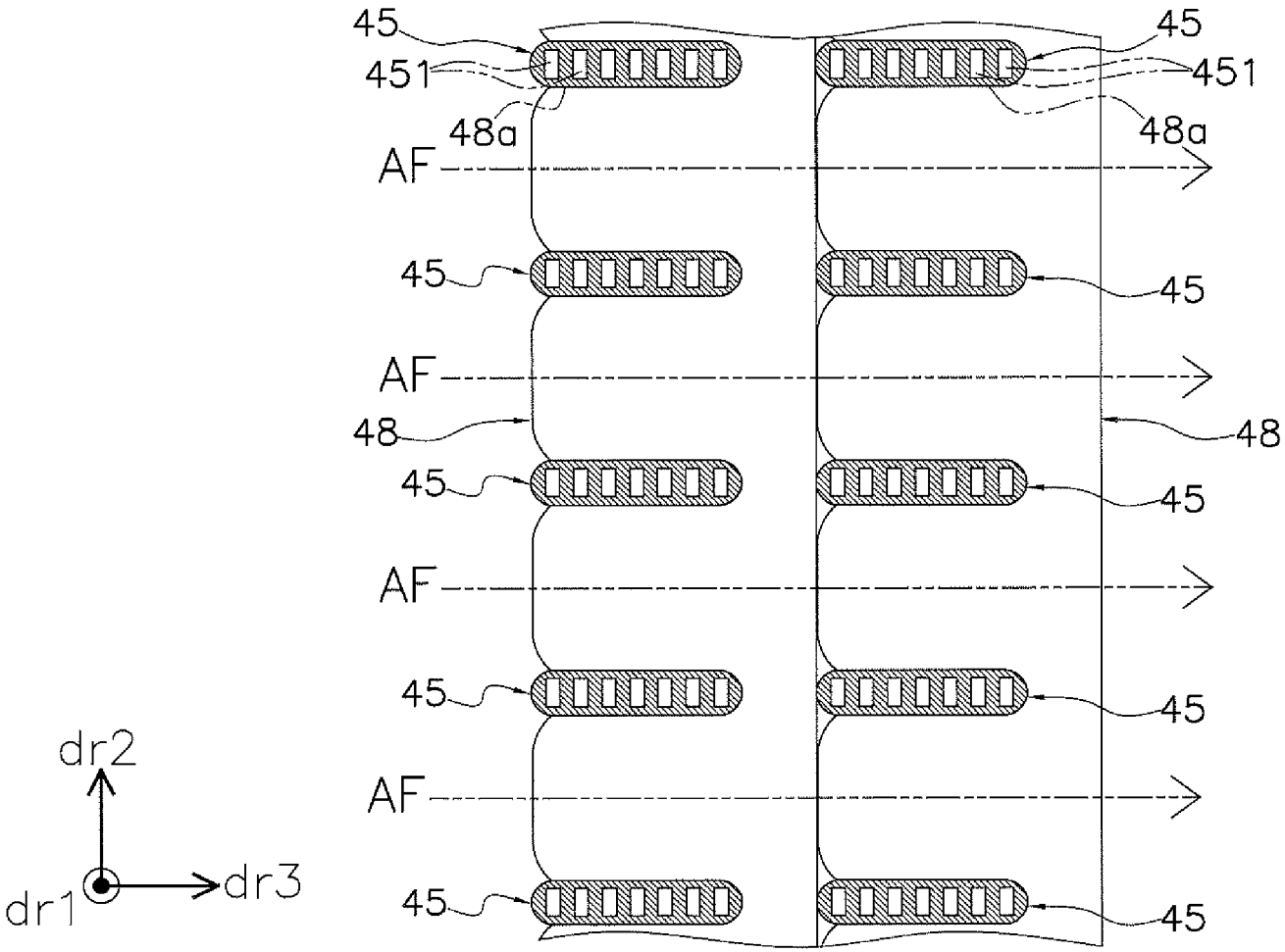
FIG. 8 is a schematic view of a section along line VIII-VIII in FIG. 5.

FIG. 5 is a schematic view schematically showing the indoor heat exchanger 25 when viewed in a heat-transfer-tube lamination direction dr2. FIG. 6 is a perspective view of the indoor heat exchanger 25. FIG. 7 is a perspective view showing a part of a heat-exchange surface 40. FIG. 8 is a schematic view of a section along line VIII-VIII in FIG. 5.

As described above, the indoor heat exchanger 25 allows a refrigerant to flow in or flow out via the gas-side inlets/outlets GH and the liquid-side inlets/outlets LH. When a heating operation is performed (that is, when the indoor heat exchanger 25 is used as a condenser), the gas-side inlets/outlets GH functions as inlets of a refrigerant (primarily, a gas refrigerant in a superheated state), and the liquid-side inlets/outlets LH functions as outlets of a refrigerant (primarily, a liquid refrigerant in a subcooled state).

In the indoor heat exchanger 25, when a heating operation is performed, superheating areas (SH3 and SH4 shown in FIGS. 15 and 16) that are areas where a refrigerant in a superheated state flows and subcooling areas (SC1 and SC2 shown in FIGS. 15 and 16) that are areas where a refrigerant in a subcooled state flows are formed.

A plurality of gas-side inlets/outlets GH (here, two gas-side inlets/outlets GH) and a plurality of liquid-side inlets/outlets LH (here, two liquid-side inlets/outlets LH) are formed in the indoor heat exchanger 25. Specifically, in the indoor heat exchanger 25, a first gas-side inlet/outlet GH1 (corresponding to "gas refrigerant inlet/outlet" in the claims) and a second gas-side inlet/outlet GH2 (corresponding to "second gas refrigerant inlet/outlet" in the claims) are formed as the gas-side inlets/outlets GH. In addition, in the indoor heat exchanger 25, first liquid-side inlets/outlets LH1 (corresponding to "liquid refrigerant inlet/outlet" in the claims) and second liquid-side inlets/outlets LH2 (corresponding to "second liquid refrigerant inlet/outlet" in the claims) are formed as the liquid-side inlets/outlets LH. The first gas-side inlet/outlet GH1 and the second gas-side inlet/outlet GH2 are positioned above the first liquid-side inlets/outlets LH1 and the second liquid-side inlets/outlets LH2.

The indoor heat exchanger 25 includes heat-exchange surfaces 40, which are provided for exchanging heat with the indoor air flow AF, on an upwind side and on a downwind side of the indoor air flow AF. The indoor heat exchanger 25 is such that each heat-exchange surface 40 includes a plurality of heat transfer tubes 45 (here, 19 heat transfer tubes 45) (see, for example, FIGS. 7 and 8), where a refrigerant flows, and a plurality of heat transfer fins 48 (see, for example, FIGS. 7 and 8) that facilitate heat exchange between the refrigerant and the indoor air flow AF.

Each heat transfer tube 45 is arranged so as to extend in a predetermined heat-transfer-tube extension direction dr1 (here, a horizontal direction), and is laminated so as to be disposed apart from each other in the predetermined heat-transfer-tube lamination direction dr2 (here, a vertical direction). The heat-transfer-tube extension direction dr1 is a direction intersecting the heat-transfer-tube lamination direction dr2 and the air flow direction dr3, and, in plan view, corresponds to a direction in which the heat-exchange surfaces 40 including the heat transfer tubes 45 extend. The heat-transfer-tube lamination direction dr2 is a direction intersecting the heat-transfer-tube extension direction dr1 and the air flow direction dr3. In one or more embodiments, since the indoor heat exchanger 25 includes the heat-exchange surfaces 40 on the upwind side and on the downwind side, in the indoor heat exchanger 25, the heat transfer tubes 45 that are arranged side by side in two rows in the air flow direction dr3 are laminated in a plurality of layers in the heat-transfer-tube lamination direction dr2. The number, the number of rows, and the number of layers of the heat transfer tubes 45 that are included at the heat-exchange surfaces 40 can be changed as appropriate in accordance with design specifications.

Each heat transfer tube 45 is a flat tube whose section has a flat shape and that is made of aluminum or an aluminum alloy. More specifically, each heat transfer tube 45 is a flat multi-perforated tube (see FIG. 8) in which a plurality of refrigerant flow paths (heat-transfer-tube flow paths 451) extending in the heat-transfer-tube extension direction dr1 are formed therein. The plurality of heat-transfer-tube flow paths 451 are arranged side by side in the air flow direction dr3 in each heat transfer tube 45.

The heat transfer fins 48 are plate-shaped members that increase the heat transfer area between the heat transfer tubes 45 and the indoor air flow AF. Each heat transfer fin 48 is made of aluminum or an aluminum alloy. A longitudinal direction of the heat transfer fins 48 extends in the heat-transfer-tube lamination direction dr2 so as to intersect the heat transfer tubes 45. A plurality of slits 48*a* are formed side by side and apart from each other in the heat-transfer-tube lamination direction dr2 in the heat transfer fins 48, and the heat transfer tubes 45 are inserted into the respective slits 48*a* (see FIG. 8).

At the heat-exchange surfaces 40, each heat transfer fin 48 is arranged side by side and apart from each other in the heat-transfer-tube extension direction dr1 along with other heat transfer fins 48. In one or more embodiments, since the heat exchanger 25 includes the heat-exchange surfaces 40 on the upwind side and on the downwind side, in the indoor heat exchanger 25, the heat transfer fins 48 extending in the heat-transfer-tube lamination direction dr2 are arranged in two rows in the air flow direction dr3 and side by side in the heat-transfer-tube extension direction dr1. The number of heat transfer fins 48 that are included at the heat-exchange surfaces 40 is selected in accordance with the length of each heat transfer tube 45 in the heat-transfer-tube extension direction dr1, and can be selected and changed as appropriate in accordance with design specifications.

Figure 9:
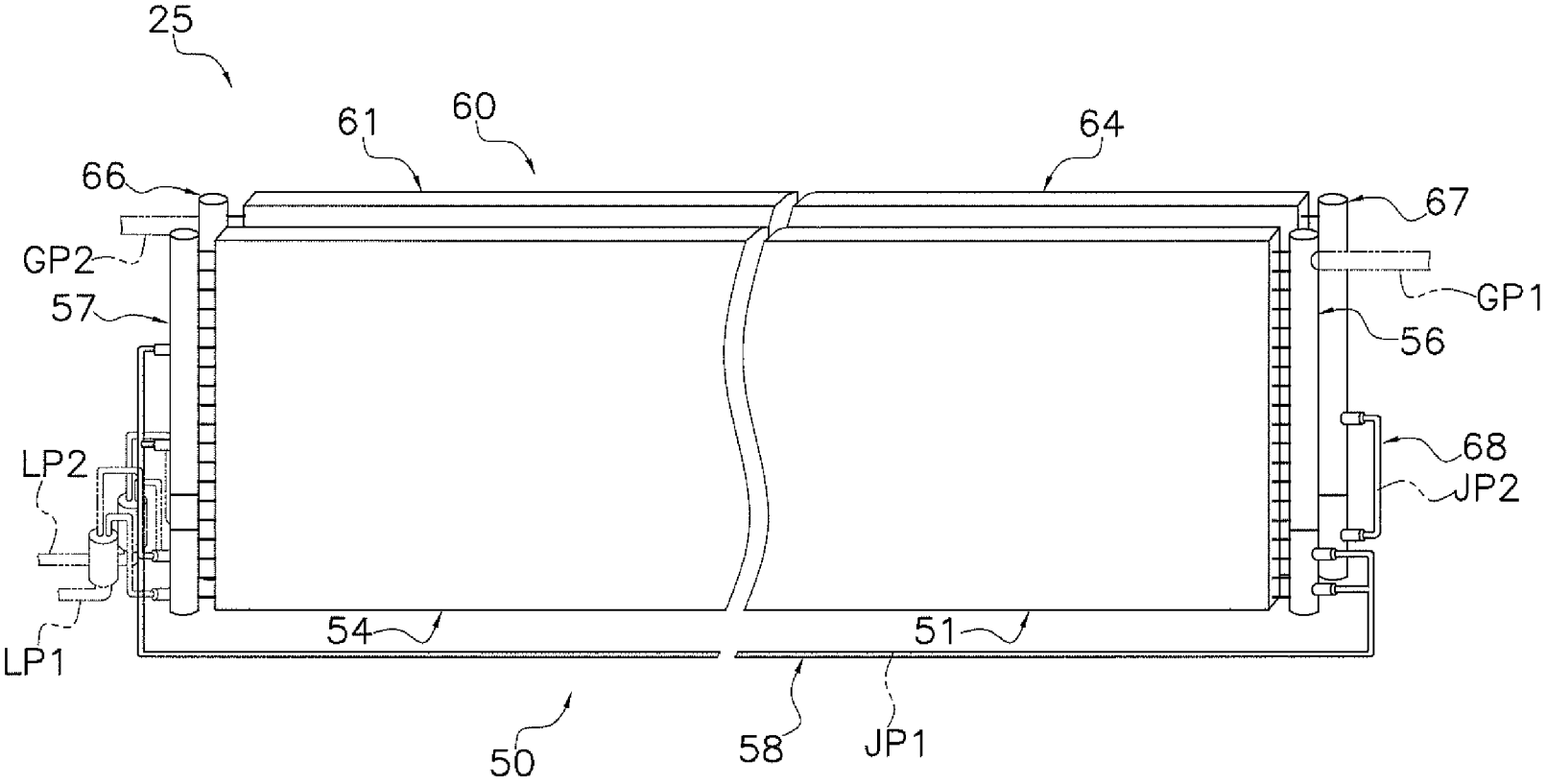
FIG. 9 is a schematic view schematically showing a mode of construction of the indoor heat exchanger.

FIG. 9 is a schematic view schematically showing a mode of construction of the indoor heat exchanger 25. The indoor heat exchanger 25 primarily includes an upwind heat-exchanging unit 50 including the heat-exchange surfaces 40 that are disposed on the upwind side and a downwind heat-exchanging unit 60 including the heat-exchange surfaces 40 that are disposed on the downwind side. When viewed in the air flow direction dr3, the upwind heat-exchanging unit 50 is disposed on the upwind side of the downwind heat-exchanging unit 60 (that is, the downwind heat-exchanging unit 60 is disposed on the downwind side of the upwind heat-exchanging unit 50).

(4-1-1) Upwind Heat-Exchanging Unit 50

Figure 10:
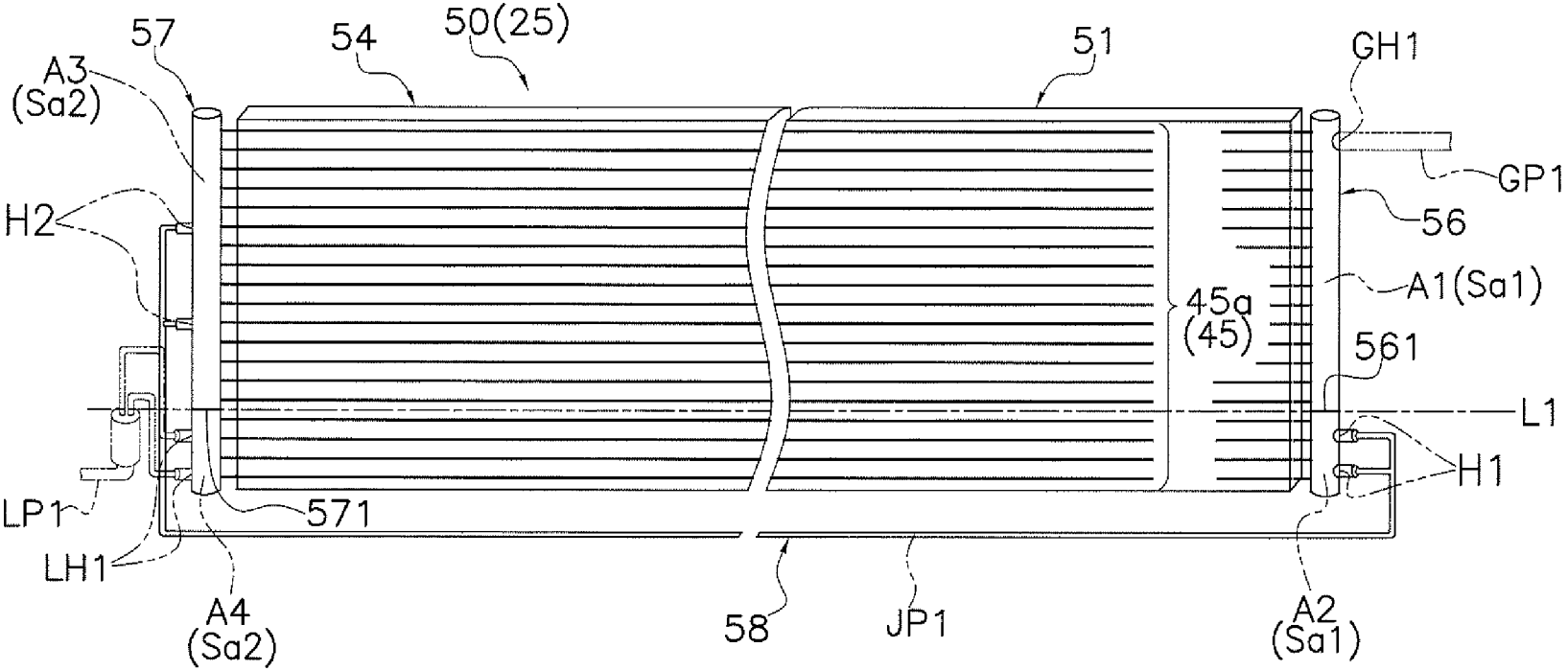
FIG. 10 is a schematic view schematically showing a mode of construction of an upwind heat-exchanging unit.

FIG. 10 is a schematic view schematically showing a mode of construction of the upwind heat-exchanging unit 50. The upwind heat-exchanging unit 50 (corresponding to "first heat-exchanging unit" in the claims) primarily includes, as the heat-exchange surfaces 40, an upwind first heat-exchange surface 51, an upwind second heat-exchange surface 52, an upwind third heat-exchange surface 53, and an upwind fourth heat-exchange surface 54 (these are collectively referred to as "upwind heat-exchange surfaces 55" below); an upwind first header 56; an upwind second header 57; and an upwind turn-around pipe 58. In the description below, the heat transfer tubes 45 that are included at the upwind heat-exchange surfaces 55 are called "upwind heat transfer tubes 45*a*" (corresponding to "first flat tubes" in the claims).

(4-1-1-1) Upwind Heat-Exchange Surfaces 55

Of the upwind heat-exchange surfaces 55, the upwind first heat-exchange surface 51 (corresponding to "first portion" or "third portion" in the claims) is positioned on a most downstream side of a flow of a refrigerant when a cooling operation is performed, and is positioned on a most upstream side of a flow of a refrigerant when a heating operation is performed. Of the upwind heat-exchange surfaces 55, when viewed in the heat-transfer-tube lamination direction dr2 (here, in plan view), the upwind first heat-exchange surface 51 has its terminating end connected to the upwind first header 56, and primarily extends from the left towards the right. The upwind first heat-exchange surface 51 is positioned closer than the upwind second heat-exchange surface 52 and the upwind third heat-exchange surface 53 to the connection pipe insertion port 30*a*. More specifically, the terminating end of the upwind first heat-exchange surface 51 is positioned closer than a leading end of the upwind first heat-exchange surface 51 to the connection pipe insertion port 30*a*.

Of the upwind heat-exchange surfaces 55, the upwind second heat-exchange surface 52 (corresponding to "second portion" in the claims) is positioned on an upstream side of a flow of a refrigerant at the upwind first heat-exchange surface 51 when a cooling operation is performed, and is positioned on a downstream side of a flow of a refrigerant at the upwind first heat-exchange surface 51 when a heating operation is performed. When viewed in the heat-transfer-tube lamination direction dr2, the upwind second heat-exchange surface 52 is connected to the leading end of the upwind first heat-exchange surface 51 while a terminating end of the upwind second heat-exchange surface 52 is curved, and primarily extends from the rear towards the front.

Of the upwind heat-exchange surfaces 55, the upwind third heat-exchange surface 53 is positioned on an upstream side of a flow of a refrigerant at the upwind second heat-exchange surface 52 when a cooling operation is performed, and is positioned on a downstream side of a flow of a refrigerant at the upwind second heat-exchange surface 52 when a heating operation is performed. When viewed in the heat-transfer-tube lamination direction dr2, the upwind third heat-exchange surface 53 is connected to a leading end of the upwind second heat-exchange surface 52 while a terminating end of the upwind third heat-exchange surface 53 is curved, and primarily extends from the right towards the left.

Of the upwind heat-exchange surfaces 55, the upwind fourth heat-exchange surface 54 (corresponding to "fourth portion" in the claims) is positioned on an upstream side of a flow of a refrigerant at the upwind third heat-exchange surface 53 when a cooling operation is performed, and is positioned on a downstream side of a flow of a refrigerant at the upwind third heat-exchange surface 53 when a heating operation is performed. When viewed in the heat-transfer-tube lamination direction dr2, the upwind fourth heat-exchange surface 54 is connected to a leading end of the upwind third heat-exchange surface 53 while a terminating end of the upwind fourth heat-exchange surface 54 is curved, and primarily extends from the front towards the rear. A leading end of the upwind fourth heat-exchange surface 54 is connected to the upwind second header 57. The upwind fourth heat-exchange surface 54 is positioned closer than the upwind second heat-exchange surface 52 and the upwind third heat-exchange surface 53 to the connection pipe insertion port 30*a*. More specifically, the leading end of the upwind fourth heat-exchange surface 54 is positioned closer than the terminating end of the upwind fourth heat-exchange surface 54 to the connection pipe insertion port 30*a*.

By including such an upwind first heat-exchange surface 51, upwind second heat-exchange surface 52, upwind third heat-exchange surface 53, and upwind fourth heat-exchange surface 54, when viewed in the heat-transfer-tube lamination direction dr2, the upwind heat-exchange surfaces 55 of the upwind heat-exchanging unit 50 are bent or curved at three or more locations and form a substantially square shape. That is, the upwind heat-exchanging unit 50 has four upwind heat-exchange surfaces 55.

(4-1-1-2) Upwind First Header 56

The upwind first header 56 (corresponding to "first header" in the claims) is a header collecting pipe that functions as, for example, a dividing header that divides a refrigerant to pass through each upwind heat transfer tube 45*a*, a merging header that merges the refrigerants that flow out from the respective upwind heat transfer tubes 45*a*, or a turn-around header for allowing the refrigerants that flow out from the respective upwind heat transfer tubes 45*a* to turn around to other upwind heat transfer tubes 45*a*. In an installed state, a longitudinal direction of the upwind first header 56 is a vertical direction (up-down direction).

The upwind first header 56 is formed in a cylindrical shape, and spaces are formed in the upwind first header 56 (hereunder called "upwind first-header spaces Sa1"). The upwind first header 56 is connected to the terminating end of the upwind first heat-exchange surface 51. The upwind first header 56 is connected to one end of each upwind heat transfer tube 45*a* that is included at the upwind first heat-exchange surface 51, and allows the upwind heat transfer tubes 45*a* and the upwind first-header spaces Sa1 to communicate with each other.

A horizontal partition plate 561 is disposed inside the upwind first header 56, and partitions the upwind first-header spaces Sa1 (here, two upwind first-header spaces Sa1 in the up-down direction; specifically, an upwind first space A1 and an upwind second space A2) from each other in the heat-transfer-tube lamination direction dr2. In other words, the upwind first space A1 and the upwind second space A2 are formed side by side in the up-down direction in the upwind first header 56.

The upwind first space A1 (corresponding to "first space" in the claims) is the upwind first-header space Sa1 that is disposed at an upper layer. The upwind second space A2 (corresponding to "second space" in the claims) is the upwind first-header space Sa1 that is disposed at a lower layer.

The first gas-side inlet/outlet GH1 is formed in the upwind first header 56. The first gas-side inlet/outlet GH1 communicates with the upwind first space A1. The first gas-side connection pipe GP1 is connected to the first gas-side inlet/outlet GH1.

First connection holes H1 for connecting one end of the upwind turn-around pipe 58 are formed in the upwind first header 56. More specifically, the first connection holes H1 (here, two first connection holes H1 in the up-down direction) are formed in the upwind first header 56, and each first connection hole H1 communicates with the upwind second space A2. Portions of the upwind turn-around pipe 58 are individually connected to the respective first connection holes H1.

(4-1-1-3) Upwind Second Header 57

The upwind second header 57 (corresponding to "second header" in the claims) is a header collecting pipe that functions as, for example, a dividing header that divides a refrigerant to pass through each upwind heat transfer tube 45*a*, a merging header that merges the refrigerants that flow out from the respective upwind heat transfer tubes 45*a*, or a turn-around header for allowing the refrigerants that flow out from the respective upwind heat transfer tubes 45*a* to turn around to other upwind heat transfer tubes 45*a*. In an installed state, a longitudinal direction of the upwind second header 57 is a vertical direction (up-down direction).

The upwind second header 57 is formed in a cylindrical shape, and spaces are formed in the upwind second header 57 (hereunder called "upwind second-header spaces Sa2"). The upwind second header 57 is connected to the leading end of the upwind fourth heat-exchange surface 54. The upwind second header 57 is connected to one end of each upwind heat transfer tube 45*a* that is included at the upwind fourth heat-exchange surface 54, and allows the upwind heat transfer tubes 45*a* and the upwind second-header spaces Sa2 to communicate with each other.

A horizontal partition plate 571 is disposed inside the upwind second header 57, and partitions the upwind second-header spaces Sa2 (here, two upwind second-header spaces Sa2 in the up-down direction; specifically, an upwind third space A3 and an upwind fourth space A4) from each other in the heat-transfer-tube lamination direction dr2. In other words, the upwind third space A3 and the upwind fourth space A4 are formed side by side in the up-down direction in the upwind second header 57.

The upwind third space A3 (corresponding to "third space" in the claims) is the upwind second-header space Sa2 that is disposed at an upper layer. The upwind third space A3 communicates with the upwind first space A1 via the upwind heat transfer tubes 45*a*. The upwind third space A3 communicates with the upwind second space A2 via the upwind turn-around pipe 58.

The upwind fourth space A4 (corresponding to "fourth space" in the claims) is the upwind second-header space Sa2 that is disposed at a lower layer. The upwind fourth space A4 communicates with the upwind second space A2 via the upwind heat transfer tubes 45*a*.

Second connection holes H2 for connecting the other end of the upwind turn-around pipe 58 are formed in the upwind second header 57. More specifically, the second connection holes H2 (here, two second connection holes H2 in the up-down direction) are formed in the upwind second header 57, and each second connection hole H2 communicates with the upwind third space A3. Portions of the upwind turn-around pipe 58 are individually connected to the second connection holes H2.

The first liquid-side inlets/outlets LH1 are formed in the upwind second header 57. More specifically, the first liquid-side inlets/outlets LH1 (here, two first liquid-side inlets/outlets LH1 in the up-down direction) are formed in the upwind second header 57, and each first liquid-side inlet/outlet LH1 communicates with the upwind second space A2. Portions of the first liquid-side communication pipe LP1 are individually connected to the respective first liquid-side inlet/outlets LH1. More specifically, the first liquid-side connection pipe LP1 branches into two branching pipes at its end portion, and the first liquid-side inlets/outlets LH1 are connected to the corresponding branching pipes of the first liquid-side connection pipe LP1.

(4-1-1-4) Upwind Turn-Around Pipe 58

The upwind turn-around pipe 58 (corresponding to "first communication path formation portion" in the claims) is a pipe for forming an upwind turn-around flow path JP1 (corresponding to "communication path" in the claims) that allows the upwind first-header space Sa1 and the upwind second-header space Sa2 to communicate with each other. In one or more embodiments, the one end of the upwind turn-around pipe 58 is connected to the upwind first header 56 so as to communicate with the upwind second space A2, and the other end of the upwind turn-around pipe 58 is connected to the upwind second header 57 so as to communicate with the upwind third space A3. More specifically, the upwind turn-around pipe 58 branches into two branching pipes on each of the one end side and the other end side, and the branching pipes on the one end side are connected to the corresponding first connection holes H1, and the branching pipes on the other end side are connected to the corresponding second connection holes H2.

By disposing the upwind turn-around pipe 58 in this way, the upwind second space A2 and the upwind third space A3 communicate with each other by the upwind turn-around flow path JP1. By forming such an upwind turn-around flow path JP1, a refrigerant flows from the upwind second space A2 towards the upwind third space A3 when a cooling operation is performed, and a refrigerant flows from the upwind third space A3 towards the upwind second space A2 when a heating operation is performed.

(4-1-2) Downwind Heat-Exchanging Unit 60

Figure 11:
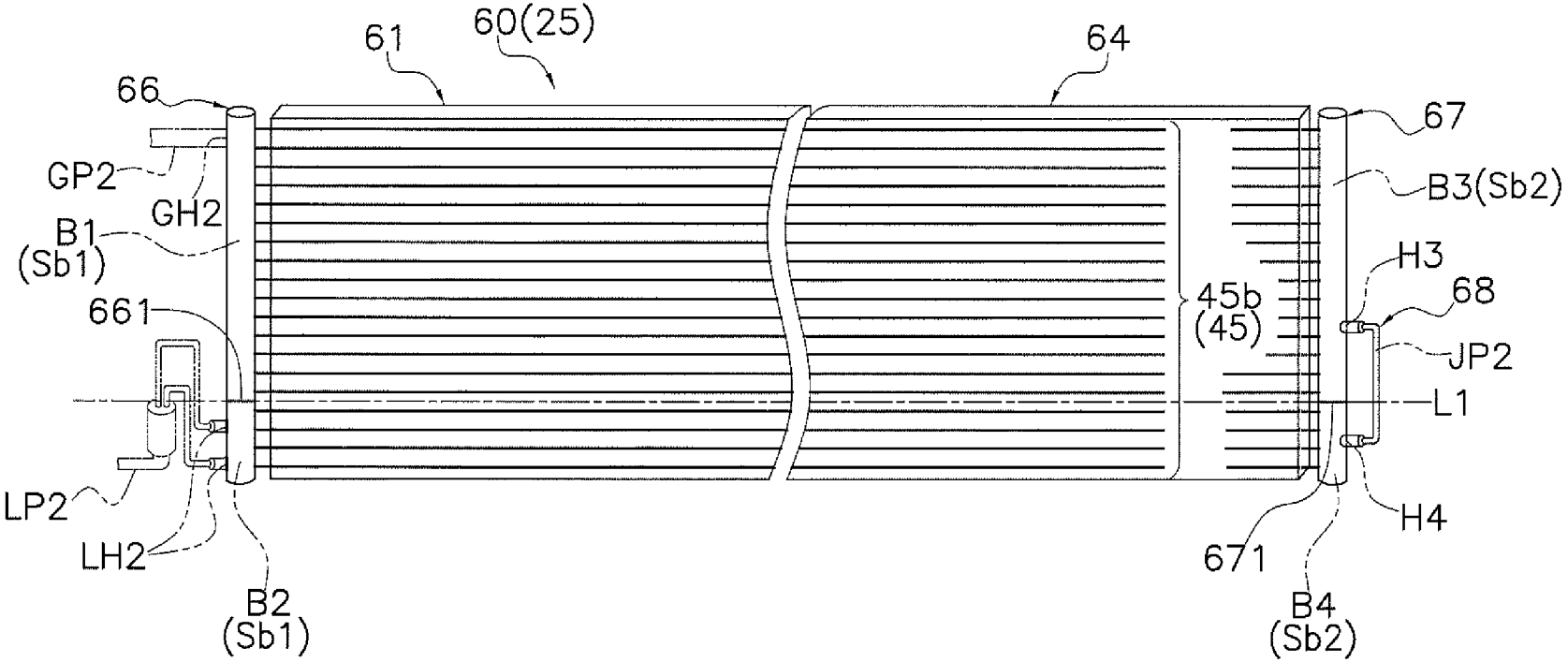
FIG. 11 is a schematic view schematically showing a mode of construction of a downwind heat-exchanging unit.

FIG. 11 is a schematic view schematically showing a mode of construction of the downwind heat-exchanging unit 60. The downwind heat-exchanging unit 60 (corresponding to "second heat-exchanging unit" in the claims) primarily includes, as the heat-exchange surfaces 40, a downwind first heat-exchange surface 61, a downwind second heat-exchange surface 62, a downwind third heat-exchange surface 63, and a downwind fourth heat-exchange surface 64 (these are collectively referred to as "downwind heat-exchange surfaces 65"); a downwind first header 66; a downwind second header 67; and a downwind turn-around pipe 68. In the description below, the heat transfer tubes 45 that are included at the downwind heat-exchange surfaces 65 are called "downwind heat transfer tubes 45*b*" (corresponding to "second flat tubes" in the claims).

(4-1-2-1) Downwind Heat-Exchange Surfaces 65

Of the downwind heat-exchange surfaces 65, the downwind first heat-exchange surface 61 is positioned on a most downstream side of a flow of a refrigerant when a cooling operation is performed, and is positioned on a most upstream side of a flow of a refrigerant when a heating operation is performed. When viewed in the heat-transfer-tube lamination direction dr2 (here, in plan view), the downwind first heat-exchange surface 61 has its terminating end connected to the downwind first header 66, and primarily extends from the rear towards the front. The downwind first heat-exchange surface 61 has substantially the same area as the upwind fourth heat-exchange surface 54 when viewed in the air flow direction dr3, and is adjacent to the downwind side of the upwind fourth heat-exchange surface 54 in the air flow direction dr3. The downwind first heat-exchange surface 61 is positioned closer than the downwind second heat-exchange surface 62 and the downwind third heat-exchange surface 63 to the connection pipe insertion port 30*a*. More specifically, the terminating end of the downwind first heat-exchange surface 61 is positioned closer than a leading end of the downwind first heat-exchange surface 61 to the connection pipe insertion port 30*a*.

Of the downwind heat-exchange surfaces 65, the downwind second heat-exchange surface 62 is positioned on an upstream side of a flow of a refrigerant at the downwind first heat-exchange surface 61 when a cooling operation is performed, and is positioned on a downstream side of a flow of a refrigerant at the downwind first heat-exchange surface 61 when a heating operation is performed. When viewed in the heat-transfer-tube lamination direction dr2, the downwind second heat-exchange surface 62 is connected to the leading end of the downwind first heat-exchange surface 61 while a terminating end of the downwind second heat-exchange surface 62 is curved, and primarily extends from the left towards the right. The downwind second heat-exchange surface 62 has substantially the same area as the upwind third heat-exchange surface 53 when viewed in the air flow direction dr3, and is adjacent to the downwind side of the upwind third heat-exchange surface 53 in the air flow direction dr3.

Of the downwind heat-exchange surfaces 65, the downwind third heat-exchange surface 63 is positioned on an upstream side of a flow of a refrigerant at the downwind second heat-exchange surface 62 when a cooling operation is performed, and is positioned on a downstream side of a flow of a refrigerant at the downwind second heat-exchange surface 62 when a heating operation is performed. When viewed in the heat-transfer-tube lamination direction dr2, the downwind third heat-exchange surface 63 is connected to a leading end of the downwind second heat-exchange surface 62 while a terminating end of the downwind third heat-exchange surface 63 is curved, and primarily extends from the front towards the rear. The downwind third heat-exchange surface 63 has substantially the same area as the upwind second heat-exchange surface 52 when viewed in the air flow direction dr3, and is adjacent to the downwind side of the upwind second heat-exchange surface 52 in the air flow direction dr3.

Of the downwind heat-exchange surfaces 65, the downwind fourth heat-exchange surface 64 is positioned on an upstream side of a flow of a refrigerant at the downwind third heat-exchange surface 63 when a cooling operation is performed, and is positioned on a downstream side of a flow of a refrigerant at the downwind third heat-exchange surface 63 when a heating operation is performed. When viewed in the heat-transfer-tube lamination direction dr2, the downwind fourth heat-exchange surface 64 is connected to a leading end of the downwind third heat-exchange surface 63 while a terminating end of the downwind fourth heat-exchange surface 64 is curved, and primarily extends from the right towards the left. A leading end of the downwind fourth heat-exchange surface 64 is connected to the downwind second header 67. The downwind fourth heat-exchange surface 64 has substantially the same area as the upwind first heat-exchange surface 51 when viewed in the air flow direction dr3, and is adjacent to the downwind side of the upwind first heat-exchange surface 51 in the air flow direction dr3. The downwind fourth heat-exchange surface 64 is positioned closer than the downwind second heat-exchange surface 62 and the downwind third heat-exchange surface 63 to the connection pipe insertion port 30*a*. More specifically, the leading end of the downwind fourth heat-exchange surface 64 is positioned closer than the terminating end of the downwind fourth heat-exchange surface 64 to the connection pipe insertion port 30*a*.

By including such a downwind first heat-exchange surface 61, downwind second heat-exchange surface 62, downwind third heat-exchange surface 63, and downwind fourth heat-exchange surface 64, when viewed in the heat-transfer-tube lamination direction dr2, the downwind heat-exchange surfaces 65 of the downwind heat-exchanging unit 60 are bent or curved at three or more locations and form a substantially square shape. That is, the downwind heat-exchanging unit 60 has four downwind heat-exchange surfaces 65.

(4-1-2-2) Downwind First Header 66

The downwind first header 66 (corresponding to "third header" in the claims) is a header collecting pipe that functions as, for example, a dividing header that divides a refrigerant to pass through each downwind heat transfer tube 45*b*, a merging header that merges the refrigerants that flow out from the respective downwind heat transfer tubes 45*b*, or a turn-around header for allowing the refrigerants that flow out from the respective downwind heat transfer tubes 45*b* to turn around to other downwind heat transfer tubes 45*b*. In an installed state, a longitudinal direction of the downwind first header 66 is a vertical direction (up-down direction). The downwind first header 66 is adjacent to the downwind side of the upwind second header 57 in the air flow direction dr3.

The downwind first header 66 is formed in a cylindrical shape, and spaces are formed in the downwind first header 66 (hereunder called "downwind first-header spaces Sb1"). The downwind first header 66 is connected to the terminating end of the downwind first heat-exchange surface 61. The downwind first header 66 is connected to one end of each downwind heat transfer tube 45*b* that is included at the downwind first heat-exchange surface 61, and allows the downwind heat transfer tubes 45*b* and the downwind first-header spaces Sb1 to communicate with each other.

A horizontal partition plate 661 is disposed inside the downwind first header 66, and partitions the downwind first-header spaces Sb1 (here, two downwind first-header spaces Sb1 in the up-down direction; specifically, a downwind first space B1 and a downwind second space B2) from each other in the heat-transfer-tube lamination direction dr2. In other words, the downwind first space B1 and the downwind second space B2 are formed side by side in the up-down direction in the downwind first header 66.

The downwind first space B1 (corresponding to "fifth space" in the claims) is the downwind first-header space Sb1 that is disposed at an upper layer. The downwind second space B2 (corresponding to "sixth space" in the claims) is the downwind first-header space Sb1 that is disposed at a lower layer.

The second gas-side inlet/outlet GH2 is formed in the downwind first header 66. The second gas-side inlet/outlet GH2 communicates with the downwind first space B1. The second gas-side connection pipe GP2 is connected to the second gas-side inlet/outlet GH2.

The second liquid-side inlets/outlets LH2 are formed in the downwind first header 66. More specifically, the second liquid-side inlets/outlets LH2 (here, two second liquid-side inlets/outlets LH2 in the up-down direction) are formed in the downwind first header 66, and each second liquid-side inlet/outlet LH2 communicates with the downwind second space B2. Portions of the second liquid-side connection pipe LP2 are individually connected to the respective second liquid-side inlets/outlets LH2. More specifically, the second liquid-side connection pipe LP2 branches into two branching pipes at its end portion, and the second liquid-side inlets/outlets LH2 are connected to the corresponding branching pipes of the second liquid-side connection pipe LP2.

(4-1-2-3) Downwind Second Header 67

The downwind second header 67 (corresponding to "fourth header" in the claims) is a header collecting pipe that functions as, for example, a dividing header that divides a refrigerant to pass through each downwind heat transfer tube 45*b*, a merging header that merges the refrigerants that flow out from the respective downwind heat transfer tubes 45*b*, or a turn-around header for allowing the refrigerants that flow out from the respective downwind heat transfer tubes 45*b* to turn around to other downwind heat transfer tubes 45*b*. In an installed state, a longitudinal direction of the downwind second header 67 is a vertical direction (up-down direction).

The downwind second header 67 is formed in a cylindrical shape, and spaces are formed in the downwind second header 67 (hereunder called "downwind second-header spaces Sb2"). The downwind second header 67 is connected to the leading end of the downwind fourth heat-exchange surface 64. The downwind second header 67 is connected to one end of each downwind heat transfer tube 45*b* that is included at the downwind fourth heat-exchange surface 64, and allows the downwind heat transfer tubes 45*b* and the downwind second-header spaces Sb2 to communicate with each other. The downwind second header 67 is adjacent to the downwind side of the upwind first header 56 in the air flow direction dr3.

A horizontal partition plate 671 is disposed inside the downwind second header 67, and partitions the downwind second-header spaces Sb2 (here, two downwind second-header spaces Sb2 in the up-down direction; specifically, a downwind third space B3 and a downwind fourth space B4) from each other in the heat-transfer-tube lamination direction dr2. In other words, the downwind third space B3 and the downwind fourth space B4 are formed side by side in the up-down direction in the downwind second header 67.

The downwind third space B3 (corresponding to "seventh space" in the claims) is the downwind second-header space Sb2 that is disposed at an upper layer. The downwind fourth space B4 (corresponding to "eighth space" in the claims) is the downwind second-header space Sb2 that is disposed at a lower layer.

A third connection hole H3 for connecting one end of the downwind turn-around pipe 68 is formed in the downwind second header 67. The third connection hole H3 communicates with the downwind third space B3. One end of the downwind turn-around pipe 68 is connected to the third connection hole H3 so that the downwind third space B3 and the downwind fourth space B4 communicate with each other.

A fourth connection hole H4 for connecting the other end of the downwind turn-around pipe 68 is formed in the downwind second header 67. The fourth connection hole H4 communicates with the downwind fourth space B4. The other end of the downwind turn-around pipe 68 is connected to the fourth connection hole H4 so that the downwind third space B3 and the downwind fourth space B4 communicate with each other.

(4-1-2-4) Downwind Turn-Around Pipe 68

The downwind turn-around pipe 68 (corresponding to "second communication path formation portion" in the claims) is a pipe for forming a downwind turn-around flow path JP2 (corresponding to "second communication path" in the claims) that allows the downwind first header space Sb1 and the downwind second header space Sb2 to communicate with each other. In one or more embodiments, the one end of the downwind turn-around pipe 68 is connected to the downwind third space B3, and the other end of the downwind turn-around pipe 68 is connected to the downwind fourth space B4. That is, the downwind turn-around flow path JP2 allows the downwind third space B3 and the downwind fourth space B4 to communicate with each other.

By forming the downwind turn-around flow path JP2 by the downwind turn-around pipe 68, a refrigerant flows from the downwind fourth space B4 towards the downwind third space B3 when a cooling operation is performed, and a refrigerant flows from the downwind third space B3 towards the downwind fourth space B4 when a heating operation is performed.

(4-2) Refrigerant Paths of Indoor Heat Exchanger 25

Figure 12:
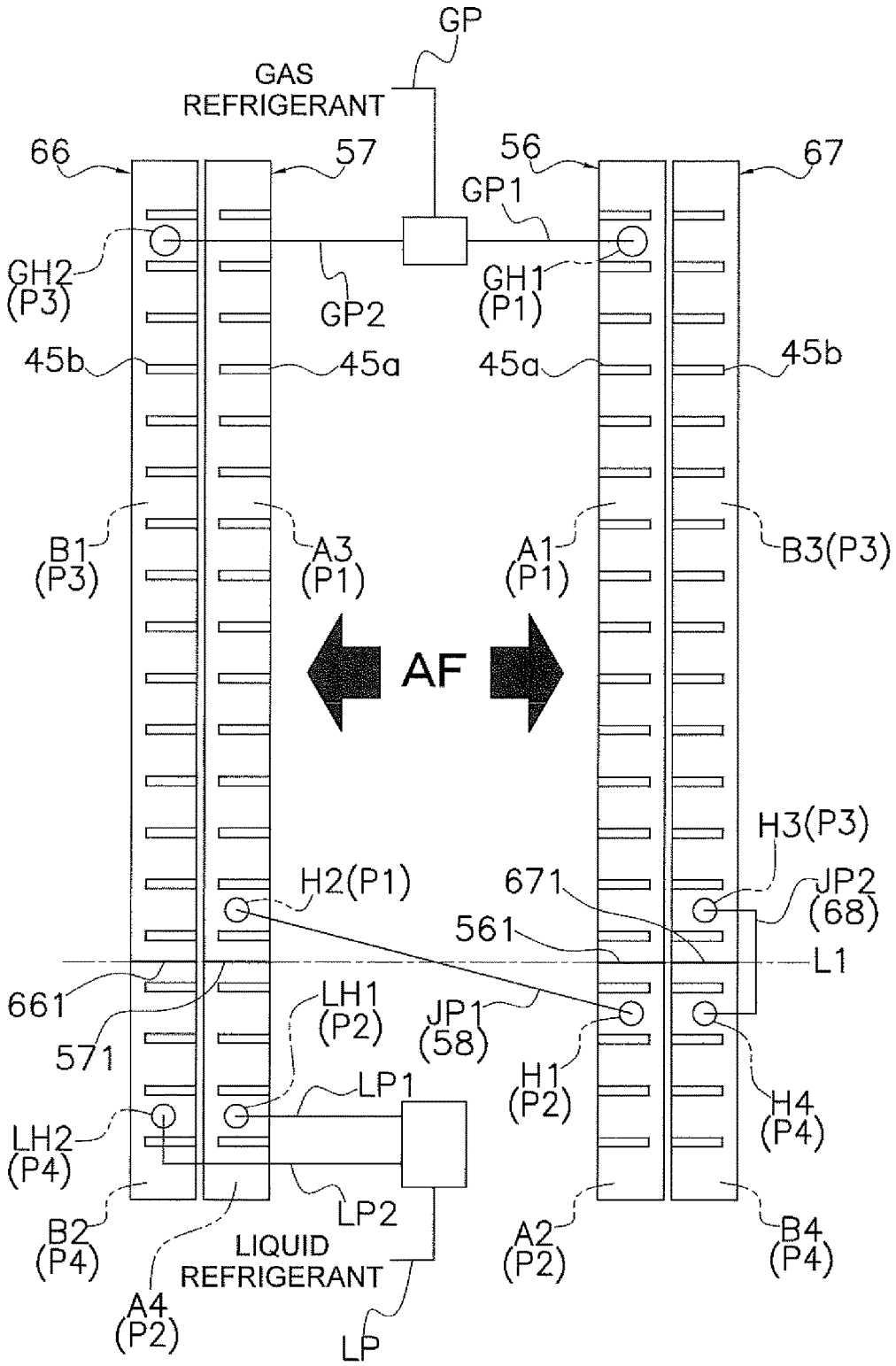
FIG. 12 is a schematic view schematically showing refrigerant paths that are formed in the indoor heat exchanger.

FIG. 12 is a schematic view schematically showing refrigerant paths that are formed in the indoor heat exchanger 25. In FIG. 12, regarding the first connection holes H1, the second connection holes H2, the first liquid-side inlets/outlets LH1, and the second liquid-side inlets/outlets LH2, one of each is shown. In addition, here, the term "path"

refers to a refrigerant flow path that is formed by causing each element that is included in the indoor heat exchanger 25 to communicate with each other.

In one or more embodiments, a plurality of paths are formed in the indoor heat exchanger 25. Specifically, in the indoor heat exchanger 25, a first path P1, a second path P2, a third path P3, and a fourth path P4 are formed. That is, in the indoor heat exchanger 25, there are four refrigerant flow paths that are separated from each other.

(4-2-1) First Path P1

The first path P1 is formed in the upwind heat-exchanging unit 50. In one or more embodiments, the first path P1 is formed above an alternate long and short dashed line L1 (see, for example, FIGS. 10 and 12) of the upwind heat-exchanging unit 50. The first path P1 is a refrigerant flow path that is formed by allowing the first gas-side inlet/outlet GH1 to communicate with the upwind first space A1, the upwind first space A1 to communicate with the upwind third space A3 via the heat-transfer-tube flow paths 451 (upwind heat transfer tubes 45*a*), and the upwind third space A3 to communicate with the second connection holes H2. That is, the first path P1 is a refrigerant flow path that includes the first gas-side inlet/outlet GH1, the upwind first space A1 in the upwind first header 56, the heat-transfer-tube flow paths 451 in the heat transfer tubes 45*a*, the upwind third space A3 in the upwind second header 57, and the second connection holes H2.

As shown in FIG. 12, the alternate long and short dashed line L1 is positioned between the fifteenth upwind heat transfer tube 45*a* from the top and the sixteenth upwind heat transfer tube 45*a* from the top. That is, in one or more embodiments, the first path P1 includes the transfer-heat-tube flow paths 451 of fifteen upwind heat transfer tubes 45*a* from the top.

(4-2-2) Second Path P2

The second path P2 is formed in the upwind heat-exchanging unit 50. In one or more embodiments, the second path P2 is formed below the alternate long and short dashed line L1 of the upwind heat-exchanging unit 50. The second path P2 is a refrigerant flow path that is formed by allowing the first connection holes H1 to communicate with the upwind second space A2, the upwind second space A2 to communicate with the upwind fourth space A4 via the heat-transfer-tube flow paths 451 (upwind heat transfer tubes 45*a*), and the upwind fourth space A4 to communicate with the first liquid-side inlets/outlets LH1. That is, the second path P2 is a refrigerant flow path that includes the first connection holes H1, the upwind second space A2 in the upwind first header 56, the heat-transfer-tube flow paths 451 in the upwind heat transfer tubes 45*a*, the upwind fourth space A4 in the upwind second header 57, and the first liquid-side inlets/outlets LH1.

As described above, the alternate long and short dashed line L1 is positioned between the fifteenth upwind heat transfer tube 45*a* from the top and the sixteenth upwind heat transfer tube 45*a* from the top. That is, in one or more embodiments, the second path P2 includes the transfer-heat-tube flow paths 451 of the sixteenth upwind heat transfer tube 45*a* to the nineteenth upwind heat transfer tube 45*a* from the top (that is, four upwind heat transfer tubes 45*a* from the bottom).

The second path P2 communicates with the first path P1 via the upwind turn-around flow path JP1 (upwind turn-around pipe 58). Therefore, the second path P2 along with the first path P1 can be interpreted as being one path.

(4-2-3) Third Path P3

The third path P3 is formed in the downwind heat-exchanging unit 60. In one or more embodiments, the third path P3 is formed above the alternate long and short dashed line L1 (see FIGS. 11 and 12) of the downwind heat-exchanging unit 60. The third path P3 is a refrigerant flow path that is formed by allowing the second gas-side inlet/outlet GH2 to communicate with the downwind first space B1, the downwind first space B1 to communicate with the downwind third space B3 via the heat-transfer-tube flow paths 451 (downwind heat transfer tubes 45*b*), and the downwind third space B3 to communicate with the third connection hole H3. That is, the third path P3 is a refrigerant flow path that includes the second gas-side inlet/outlet GH2, the downwind first space B1 in the downwind first header 66, the heat-transfer-tube flow paths 451 in the downwind heat transfer tubes 45*b*, the downwind third space B3 in the downwind second header 67, and the third connection hole H3.

As shown in FIG. 12, the alternate long and short dashed line L1 is positioned between the fifteenth downwind heat transfer tube 45*b* from the top and the sixteenth downwind heat transfer tube 45*b* from the top. That is, in one or more embodiments, the third path P3 includes the transfer-heat-tube flow paths 451 of fifteen downwind heat transfer tubes 45*b* from the top.

(4-2-4) Fourth Path P4

The fourth path P4 is formed in the downwind heat-exchanging unit 60. In one or more embodiments, the fourth path P4 is formed below the alternate long and short dashed line L1 of the downwind heat-exchanging unit 60. The fourth path P4 is a refrigerant flow path that is formed by allowing the fourth connection hole H4 to communicate with the downwind fourth space B4, the downwind fourth space B4 to communicate with the downwind second space B2 via the heat-transfer-tube flow paths 451 (downwind heat transfer tubes 45*b*), and the downwind second space B2 to communicate with the second liquid-side inlets/outlets LH2. That is, the fourth path P4 is a refrigerant flow path that includes the fourth connection hole H4, the downwind fourth space B4 in the downwind first header 66, the heat-transfer-tube flow paths 451 in the downwind heat transfer tubes 45*b*, the downwind second space B2 in the downwind second header 67, and the second liquid-side inlets/outlets LH2.

As described above, the alternate long and short dashed line L1 is positioned between the fifteenth downwind heat transfer tube 45*b* from the top and the sixteenth downwind heat transfer tube 45*b* from the top. That is, in one or more embodiments, the fourth path P4 includes the transfer-heat-tube flow paths 451 of the sixteenth downwind heat transfer tube 45*b* from the top to the nineteenth downwind heat transfer tube 45*b* from the top (that is, four downwind heat transfer tubes 45*b* from the bottom).

The fourth path P4 communicates with the third path P3 via the downwind turn-around flow path JP2 (downwind turn-around pipe 68). Therefore, the fourth path P4 along with the third path P3 can be interpreted as being one path.

(4-3) Flow of Refrigerant in Indoor Heat Exchanger 25

(4-3-1) when Cooling Operation is Performed

Figure 13:
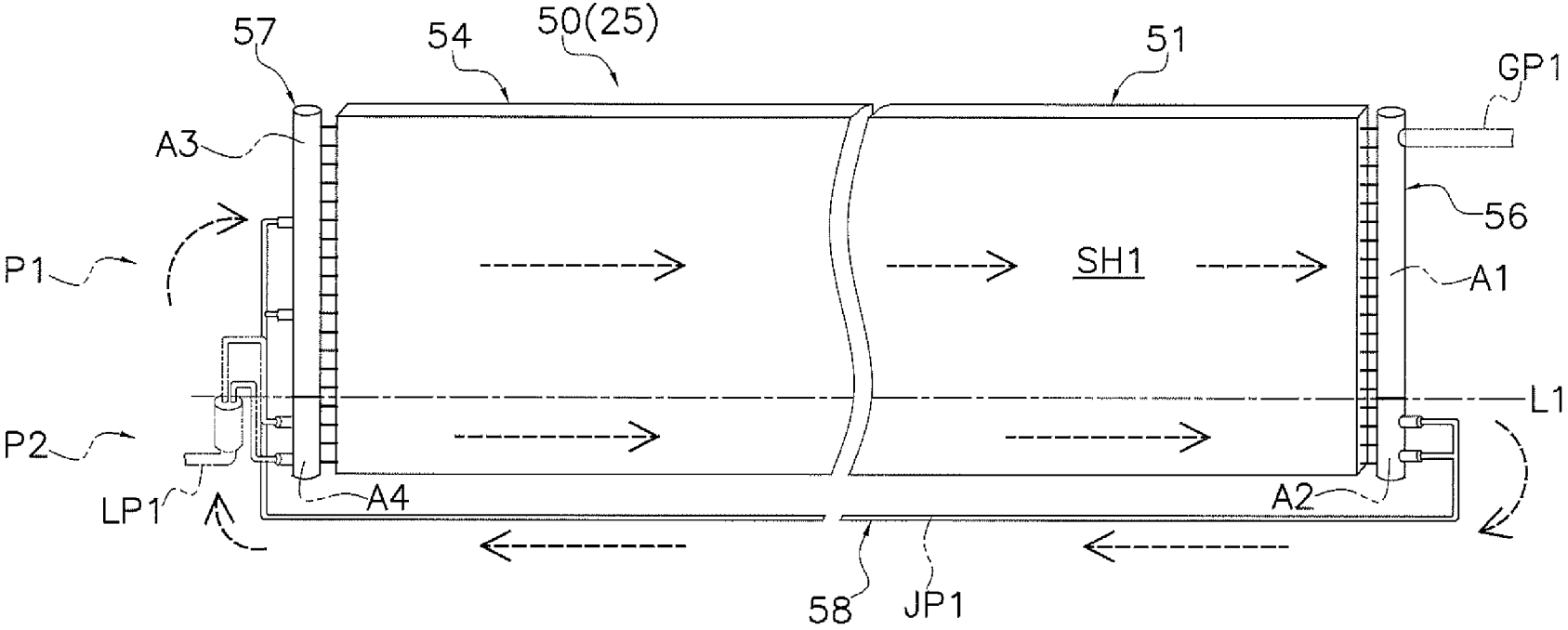
FIG. 13 is a schematic view schematically showing a flow of a refrigerant in the upwind heat-exchanging unit when a cooling operation is performed.
Figure 14:
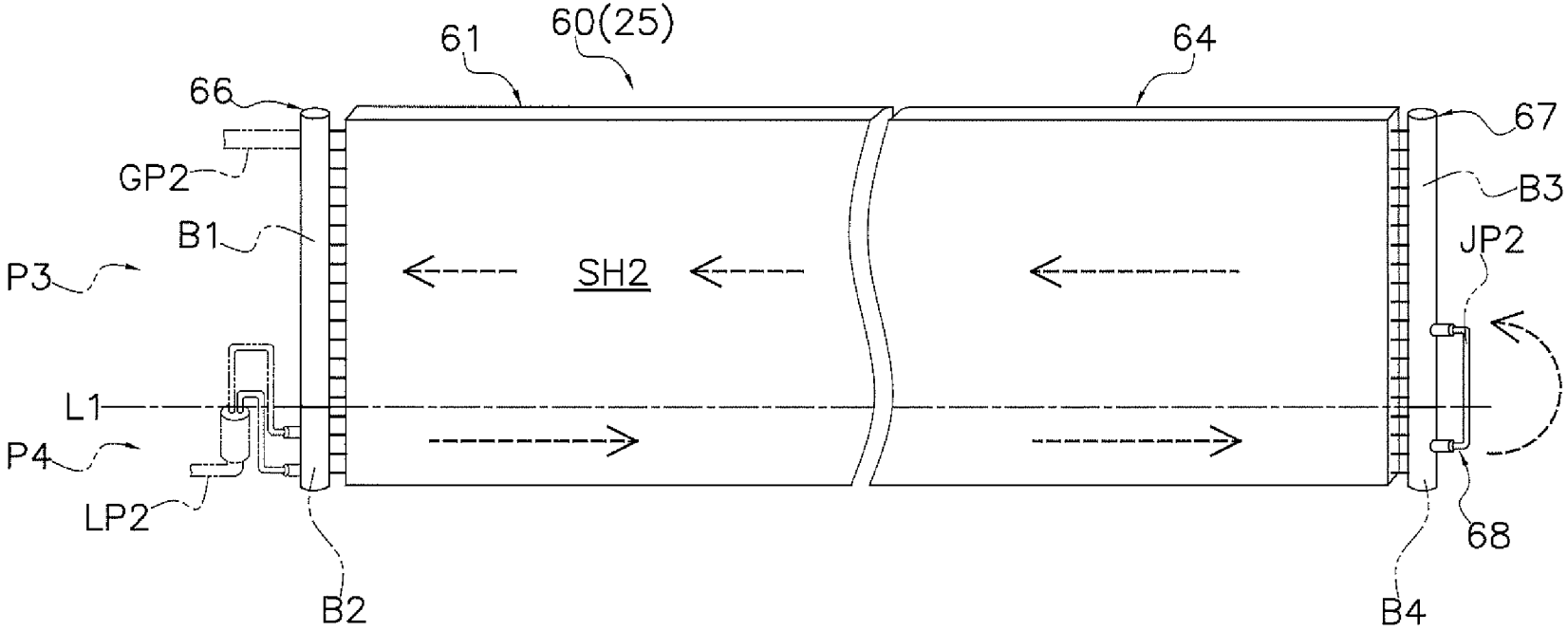
FIG. 14 is a schematic view schematically showing a flow of a refrigerant in the downwind heat-exchanging unit when a cooling operation is performed.

FIG. 13 is a schematic view schematically showing a flow of a refrigerant in the upwind heat-exchanging unit 50 when a cooling operation is performed. FIG. 14 is a schematic view schematically showing a flow of a refrigerant in the downwind heat-exchanging unit 60 when a cooling operation is performed. In FIGS. 13 and 14, the broken arrows indicate refrigerant flow directions.

When a cooling operation is performed, a refrigerant that has flown through the first liquid-side connection pipe LP1 flows into the second path P2 of the upwind heat-exchanging unit 50 via the first liquid-side inlets/outlets LH1. The refrigerant that has flown into the second path P2 passes through the second path P2 while exchanging heat with the indoor air flow AF and being heated, and flows into the first path P1 via the upwind turn-around flow path JP1 (upwind turn-around pipe 58). The refrigerant that has flown into the first path P1 passes through the first path P1 while exchanging heat with the indoor air flow AF and being heated, and flows out to the first gas-side connection pipe GP1 via the first gas-side inlet/outlet GH1.

When the cooling operation is performed, a refrigerant that has flown into the second liquid-side connection pipe LP2 flows into the fourth path P4 of the downwind heat-exchanging unit 60 via the second liquid-side inlets/outlets LH2. The refrigerant that has flown into the fourth path P4 passes through the fourth path P4 while exchanging heat with the indoor air flow AF and being heated, and flows into the third path P3 via the downwind turn-around flow path JP2 (downwind turn-around pipe 68). The refrigerant that has flown into the third path P3 passes through the third path P3 while exchanging heat with the indoor air flow AF and being heated, and flows out to the second gas-side connection pipe GP2 via the second gas-side inlet/outlet GH2.

In this way, when the cooling operation is performed, in the indoor heat exchanger 25, a refrigerant flow in which the refrigerant flows into the second path P2 and flows out via the first path P1 (that is, a refrigerant flow that is produced by the first path P1 and the second path P2) and a refrigerant flow in which the refrigerant flows into the fourth path P4 and flows out via the third path P3 (that is, a refrigerant flow that is produced by the third path P3 and the fourth path P4) are produced.

In the refrigerant flow that is produced by the first path P1 and the second path P2, the refrigerant flows through the first liquid-side inlets/outlets LH1, the upwind fourth space A4, the heat-transfer-tube flow paths 451 (upwind heat transfer tubes 45*a*) in the second path P2, the upwind second space A2, the upwind turn-around flow path JP1 (upwind turn-around pipe 58), the upwind third space A3, the heat-transfer-tube flow paths 451 (upwind heat transfer tubes 45*a*) in the first path P1, the upwind first space A1, and the first gas-side inlet/outlet GH1 in this order.

In the refrigerant flow that is produced by the third path P3 and the fourth path P4, the refrigerant flows through the second liquid-side inlets/outlets LH2, the downwind second space B2, the heat-transfer-tube flow paths 451 (downwind heat transfer tubes 45*b*) in the fourth path P4, the downwind fourth space B4, the downwind turn-around flow path JP2 (downwind turn-around pipe 68), the downwind third space B3, the heat-transfer-tube flow paths 451 (downwind heat transfer tubes 45*b*) in the third path P3, the downwind first space B1, and the second gas-side inlet/outlet GH2 in this order.

When the cooling operation is performed, in the indoor heat exchanger 25, an area in which a refrigerant that is in a superheated state flows (superheating area SH1) is formed at the heat-transfer-tube flow paths 451 in the first path P1 (in particular, the heat-transfer-tube flow paths 451 that are included at the first path P1 of the upwind first heat-exchange surface 51). In addition, an area in which a refrigerant that is in a superheated state flows (superheating area SH2) is formed at the heat-transfer-tube flow paths 451 in the third path P3 (in particular, the heat-transfer-tube flow paths 451 that are included at the third path P3 of the downwind first heat-exchange surface 61).

(4-3-2) when a Heating Operation is Performed

Figure 15:
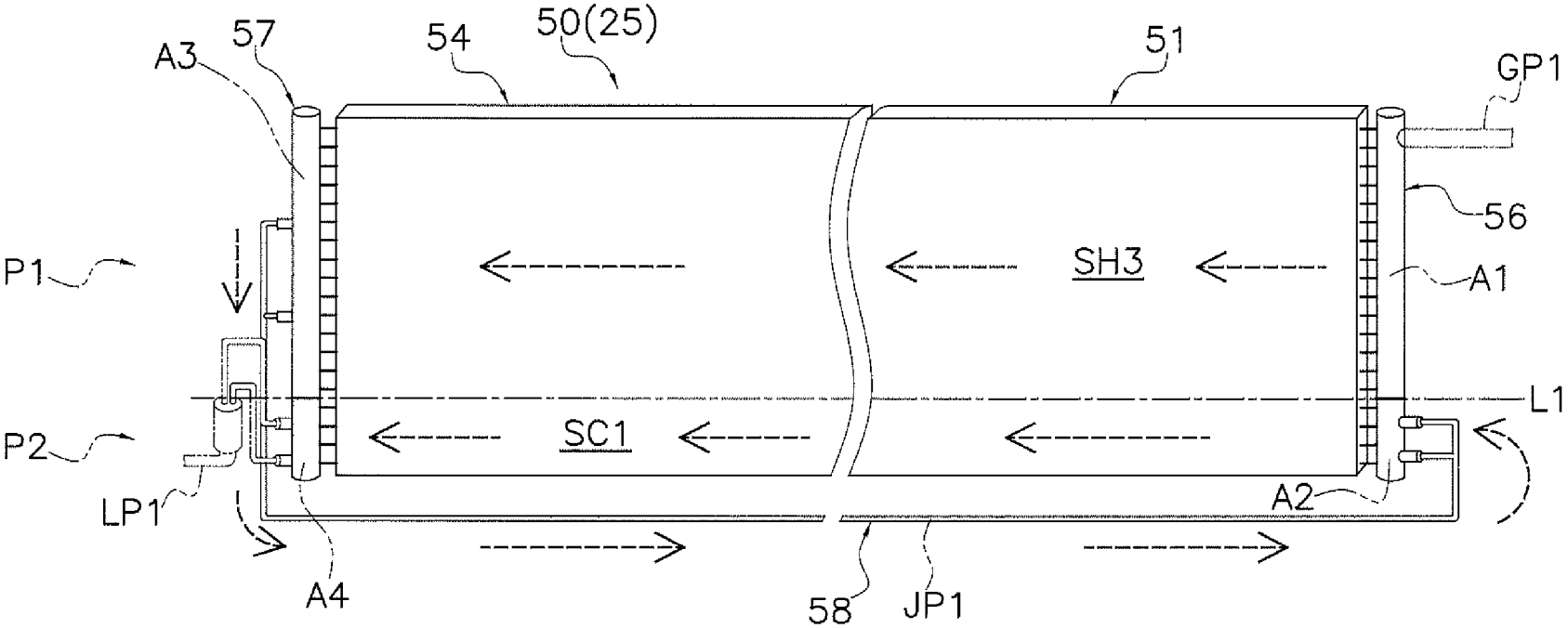
FIG. 15 is a schematic view schematically showing a flow of a refrigerant in the upwind heat-exchanging unit when a heating operation is performed.
Figure 16:
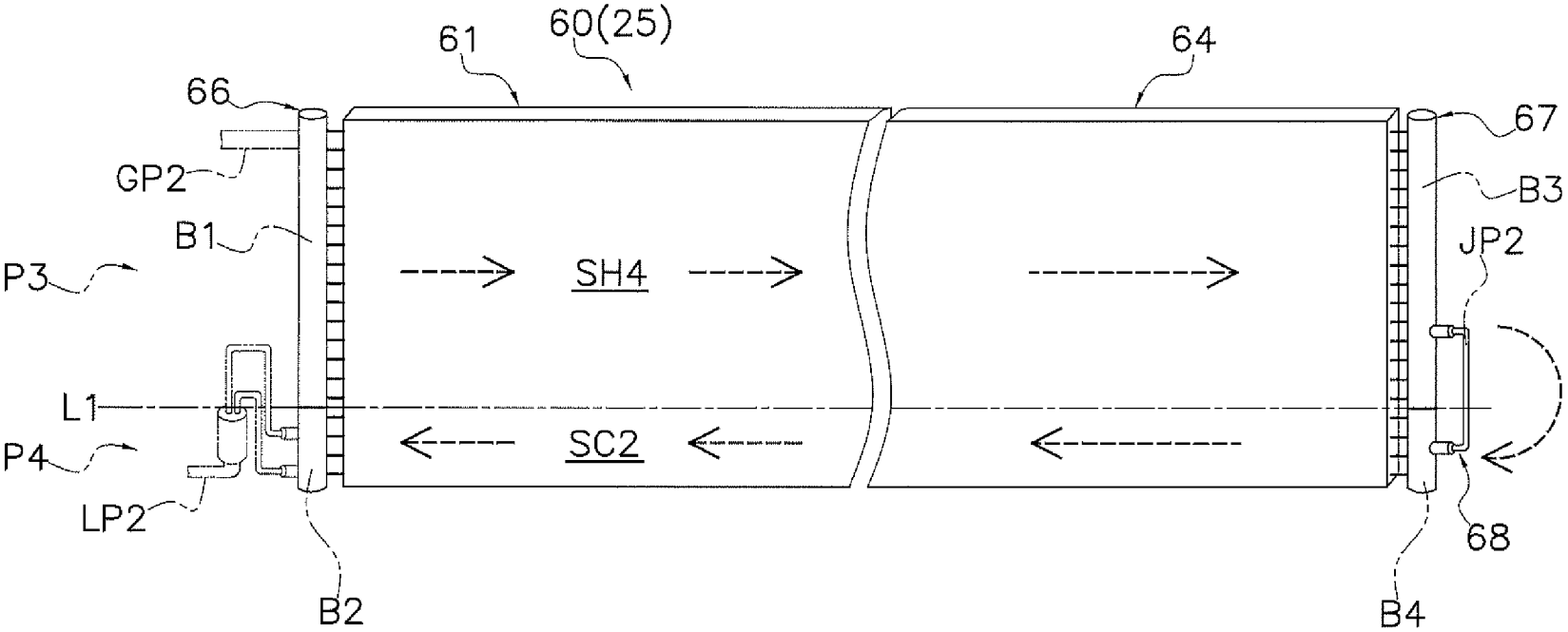
FIG. 16 is a schematic view schematically showing a flow of a refrigerant in the downwind heat-exchanging unit when a heating operation is performed.

FIG. 15 is a schematic view schematically showing a flow of a refrigerant in the upwind heat-exchanging unit 50 when a heating operation is performed. FIG. 16 is a schematic view schematically showing a flow of a refrigerant in the downwind heat-exchanging unit 60 when a heating operation is performed. In FIGS. 15 and 16, the broken arrows indicate refrigerant flow directions.

When a heating operation is performed, a gas refrigerant in a superheated state that has flown through the first gas-side connection pipe GP1 flows into the first path P1 of the upwind heat-exchanging unit 50 via the first gas-side inlet/outlet GH1. The refrigerant that has flown into the first path P1 passes through the first path P1 while exchanging heat with the indoor air flow AF and being cooled, and flows into the second path P2 via the upwind turn-around flow path JP1 (upwind turn-around pipe 58). The refrigerant that has flown into the second path P2 passes through the second path P2 while exchanging heat with the indoor air flow AF and being in a subcooled state, and flows out to the first liquid-side connection pipe LP1 via the first liquid-side inlets/outlets LH1.

When the heating operation is performed, a gas refrigerant in a superheated state that has flown through the second gas-side connection pipe GP2 flows into the third path P3 of the downwind heat-exchanging unit 60 via the second gas-side inlet/outlet GH2. The refrigerant that has flown into the third path P3 passes through the third path P3 while exchanging heat with the indoor air flow AF and being cooled, and flows into the fourth path P4 via the downwind turn-around flow path JP2 (downwind turn-around pipe 68). The refrigerant that has flown into the fourth path P4 passes through the fourth path P4 while exchanging heat with the indoor air flow AF and being in a subcooled state, and flows out to the second liquid-side connection pipe LP2 via the second liquid-side inlets/outlets LH2.

In this way, when the heating operation is performed, in the indoor heat exchanger 25, a refrigerant flow in which the refrigerant flows into the first path P1 and flows out via the second path P2 (that is, a refrigerant flow that is produced by the first path P1 and the second path P2) and a refrigerant flow in which the refrigerant flows into the third path P3 and flows out via the fourth path P4 (that is, a refrigerant flow that is produced by the third path P3 and the fourth path P4) are produced.

In the refrigerant flow that is produced by the first path P1 and the second path P2, the refrigerant flows through the first gas-side inlet/outlet GH1, the upwind first space A1, the heat-transfer-tube flow paths 451 (upwind heat transfer tubes 45*a*) in the first path P1, the upwind third space A3, the upwind turn-around flow path JP1 (upwind turn-around pipe 58), the upwind second space A2, the heat-transfer-tube flow paths 451 (upwind heat transfer tubes 45*a*) in the second path P2, the upwind fourth space A4, and the first liquid-side inlets/outlets LH1 in this order.

In the refrigerant flow that is produced by the third path P3 and the fourth path P4, the refrigerant flows through the second gas-side inlet/outlet GH2, the downwind first space B1, the heat-transfer-tube flow paths 451 (downwind heat transfer tubes 45*b*) in the third path P3, the downwind third space B3, the downwind turn-around flow path JP2 (downwind turn-around pipe 68), the downwind fourth space B4, the heat-transfer-tube flow paths 451 (downwind heat transfer tubes 45*b*) in the fourth path P4, the downwind second space B2, and the second liquid-side inlets/outlets LH2 in this order.

When the heating operation is performed, in the indoor heat exchanger 25, an area in which a refrigerant that is in a superheated state flows (first superheating area SH3) is formed at the heat-transfer-tube flow paths 451 in the first path P1 (in particular, the heat-transfer-tube flow paths 451 that are included at the first path P1 of the upwind first heat-exchange surface 51). In one or more embodiments, the first superheating area SH3 is an area of the upwind first heat-exchange surface 51 that is positioned close to the upwind first space A1 and that communicates with the upwind first space A1. In addition, an area in which a refrigerant that is in a superheated state flows (second superheating area SH4) is formed at the heat-transfer-tube flow paths 451 in the third path P3 (in particular, the heat-transfer-tube flow paths 451 that are included at the third path P3 of the downwind first heat-exchange surface 61). In one or more embodiments, the second superheating area SH4 is an area of the downwind first heat-exchange surface 61 that is positioned close to the downwind first space B1 and that communicates with the downwind first space B1. As shown in FIGS. 15 and 16, the direction of flow of the refrigerant that flows through the first superheating area SH3 of the upwind heat-exchanging unit 50 and the direction of flow of the refrigerant that flows through the second superheating area SH4 of the downwind heat-exchanging unit 60 are opposite to each other (that is, the flows are counterflows).

When the heating operation is performed, in the indoor heat exchanger 25, an area in which a refrigerant in a subcooled state flows (first subcooling area SC1) is formed at the heat-transfer-tube flow paths 451 in the second path P2 (in particular, the heat-transfer-tube flow paths 451 that are included at the second path P2 of the upwind fourth heat-exchange surface 54). In one or more embodiments, the first subcooling area SC1 is an area of the upwind fourth heat-exchange surface 54 that is positioned close to the upwind fourth space A4 and that communicates with the upwind fourth space A4. In addition, an area in which a refrigerant that is in a subcooled state flows (second subcooling area SC2) is formed at the heat-transfer-tube flow paths 451 in the fourth path P4 (in particular, the heat-transfer-tube flow paths 451 that are included at the fourth path P4 of the downwind first heat-exchange surface 61). In one or more embodiments, the second subcooling area SC2 is an area of the downwind first heat-exchange surface 61 that is positioned close to the downwind second space B2 and that communicates with the downwind second space B2. As shown in FIGS. 15 and 16, the whole or a large part of the first superheating area SH3 of the upwind heat-exchanging unit 50 and the whole or a large part of the second subcooling area SC2 of the downwind heat-exchanging unit 60 do not overlap each other in the air flow direction dr3.

Of the upwind heat-exchange surfaces 55 and the downwind heat-exchange surfaces 65, when a heating operation is performed, an area that does not correspond to the subcooling areas is a main heat-exchange area. The heat exchange amount between the refrigerant and the indoor air flow AF is larger at the main heat-exchange area than at the subcooling areas. In the upwind heat-exchange surfaces 55 and the downwind heat-exchange surfaces 65, the heat transfer area of the main heat-exchange area is larger than the heat transfer area of the subcooling areas.

(5) Features (5-1)

If a flat-tube heat exchanger is used as a condenser of a refrigerant, when a superheating area and a subcooling area are adjacent to each other one above another, heat is exchanged between a refrigerant that passes through the superheating area and a refrigerant that passes through the subcooling area via the heat-transfer fins. In relation to this, heat exchange between the refrigerant and the air flow in the subcooling area is suppressed, and there may be cases in which the degree of subcooling of the refrigerant is not properly ensured.

In this respect, in the indoor heat exchanger 25 according to the above-described embodiments, the upwind first header 56 is formed so as to include therein the upwind first space A1 that communicates with the first superheating area SH3 (area in which a gas refrigerant in a superheated state flows when a heating operation is performed, that is, when the gas refrigerant in the superheated state that has flown in from the first gas-side inlet/outlet GH1 exchanges heat with the air flow and flows out as a liquid refrigerant in a subcooled state from the first liquid-side inlets/outlets LH1) and the upwind second space A2 that is partitioned from the upwind first space A1. In addition, the upwind second header 57 is formed so as to include therein the upwind third space A3 that communicates with the upwind first space A1 via the upwind heat transfer tubes 45*a* and the upwind fourth space A4 that is partitioned from the upwind third space A3 and that communicates with the first subcooling area SC1 (area in which a liquid refrigerant in a subcooled state flows when a heating operation is performed. Moreover, the upwind turn-around pipe 58 (upwind turn-around flow path JP1) allows the upwind second space A2 and the upwind third space A3 to communicate with each other.

Therefore, when the heat exchanger is used as a condenser of a refrigerant, the flat-tube heat exchanger is formed so that the first superheating area SH3 and the first subcooling area SC1 are not adjacent to each other one above another. That is, the first superheating area SH3 and the first subcooling area SC1 are formed so that heat exchange between the refrigerant that passes through the first superheating area SH3 and the refrigerant that passes through the first subcooling area SC1 is suppressed. In relation to this, this helps the degree of subcooling of the refrigerant to be properly ensured. Therefore, improvement in the performance of the heat exchanger is facilitated.

(5-2)

In the indoor heat exchanger 25 according to the above-described embodiments, in an installed state, the downwind heat-exchanging unit 60 is disposed beside the upwind heat-exchanging unit 50 on the downwind side of the upwind heat-exchanging unit 50 so that the direction of flow of the refrigerant through the second subcooling area SC2 (area in which a liquid refrigerant in a subcooled state flows when a heating operation is performed, that is, when a gas refrigerant in a superheated state that has flown in from the gas-side inlets/outlets GH exchanges heat with the air flow and flows out as the liquid refrigerant in the subcooled state from the liquid-side inlets/outlets LH) is the same as the direction of flow of the refrigerant through the first subcooling area SC1 of the upwind heat-exchanging unit 50.

Therefore, when the indoor heat exchanger 25 in which a plurality of heat-exchanging units are arranged side by side on the upwind side and on the downwind side (so-called two-row flat-tube heat exchanger) is used as a condenser of a refrigerant, of the upwind heat-exchanging unit 50 and the downwind heat-exchanging unit 60, the first superheating area SH3 on the upwind side and the second subcooling area SC2 on the downwind side are suppressed from partly overlapping each other or being close to each other when viewed in the air flow direction dr3. As a result, passage of the indoor air flow AF that has passed the first superheating area SH3 of the upwind heat-exchanging unit 50 through the second subcooling area SC2 of the downwind heat-exchanging unit 60 is suppressed. Therefore, in the second subcooling area SC2 of the downwind heat-exchanging unit 60, temperature differences between the refrigerant and the indoor air flow AF are easily properly ensured, and this helps the degree of subcooling to be properly ensured.

(5-3)

In the indoor heat exchanger 25 according to the above-described embodiments, the downwind first header 66 of the downwind heat-exchanging unit 60 is formed so as to include therein the downwind first space B1 (space that communicates with the second gas-side inlet/outlet GH2) and the downwind second space B2 (space that is partitioned from the downwind first space B1 and that communicates with the second liquid-side inlets/outlets LH2). Moreover, the downwind third space B3 (space that communicates with the downwind first space B1 via the downwind heat transfer tubes 45*b*) and the downwind fourth space B4 (space that communicates with the downwind second space B2 via the downwind heat transfer tubes 45*b*) of the downwind second header 67 communicate with each other by the downwind turn-around flow path JP2.

Therefore, it is possible to arrange the first superheating area SH3 that is formed at the upwind heat-exchanging unit 50 and the second superheating area SH4 that is formed at the downwind heat-exchanging unit 60 so as not to overlap each other in the air flow direction dr3. As a result, of the indoor air flow AF that has passed the upwind heat-exchanging unit 50 and the downwind heat-exchanging unit 60, large differences in the proportions between air that has sufficiently exchanged heat with the refrigerant and air that has not sufficiently exchanged heat with the refrigerant depending upon portions where the air flow passes are suppressed. Therefore, temperature unevenness of air that has passed the heat exchanger 25 is suppressed.

(5-4)

In the indoor heat exchanger 25 according to the above-described embodiments, the direction of flow of the refrigerant that flows through the second superheating area SH4 is opposite to the direction of flow of the refrigerant that flows through the first superheating area SH3. Therefore, when a heating operation is performed, the refrigerant in the first superheating area SH3 of the upwind heat-exchanging unit 50 and the refrigerant in the second superheating area SH4 of the downwind heat-exchanging unit 60 flow opposite to each other. As a result, of the indoor air flow AF that has passed the upwind heat-exchanging unit 50 and the downwind heat-exchanging unit 60, large differences in the proportions between air that has sufficiently exchanged heat with the refrigerant and air that has not sufficiently exchanged heat with the refrigerant depending upon portions where the air flow passes are suppressed. Therefore, temperature unevenness of air that has passed the indoor heat exchanger 25 is suppressed.

(5-5)

In the indoor heat exchanger 25 according to the above-described embodiments, in an installed state, a longitudinal direction of the upwind heat transfer tubes 45*a* is a horizontal direction, a longitudinal direction of each of the upwind first header 56 and the upwind second header 57 is a vertical direction, and the first gas-side inlet/outlet GH1 is positioned above the first liquid-side inlets/outlets LH1. That is, in the installed state, in the flat-tube heat exchanger in which the heat transfer tubes 45 that extend in the horizontal direction are laminated in the vertical direction and the flow path through which the liquid refrigerant flows is disposed below the flow path through which the gas refrigerant flows, an improvement in performance is facilitated.

(5-6)

In the indoor heat exchanger 25 according to the above-described embodiments, the upwind heat-exchanging unit 50 includes the upwind first heat-exchange surface 51 and the upwind second heat exchange surface, the upwind heat transfer tubes 45*a* extend in a "first direction" (here, a left-right direction) at the upwind first heat-exchange surface 51, and the upwind heat transfer tubes 45*a* extend in a "second direction" (here, a front-rear direction), which is a direction that intersects the "first direction", at the upwind second heat-exchange surface 52. That is, in the flat-tube heat exchanger including the upwind heat-exchanging unit 50 that includes the upwind first heat-exchange surface 51 and the upwind second heat-exchange surface 52 extending in different directions, an improvement in performance is facilitated.

(5-7)

In the indoor heat exchanger 25 according to the above-described embodiments, when viewed in the heat-transfer-tube lamination direction dr2 (direction in which the upwind first header 56 and the upwind second header 57 extend), the upwind heat-exchanging unit 50 is bent or curved at three or more locations and has a substantially square shape. When viewed in the heat-transfer-tube lamination direction dr2, the upwind first header 56 is disposed at one end portion of the upwind heat-exchanging unit 50, and the upwind second header 57 is disposed at the other end portion of the upwind heat-exchanging unit 50. Therefore, in the flat-tube heat exchanger having a substantially square shape when viewed in the heat-transfer-tube lamination direction dr2, an improvement in performance is facilitated. Pipes (such as the upwind turn-around pipe 58) extending between the upwind first header 56 and the upwind second header 57 and connection pipes that are connected to the upwind first header 56 and the upwind second header 57 (such as the first gas-side connection pipe GP1 and the first liquid-side connection pipe LP1) are easily routed, and are easily assembled.

(5-8)

In the air conditioner 100 according to the above-described embodiments, the connection pipe insertion port 30*a* for inserting the refrigerant connection pipes (GP and LP) is formed in the casing 30 that accommodates the indoor heat exchanger 25. In the indoor heat exchanger 25, the upwind heat-exchanging unit 50 includes the upwind first heat-exchange surface 51 in which the upwind heat transfer tubes 45*a* extend in a "third direction" (here, rightwards) and the upwind fourth heat-exchange surface 54 in which the heat transfer tubes 45*a* extend in a "fourth direction" (here, rearwards) that differs from the third direction. Moreover, in the upwind heat-exchanging unit 50, one of the upwind first header 56 and upwind second header 57 (here, the upwind first header 56) is positioned at the terminating end of the upwind first heat-exchange surface 51, and the other of the upwind first header 56 and upwind second header 57 (here, the upwind second header 57) is positioned at the leading end of the upwind fourth heat-exchange surface 54 that is disposed apart from the terminating end of the upwind first heat-exchange surface 51; and the terminating end of the upwind first heat-exchange surface 51 is positioned closer than the leading end of the upwind first heat-exchange surface 51 to the connection pipe insertion port 30*a*, and the leading end of the upwind fourth heat-exchange surface 54 is disposed closer than the terminating end of the upwind fourth heat-exchange surface 54 to the connection pipe insertion port 30*a*.

Therefore, in the air conditioner 100 that includes the upwind heat-exchanging unit 50 (flat-tube heat exchanger) including the upwind first heat-exchange surface 51 and the upwind fourth heat-exchange surface 54 extending in different directions, the pipes in the casing 30 (for example, the refrigerant connection pipes GP and LP that are connected to the corresponding inlets/outlets GH1, GH2, LH1, and LH2 of the indoor heat exchanger 25, and the upwind turn-around pipe 58 that is connected to the connection holes H1 and H2) can be made short in length. As a result, the pipes inside the casing 30 are easily routed. In relation to this, this helps the refrigeration apparatus 100 to have improved workability, to be assembled more easily, and to be more compact.

(6) Modifications

The above-described embodiments can be modified as appropriate as indicated by the following modifications. Each modification may be applied by combining with other modifications in a noncontradictory manner.

(6-1) Modification 1

In the above-described embodiments, the first path P1 is formed by allowing the first gas-side inlet/outlet GH1 to communicate with the upwind first space A1 and by allowing the second connection holes H2 to communicate with the upwind third space A3. However, the first path P1 may be formed in other ways. For example, the first path P1 may be formed by allowing the first gas-side inlet/outlet GH1 to communicate with the upwind third space A3 and by allowing the second connection holes H2 to communicate with the upwind first space A1. Even in such a case, the same effects as those provided by the above-described embodiments can be realized.

In particular, the second path P2 may be formed by allowing the first liquid-side inlets/outlets LH1 to communicate with the upwind second space A2 instead of with the upwind fourth space A4 and by allowing the first connection holes H1 to communicate with the upwind fourth space A4 instead of with the upwind second space A2. This allows the same operational effects provided by (5-1) above to be realized.

The third path P3 may be formed by allowing the second gas-side inlet/outlet GH2 to communicate with the downwind third space B3 instead of with the downwind first space B1 and by allowing the third connection hole H3 to communicate with the downwind first space B1 instead of with the downwind third space B3. The fourth path P4 may be formed by allowing the second liquid-side inlets/outlets LH2 to communicate with the downwind fourth space B4 instead of with the downwind second space B2 and by allowing the fourth connection hole H4 to communicate with the downwind second space B2 instead of with the downwind fourth space B4. This allows the same operational effects provided by (5-2) above to be realized.

(6-2) Modification 2

In the above-described embodiments, a heat-exchanging unit is not disposed on the upstream side of the upwind heat-exchanging unit 50 in the air flow direction dr3 (that is, the upwind heat-exchanging unit 50 is the heat-exchanging unit at the most upwind position in the air flow direction dr3). However, it is not necessarily limited thereto, and a heat-exchanging unit may be disposed on the upstream side of the upwind heat-exchanging unit 50 as long as contradictions do not occur with regard to the operational effects described in (5-1) above.

Figure 17:
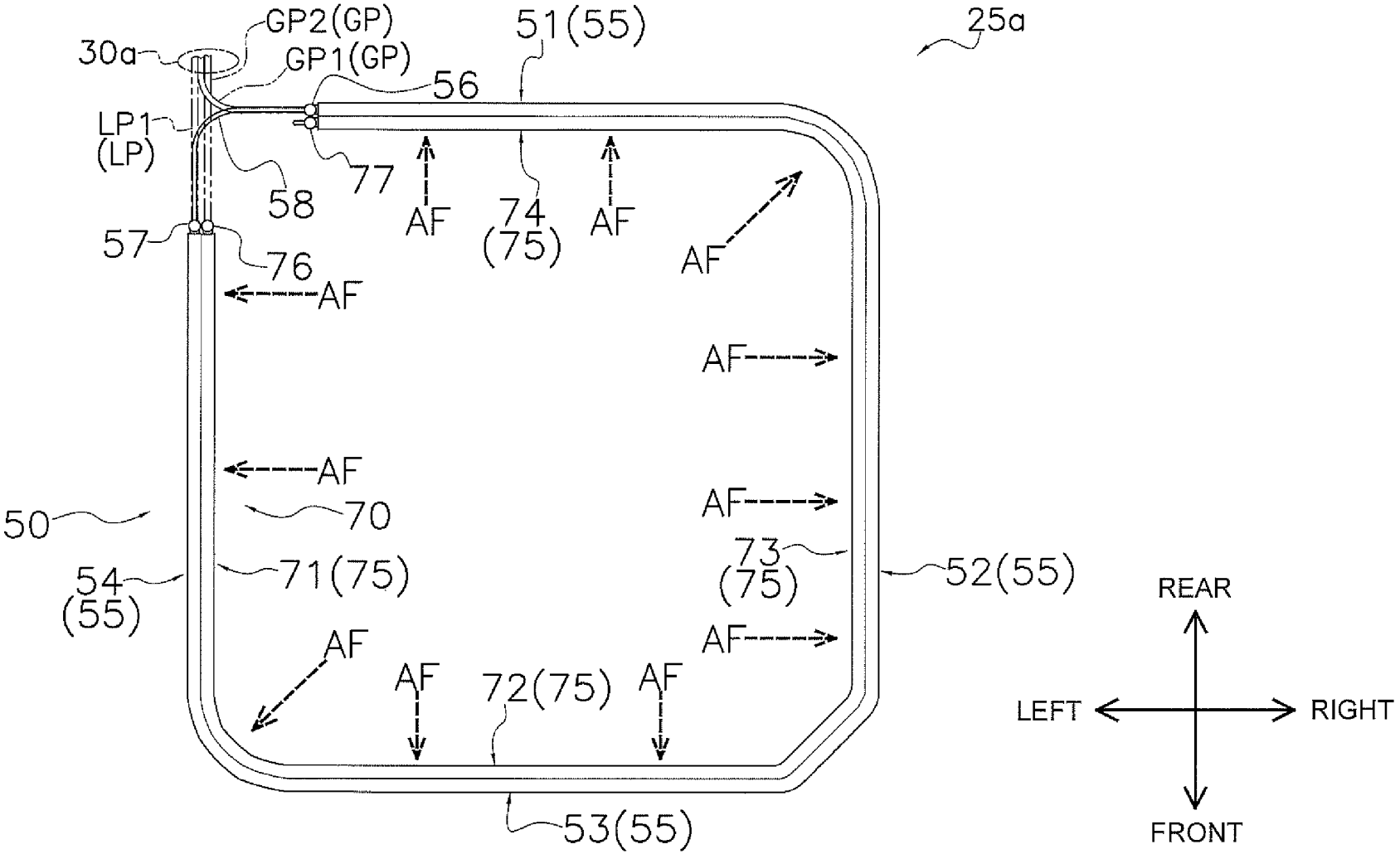
FIG. 17 is a schematic view schematically showing an indoor heat exchanger according to Modification 2 when viewed in the heat-transfer-tube lamination direction.

For example, the indoor heat exchanger 25 may be formed like an indoor heat exchanger 25*a* shown in FIG. 17. The indoor heat exchanger 25*a* is described below. Unless otherwise noted, descriptions that are left out below can be interpreted as being substantially the same as those of the indoor heat exchanger 25.

Figure 18:
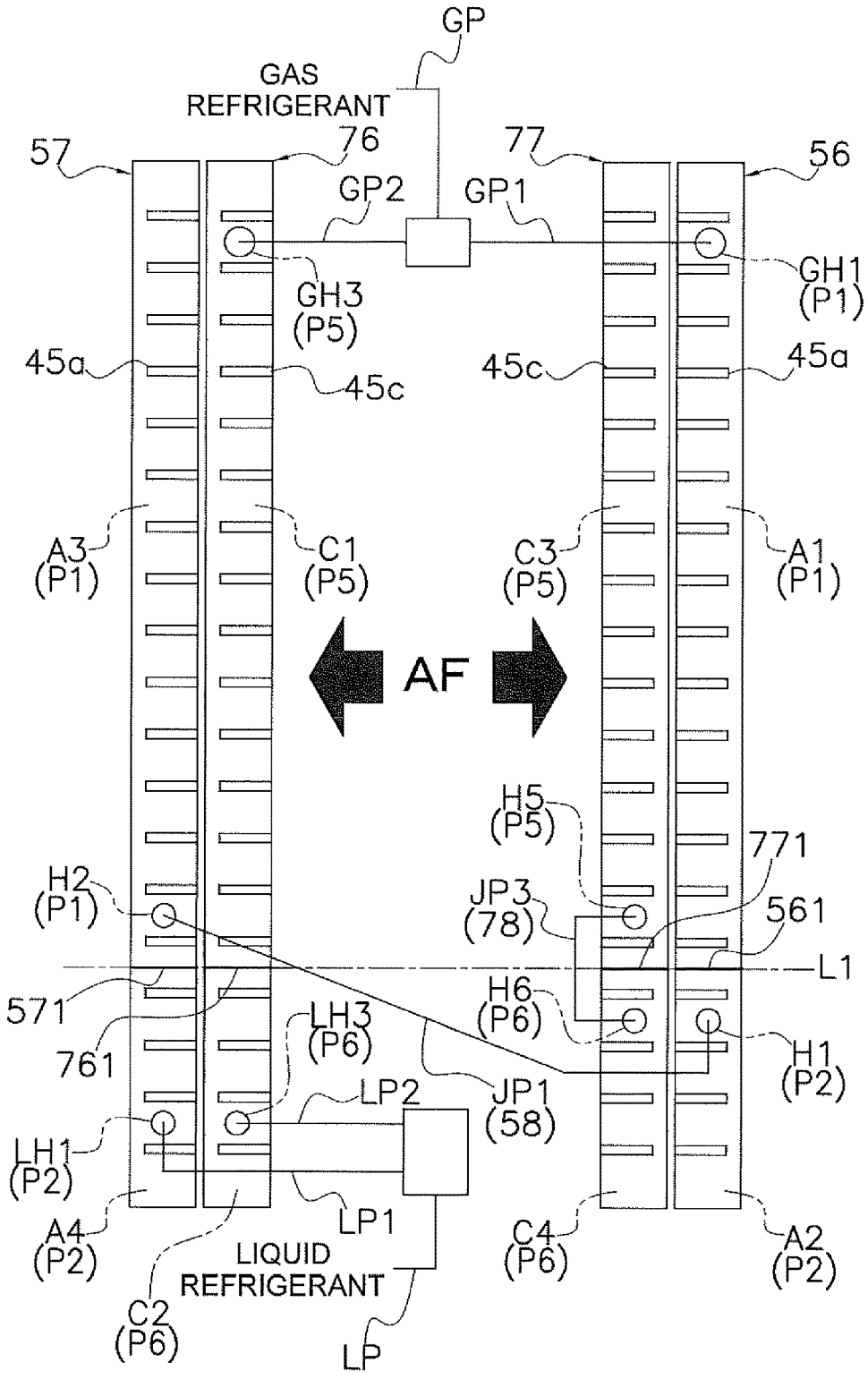
FIG. 18 is a schematic view schematically showing refrigerant paths that are formed in the indoor heat exchanger according to Modification 2.
Figure 19:
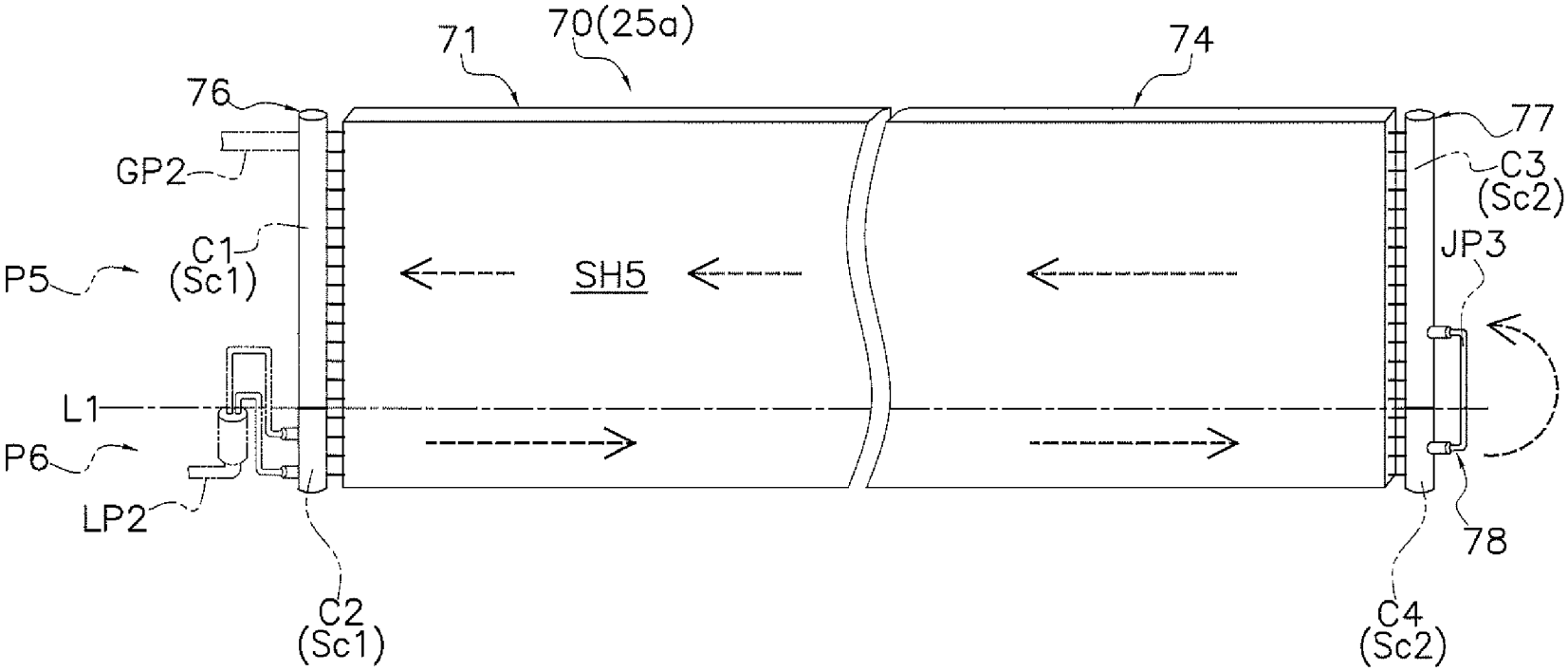
FIG. 19 is a schematic view schematically showing a flow of a refrigerant in a most-upstream heat-exchanging unit of the indoor heat exchanger according to Modification 2 when a cooling operation is performed.
Figure 20:
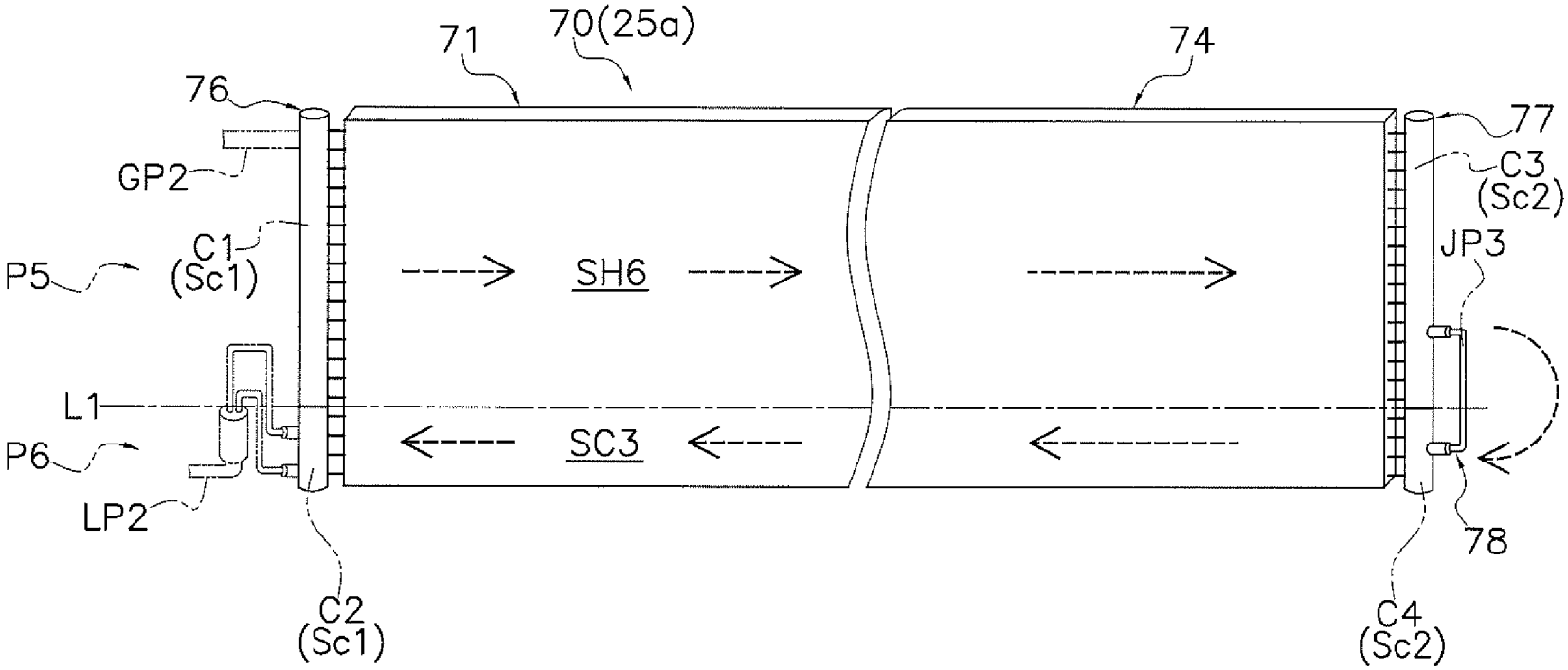
FIG. 20 is a schematic view schematically showing a flow of a refrigerant in the most-upstream heat-exchanging unit of the indoor heat exchanger according to Modification 2 when a heating operation is performed.

FIG. 17 is a schematic view schematically showing the indoor heat exchanger 25*a* when viewed in the heat-transfer-tube lamination direction dr2. FIG. 18 is a schematic view schematically showing refrigerant paths that are formed in the indoor heat exchanger 25*a*. FIG. 19 is a schematic view schematically showing a flow of a refrigerant in a most-upstream heat-exchanging unit 70 when a cooling operation is performed. FIG. 20 is a schematic view schematically showing a flow of a refrigerant in the most-upstream heat-exchanging unit 70 when a heating operation is performed.

In the indoor heat exchanger 25*a*, the most-upstream heat-exchanging unit 70 is disposed instead of the downwind heat-exchanging unit 60. The configuration of the most-upstream heat-exchanging unit 70 is similar to the configuration of the downwind heat-exchanging unit 60.

Specifically, in the most-upstream heat-exchanging unit 70, the downwind heat-exchange surfaces 65 of the downwind heat-exchanging unit 60, that is, the downwind first heat-exchange surface 61, the downwind second heat-exchange surface 62, the downwind third heat-exchange surface 63, and the downwind fourth heat-exchange surface 64 are replaced by most-upstream heat-exchange surfaces 75, that is, a most-upstream first heat-exchange surface 71, a most-upstream second heat-exchange surface 72, a most-upstream third heat-exchange surface 73, and a most-upstream fourth heat-exchange surface 74. However, the most-upstream first heat-exchange surface 71 is adjacent to an upwind side of the upwind fourth heat-exchange surface 54 in the air flow direction dr3. The most-upstream second heat-exchange surface 72 is adjacent to an upwind side of the upwind third heat-exchange surface 53 in the air flow direction dr3. The most-upstream third heat-exchange surface 73 is adjacent to an upwind side of the upwind second heat-exchange surface 52 in the air flow direction dr3. The most-upstream fourth heat-exchange surface 74 is adjacent to an upwind side of the upwind first heat-exchange surface 51 in the air flow direction dr3.

In the most-upstream heat-exchanging unit 70, the downwind first header 66, the downwind second header 67, and the downwind heat transfer tubes 45*b* of the downwind heat-exchanging unit 60 are replaced by a most-upstream first header 76, a most-upstream second header 77, and most-upstream heat transfer tubes 45*c*. However, the most-upstream first header 76 is adjacent to an upwind side of the upwind second header 57 in the air flow direction dr3. The most-upstream second header 77 is adjacent to an upwind side of the upwind first header 56 in the air flow direction dr3.

In the most-upstream heat-exchanging unit 70, the horizontal partition plate 661, the downwind first-header spaces Sb1, that is, the downwind first space B1 and the downwind second space B2, the second gas-side inlet/outlet GH2, and the second liquid-side inlets/outlets LH2 of the downwind heat-exchanging unit 60 are replaced by a horizontal partition plate 761, most-upstream first-header spaces Sc1, that is, a most-upstream first space C1 and a most-upstream second space C2, a third gas-side inlet/outlet GH3, and third liquid-side inlets/outlets LH3. In the most-upstream heat-exchanging unit 70, the horizontal partition plate 671, the downwind second-header spaces Sb2, that is, the downwind third space B3 and the downwind fourth space B4, the first connection hole H3, and the fourth connection hole H4 of the downwind heat-exchanging unit 60 are replaced by a horizontal partition plate 771, most-upstream second-header spaces Sc2, that is, a most-upstream third space C3 and a most-upstream fourth space C4, a fifth connection hole H5, and a sixth connection hole H6.

In the most-upstream heat-exchanging unit 70, the downwind turn-around pipe 68 and the downwind turn-around flow path JP2 of the downwind heat-exchanging unit 60 are replaced by a most-upstream turn-around pipe 78 and a most-upstream turn-around flow path JP3. In the most-upstream heat-exchanging unit 70, the third path P3 and the fourth path P4 of the downwind heat-exchanging unit 60 are replaced by a fifth path P5 and a sixth path P6. In the most-upstream heat-exchanging unit 70, the superheating area SH2, the second superheating area SH4, and the second subcooling area SC2 of the downwind heat-exchanging unit 60 are replaced by a superheating area SH5, a second superheating area SH6, and a second subcooling area SC3.

Even the indoor heat exchanger 25*a* that includes the most-upstream heat-exchanging unit 70 of such a form realizes the same operational effects as those provided by the above-described embodiments.

In particular, in the indoor heat exchanger 25*a*, in an installed state, the most-upstream heat-exchanging unit 70 is disposed beside the upwind heat-exchanging unit 50 on the upwind side of the upwind heat-exchanging unit 50 so that the direction of flow of the refrigerant through the second subcooling area SC3 (area in which a liquid refrigerant in a subcooled state flows when a heating operation is performed, that is, when a gas refrigerant in a superheated state that has flown in from the gas-side inlets/outlets GH exchanges heat with the air flow and flows out as the liquid refrigerant in the subcooled state from the liquid-side inlets/outlets LH) is the same as the direction of flow of the refrigerant through the first subcooling area SC1 of the upwind heat-exchanging unit 50.

Therefore, when the indoor heat exchanger 25*a* (so-called two-row flat-tube heat exchanger) in which a plurality of heat-exchanging units are arranged side by side on the upwind side and on the downwind side is used as a condenser of a refrigerant, of the upwind heat-exchanging unit 50 and the most-upstream heat-exchanging unit 70, the second superheating area SH6 on the upwind side and the first subcooling area SC1 on the downwind side are suppressed from partly overlapping each other or being close to each other when viewed in the air flow direction dr3. As a result, passage of the indoor air flow AF that has passed the second superheating area SH6 of the most-upstream heat-exchanging unit 70 through the first subcooling area SC1 of the upwind heat-exchanging unit 50 is suppressed. Therefore, in the first subcooling area SC1 in the upwind heat-exchanging unit 50, temperature differences between the refrigerant and the indoor air flow AF is easily properly ensured, and this helps a degree of subcooling to be properly ensured.

At the indoor heat exchanger 25*a*, in the most-upstream heat-exchanging unit 70, the most-upstream first header 76 is formed so as to include the most-upstream first space C1 (space that communicates with the third gas-side inlet/outlet GH3) and the most-upstream second space C2 (space that is partitioned from the most-upstream first space C1 and that communicates with the third liquid-side inlets/outlets LH3) therein. Moreover, the most-upstream third space C3 (space that communicates with the most-upstream first space C1 via the downwind heat transfer tubes 45*b*) of the most-upstream second header 77 and the most-upstream fourth space C4 (space that communicates with the most-upstream second space C2 via the downwind heat transfer tubes 45*b*) of the most-upstream second header 77 are allowed to communicate with each other by the most-upstream turn-around flow path JP3.

Consequently, the first superheating area SH3 that is formed at the upwind heat-exchanging unit 50 and the second superheating area SH6 that is formed at the most-upstream heat-exchanging unit 70 can be prevented from overlapping each other in the air flow direction dr3. As a result, of the indoor air flow AF that has passed the upwind heat-exchanging unit 50 and the most-upstream heat-exchanging unit 70, large differences in the proportions between air that has sufficiently exchanged heat with the refrigerant and air that has not sufficiently exchanged heat with the refrigerant depending upon portions where the air flow passes are suppressed. Therefore, temperature unevenness of air that has passed the indoor heat exchanger 25*a* is suppressed.

Further, in the indoor heat exchanger 25*a*, the direction of flow of the refrigerant that flows through the second superheating area SH6 of the most-upstream heat-exchanging unit 70 is opposite to the direction of flow of the refrigerant that flows through the first superheating area SH3 of the upwind heat-exchanging unit 50. Therefore, when a heating operation is performed, the refrigerant in the first superheating area SH3 of the upwind heat-exchanging unit 50 and the refrigerant in the second superheating area SH6 of the upwind heat-exchanging unit 70 flow so as to oppose each other. As a result, of the indoor air flow AF that has passed the upwind heat-exchanging unit 50 and the most-upstream heat-exchanging unit 70, large differences in the proportions between air that has sufficiently exchanged heat with the refrigerant and air that has not sufficiently exchanged heat with the refrigerant depending upon portions where the air flow passes are suppressed. Therefore, temperature unevenness of air that has passed the indoor heat exchanger 25*a* is suppressed.

The indoor heat exchanger 25*a* may further include the downwind heat-exchanging unit 60. That is, the indoor heat exchanger 25*a* may be formed as a flat-tube heat exchanger having three or more rows and including three or more heat-exchanging units in the air flow direction dr3. Even in such a case, the same operational effects as those provided by the above-described embodiments can be realized.

(6-3) Modification 3

In the above-described embodiments, the upwind first-header spaces Sa1 in the upwind first header 56 are formed so that the upwind first space A1 and the upwind second space A2 are arranged side by side in this order from top to bottom. In addition, in the upwind second header 57, the upwind second header spaces Sa2 are formed so that the upwind third space A3 and the upwind fourth space A4 are arranged side by side in this order from top to bottom. That is, the paths that are formed in the upwind heat-exchanging unit 50 are formed so that the first path P1 is positioned at the upper layer and the second path P2 is positioned at the lower layer.

However, the mode of formation of the upwind first-header spaces Sa1 and the upwind second-header spaces Sa2 and the mode of formation of the paths in the upwind heat-exchanging unit 50 are not necessarily limited thereto, and can be changed as appropriate in accordance with design specifications and installation environments as long as operational effects that are the same as those provided by the above-described embodiments can be realized.

For example, the upwind first-header spaces Sa1 may be formed so that the upwind first space A1 and the upwind second space A2 are arranged side by side in this order from bottom to top. In such a case, even in the upwind second header 57, the upwind second-header spaces Sa2 are formed so that the upwind third space A3 and the upwind fourth space A4 are arranged side by side in this order from bottom to top. As a result, the paths that are formed in the upwind heat-exchanging unit 50 are formed so that the first path P1 is positioned at the lower layer and the second path P2 is positioned at the upper layer.

In the upwind first header spaces Sa1 and the upwind second header spaces Sa2, new spaces that differ from the upwind first space A1 and upwind second space A2 and the upwind third space A3 and upwind fourth space A4 may be formed as long as contradictions do not occur with regard to the operational effects of the above-described embodiments.

When the positions of the paths are changed, the positions where the openings (GH1, LH1, H1, and H2) that communicate with the paths are formed are also correspondingly changed as appropriate.

(6-4) Modification 4

In the above-described embodiments, the downwind first-header spaces Sb1 in the downwind first header 66 are formed so that the downwind first space B1 and the downwind second space B2 are arranged side by side in this order from top to bottom. In addition, in the downwind second header 67, the downwind second header spaces Sb2 are formed so that the downwind third space B3 and the downwind fourth space B4 are arranged side by side in this order from top to bottom. That is, the paths that are formed in the upwind heat-exchanging unit 50 are formed so that the third path P3 is positioned at the upper layer and the fourth path P4 is positioned at the lower layer.

However, the mode of formation of the downwind first-header spaces Sb1 and the downwind second-header spaces Sb2 and the mode of formation of the paths in the upwind heat-exchanging unit 50 are not necessarily limited thereto, and can be changed as appropriate in accordance with design specifications and installation environments as long as operational effects that are the same as those provided by the above-described embodiments can be realized.

For example, the downwind first-header spaces Sb1 may be formed so that the downwind first space B1 and the downwind second space B2 are arranged side by side in this order from bottom to top. In such a case, even in the downwind second header 67, the downwind second-header spaces Sb2 are formed so that the downwind third space B3 and the downwind fourth space B4 are arranged side by side in this order from bottom to top. As a result, the paths that are formed in the upwind heat-exchanging unit 50 are formed so that the third path P3 is positioned at the lower layer and the fourth path P4 is positioned at the upper layer.

In the downwind first header spaces Sb1 and the downwind second header spaces Sb2, new spaces that differ from the downwind first space B1 and downwind second space B2 and the downwind third space B3 and downwind fourth space B4 may be formed as long as contradictions do not occur with regard to the operational effects of the above-described embodiments.

When the positions of the paths are changed, the positions where the openings (GH2, LH2, H3, and H4) that communicate with the paths are formed are also correspondingly changed as appropriate.

(6-5) Modification 5

In the indoor heat exchanger 25 according to the above-described embodiments, the downwind heat-exchanging unit 60 is disposed beside the upwind heat-exchanging unit 50 on the downwind side of the upwind heat-exchanging unit 50 so that the direction of flow of the refrigerant in the second subcooling area SC2 is the same as the direction of flow of the refrigerant in the first subcooling area SC1 of the upwind heat-exchanging unit 50. From the viewpoint of suppressing, of the upwind heat-exchanging unit 50 and the downwind heat-exchanging unit 60, the first superheating area SH3 on the upwind side and the second subcooling area SC2 on the downwind side from partly overlapping each other or being close to each other when viewed in the air flow direction dr3, it is desirable that the indoor heat exchanger 25 be formed in such a mode. However, it is not necessarily limited thereto. The direction of flow of the refrigerant in the first subcooling area SC1 of the upwind heat-exchanging unit 50 and the direction of flow of the refrigerant in the second subcooling area SC2 of the downwind heat-exchanging unit 60 need not be the same. Even in such a case, the same operational effects as those provided by (5-1) above can be realized.

(6-6) Modification 6

In the above-described embodiments, in the downwind heat-exchanging unit 60, a plurality of paths (third path P3 and fourth path P4) are formed, and the downwind turn-around flow path JP2 is formed so that the refrigerant that has flown into the downwind heat-exchanging unit 60 turns around at a location between the paths. However, the downwind heat-exchanging unit 60 need not be formed in this mode. That is, in the downwind heat-exchanging unit 60, it is possible to connect the second gas-side connection pipe GP2 to one of the downwind first header 66 and the downwind second header 67, and the second liquid-side connection pipe LP2 to the other of the downwind first header 66 and the downwind second header 67, and form only one path. In such a case, in the downwind first header 66 and the downwind second header 67, it is possible to omit the horizontal partition plate 661 or 671 and form one downwind first header space Sb1 or one downwind second header space Sb2. Even in such a case, the same operational effects as those provided by (5-1) above can be realized.

(6-7) Modification 7

In the above-described embodiments, when a heating operation is performed, the direction of flow of the refrigerant that flows through the second superheating area SH4 is opposite to the direction of flow of the refrigerant that flows through the first superheating area SH3. From the viewpoint of suppressing temperature unevenness of air that has passed the indoor heat exchanger 25, it is desirable that the indoor heat exchanger 25 be formed in such a mode. However, it is not necessarily limited thereto. In the indoor heat exchanger 25, the direction of flow of the refrigerant that flows through the second superheating area SH4 need not be opposite to the direction of flow of the refrigerant that passes through the first superheating area SH3. Even in such a case, the same operational effects as those provided by (5-1) above can be realized.

(6-8) Modification 8

In the above-described embodiments, the downwind turn-around flow path JP2 is formed by the downwind turn-around pipe 68. However, the mode of formation of the downwind turn-around flow path JP2 is not necessarily limited thereto, and can be changed as appropriate in accordance with design specifications and installation environments.

For example, in the downwind heat-exchanging unit 60, an opening may be formed in the partition plate (in the above-described embodiments, the horizontal partition plate 671) that partitions both spaces (in the above-described embodiments, the downwind third space B3 and the downwind fourth space B4) that communicate with each other at the downwind turn-around flow path JP2 to allow both the spaces to communicate with each other via the opening. In such a case, the opening that is formed in the partition plate corresponds to "second communication path" in the claims, and the partition plate in which the opening is formed corresponds to "second communication path formation portion" in the claims.

(6-9) Modification 9

In the above-described embodiments, regarding the first liquid-side connection pipe LP1 and the second liquid-side connection pipe LP2, the case in which an end portion of each header collecting pipe (57, 66) to which a corresponding one of the first liquid-side connection pipe LP1 and the second liquid-side connection pipe LP2 is connected is branched into a plurality of branching pipes (two branching pipes) is described. However, an end portion of the first liquid-side connection pipe LP1 or the second liquid-side connection pipe LP2 need not be branched into a plurality of branching pipes in such a mode. In relation to this, a plurality of first liquid-side inlets/outlets LH1 or a plurality of second liquid-side inlets/outlets LH2 need not be formed.

(6-10) Modification 10

In the above-described embodiment, the case in which the one end and the other end of the upwind turn-around pipe 58 branch into a plurality of branching pipes (two branching portions) is described. However, the one end or the other end of the upwind turn-around pipe 58 need not be branched into a plurality of branching pipes in such a mode. In relation to this, a plurality of first connection holes H1 or a plurality of second connection holes H2 need not be formed.

(6-11) Modification 11

In the above-described embodiments, the upwind first header 56 and the downwind second header 67 that are arranged adjacent to each other in the air flow direction dr3 are formed as separate headers, and, similarly, the upwind second header 57 and the downwind first header 66 are formed as separate headers. However, it is not necessarily limited thereto. In the indoor heat exchanger 25, the plurality of header collecting pipes (here, the upwind first header 56 and the downwind second header 67, or the upwind second header 57 and the downwind first header 66) that are arranged adjacent to each other in the air flow direction dr3 may be integrally formed. That is, by forming the plurality of header collecting pipes that are arranged adjacent to each other in the air flow direction dr3 out of one header collecting pipe and dividing the internal space of such a header collecting pipe into two spaces by a longitudinal partition plate that partitions the internal space in a longitudinal direction, the upwind first-header space Sa1 and the downwind second-header space Sb2 or the upwind second-header space Sa2 and the downwind first-header space Sb1 may be formed. In such a case, by forming an opening in a flow-path formation member, such as the longitudinal partition plate, that is disposed inside the header collecting pipe, a refrigerant flow path that allows each space to communicate with each other can be formed.

(6-12) Modification 12

In the above-described embodiments, the case in which the upwind heat-exchanging unit 50 and the downwind heat-exchanging unit 60 include four heat-exchange surfaces 40 (upwind heat-exchange surfaces 55 or downwind heat-exchange surfaces 65) is described. However, the number of heat-exchange surfaces 40 of the upwind heat-exchanging unit 50 and the number of heat-exchange surfaces 40 of the downwind heat-exchanging unit 60 are not limited, and can be changed as appropriate in accordance with design specifications and installation environments to three or less or five or more.

For example, the upwind heat-exchanging unit 50 and the downwind heat-exchanging unit 60 may each include two heat-exchange surfaces 40. Even in such a case, advantageous effects that are the same as those provided by the above-described embodiments can be realized. In particular, by forming the upwind heat-exchanging unit 50 and the downwind heat-exchanging unit 60 so as to have a substantially V shape in plan view or side view, the operational effects described in (5-6) above can also be realized (in such a case, in each of the upwind heat-exchanging unit 50 and the downwind heat-exchanging unit 60, one of the heat-exchange surfaces 40 corresponds to "first portion", and the other heat-exchange surface 40 corresponds to "second portion").

The upwind heat-exchanging unit 50 and the downwind heat-exchanging unit 60 may each include three heat-exchange surfaces 40. Even in such a case, advantageous effects that are the same as those provided by the above-described embodiments can be realized. In particular, by forming the upwind heat-exchanging unit 50 and the downwind heat-exchanging unit 60 so as to have a substantially U shape in plan view or side view, the operational effects described in (5-6) above can also be realized (in such a case, in each of the upwind heat-exchanging unit 50 and the downwind heat-exchanging unit 60, the heat-exchange surface 40 to which one of the header collecting pipes is connected corresponds to "first portion", and the heat-exchange surface 40 to which the other header collecting pipe is connected corresponds to "second portion").

The upwind heat-exchanging unit 50 and the downwind heat-exchanging unit 60 may each include only one heat-exchange surface 40. Even in such a case, advantageous effects that are the same as those provided by the above-described embodiments can be realized (except the operational effects described in (5-6) and (5-7) above).

(6-13) Modification 13

In the above-described embodiments, the gas-side connection pipes GP (GP1 and GP2) are each individually connected to a corresponding one of the first gas-side inlet/outlet GH1 of the upwind heat-exchanging unit 50 and second gas-side inlet/outlet GH2 of the downwind heat-exchanging unit 60. In addition, the liquid-side connection pipes LP (LP1 and LP2) are each individually connected to the first liquid-side inlets/outlets LH1 of the upwind heat-exchanging unit 50 or second liquid-side inlets/outlets LH2 of the downwind heat-exchanging unit 60. However, the modes of connection of the gas-side connection pipes GP and the liquid-side connection pipes LP in the indoor heat exchanger 25 are not necessarily limited thereto, and can be changed as appropriate.

For example, a shunt may be disposed between the indoor heat exchanger 25 and each gas-side connection pipe GP or each liquid-side connection pipe LP, and both may be made to communicate with each other via the shunt. As long as inconsistencies in the flow of the refrigerant do not occur, the upwind heat-exchanging unit 50 and the downwind heat-exchanging unit 60 may each further include a header collecting pipe differing from the header collecting pipes (56 and 57 or 66 and 67) described in the above-described embodiments.

(6-14) Modification 14

In the above-described embodiments, the first path P1 includes fifteen upwind heat transfer tubes 45*a* (heat-transfer-tube flow paths 451). However, the mode of formation of the first path P1 is not necessarily limited thereto, and can be changed as appropriate. That is, the first path P1 may include 14 or fewer or 16 or more upwind heat transfer tubes 45*a* (heat-transfer-tube flow paths 451).

In the above-described embodiments, the second path P2 includes four upwind heat transfer tubes 45*a* (heat-transfer-tube flow paths 451). However, the mode of formation of the second path P2 is not necessarily limited thereto, and can be changed as appropriate. That is, the second path P2 may include 3 or fewer or 5 or more upwind heat transfer tubes 45*a* (heat-transfer-tube flow paths 451).

In the above-described embodiments, the third path P3 includes fifteen downwind heat transfer tubes 45*b* (heat-transfer-tube flow paths 451). However, the mode of formation of the third path P3 is not necessarily limited thereto, and can be changed as appropriate. That is, the third path P3 may include 14 or fewer or 16 or more downwind heat transfer tubes 45*b* (heat-transfer-tube flow paths 451). The third path P3 need not include the same number of heat transfer tubes 45 as the first path P1. That is, the number of heat transfer tubes 45 that are included in the third path P3 may differ from the number of heat transfer tubes 45 that are included in the first path P1.

In the above-described embodiments, the fourth path P4 includes four downwind heat transfer tubes 45*b* (heat-transfer-tube flow paths 451). However, the mode of formation of the fourth path P4 is not necessarily limited thereto, and can be changed as appropriate. That is, the fourth path P4 may include 3 or fewer or five or more downwind heat transfer tubes 45*b* (heat-transfer-tube flow paths 451). The fourth path P4 need not include the same number of heat transfer tubes 45 as the second path P2. That is, the number of heat transfer tubes 45 that are included in the fourth path P4 may differ from the number of heat transfer tubes 45 that are included in the second path P2.

(6-15) Modification 15

In the above-described embodiments, the area of the downwind first heat-exchange surface 61 is substantially the same as the area of the upwind fourth heat-exchange surface 54 when viewed in the air flow direction dr3. However, the downwind first heat-exchange surface 61 need not be formed in this mode, and may be formed so that its area differs from the area of the upwind fourth heat-exchange surface 54 when viewed in the air flow direction dr3.

In the above-described embodiments, the area of the downwind second heat-exchange surface 62 is substantially the same as the area of the upwind third heat-exchange surface 53 when viewed in the air flow direction dr3. However, the downwind second heat-exchange surface 62 need not be formed in this mode, and may be formed so that its area differs from the area of the upwind third heat-exchange surface 53 when viewed in the air flow direction dr3.

In the above-described embodiments, the area of the downwind third heat-exchange surface 63 is substantially the same as the area of the upwind second heat-exchange surface 52 when viewed in the air flow direction dr3. However, the downwind third heat-exchange surface 63 need not be formed in this mode, and may be formed so that its area differs from the area of the upwind second heat-exchange surface 52 when viewed in the air flow direction dr3.

In the above-described embodiments, the area of the downwind fourth heat-exchange surface 64 is substantially the same as the area of the upwind first heat-exchange surface 51 when viewed in the air flow direction dr3. However, the downwind fourth heat-exchange surface 64 need not be formed in this mode, and may be formed so that its area differs from the area of the upwind first heat-exchange surface 51 when viewed in the air flow direction dr3.

(6-16) Modification 16

The indoor heat exchanger 25 according to the above-described embodiments is a flat-tube heat exchanger having two rows and including the upwind heat-exchanging unit 50 and the downwind heat-exchanging unit 60. However, as long as contradictions do not occur with regard to the operational effects of the above-described embodiments, the indoor heat exchanger 25 may be formed as a flat-tube heat exchanger having three or more rows and include a new heat-exchanging unit.

In the indoor heat exchanger 25, the downwind heat-exchanging unit 60 need not be provided, and can be omitted as appropriate. That is, the indoor heat exchanger 25 may be formed as a flat-tube heat exchanger having one row. Even in such a case, operational effects that are the same as those described in (5-1) above can be realized.

(6-17) Modification 17

In the above-described embodiments, the indoor heat exchanger 25 includes 19 heat transfer tubes 45. However, the number of heat transfer tubes 45 that are included in the indoor heat exchanger 25 can be changed as appropriate in accordance with design specifications and installation environments. For example, the indoor heat exchanger 25 may include 18 or fewer or 20 or more heat transfer tubes 45.

(6-18) Modification 18

In the above-described embodiments, each heat transfer tube 45 is a flat multi-perforated tube in which a plurality of heat-transfer-tube flow paths 451 are formed in its interior. However, the mode of construction of the heat transfer tubes 45 can be changed as appropriate. For example, flat tubes having one refrigerant flow path formed in their interior may be used as the heat transfer tubes 45. In addition, heat transfer tubes having a shape other than a plate shape (heat transfer tubes other than flat tubes) may be used as the heat transfer tubes 45.

The heat transfer tubes 45 need not be made of aluminum or an aluminum alloy, and materials of the heat transfer tubes 45 can be changed as appropriate. For example, the heat transfer tubes 45 may be made of copper. Similarly, the heat transfer fins 48 need not be made of aluminum or an aluminum alloy, and materials of the heat transfer fins 48 can be changed as appropriate.

(6-19) Modification 19

In the above-described embodiments, the indoor heat exchanger 25 is disposed so as to surround the indoor fan 28. However, the indoor heat exchanger 25 need not be disposed so as to surround the indoor fan 28, and the mode of arrangement can be changed as appropriate as long as it is a mode that allows heat exchange between the indoor air flow AF and the refrigerant.

(6-20) Modification 20

In the above-described embodiments, the case in which the indoor heat exchanger 25 in an installed state is such that the heat-transfer-tube extension direction dr1 is a horizontal direction and the heat-transfer-tube lamination direction dr2 is a vertical direction (up-down direction) is described. However, it is not necessarily limited thereto, so that the indoor heat exchanger 25 may be formed and arranged so that, in the installed state, the heat-transfer-tube extension direction dr1 is a vertical direction and the heat-transfer-tube lamination direction dr2 is a horizontal direction.

In the above-described embodiments, the case in which the air flow direction dr3 is a horizontal direction is described. However, it is not necessarily limited thereto. The air flow direction dr3 can be changed as appropriate in accordance with the mode of construction and installation mode of the indoor heat exchanger 25. For example, the air flow direction dr3 may be a vertical direction that intersects the heat-transfer-tube extension direction dr1.

(6-21) Modification 21

In the above-described embodiments, the indoor heat exchanger 25 is applied to a ceiling-embedded-type indoor unit 20 that is installed in the ceiling rear space CS of the target space. However, the type of indoor unit 20 to which the indoor heat exchanger 25 is applied is not limited. For example, the indoor heat exchanger 25 may be applied to a ceiling-suspension-type indoor unit that is fixed to the ceiling surface CL of the target space, a wall-mounted-type indoor unit that is installed on a side wall, a floor-placement-type indoor unit that is installed on a floor surface, and a floor-embedded-type indoor unit that is installed at the back surface of a floor.

(6-22) Modification 22

The mode of construction of the refrigerant circuit RC in the above-described embodiments can be changed as appropriate in accordance with installation environments and design specifications. Specifically, some of the circuit elements in the refrigerant circuit RC may be replaced by other devices, or may be omitted as appropriate when the circuit elements are not necessarily needed. For example, the four-way switching valve 12 may be omitted as appropriate and the air conditioner may be formed as an air conditioner for a heating operation. The refrigerant circuit RC may include devices that are not shown in FIG. 1 (for example, a subcooling heat exchanger or a receiver) and refrigerant flow paths (such as a circuit that causes refrigerant bypassing). For example, in the above-described embodiments, a plurality of compressors 11 may be arranged in series or in parallel.

(6-23) Modification 23

In the above-described embodiments, the case in which a HFC refrigerant, such as R32 and R410A, is used as a refrigerant that circulates in the refrigerant circuit RC is described. However, the refrigerant that is used in the refrigerant circuit RC is not limited. For example, in the refrigerant circuit RC, for example, HFO1234yf, HFO1234ze (E), and mixed refrigerants thereof may be used. In addition, in the refrigerant circuit RC, HFC-based refrigerants, such as R407C, may be used.

(6-24) Modification 24

In the above-described embodiments, one outdoor unit 10 and one indoor unit 20 are connected to each other by the connection pipes (LP and GP) to form the refrigerant circuit RC. However, the number of outdoor units 10 and the number of indoor units 20 can be changed as appropriate. For example, the air conditioner 100 may include a plurality of outdoor units 10 that are connected in series or in parallel. The air conditioner 100 may include, for example, a plurality of indoor units 20 that are connected in series or in parallel.

(6-25) Modification 25

Although, in the above-described embodiments, the present invention is applied to the indoor heat exchanger 25, it is not limited thereto, and may be applied to other heat exchangers. For example, the present invention may be applied to the outdoor heat exchanger 13. In such a case, outdoor air flow that is produced by the outdoor fan 15 corresponds to the indoor air flow AF in the above-described embodiments.

(6-26) Modification 26

In the above-described embodiments, the present invention is applied to the air conditioner 100 serving as a refrigeration apparatus. However, the present invention may be applied to a refrigeration apparatus other than the air conditioner 100. For example, the present invention may also be applied to a low-temperature refrigeration apparatus used in a refrigeration and cold container or a store room/showcase, or other types of refrigeration apparatuses including a refrigerant circuit and a heat exchanger, such as a hot water supply apparatus or heat pump chiller.

(7) Reference Example

In the above-described embodiments, the first path P1 and the second path P2 communicate with each other by connecting them with the upwind turn-around pipe 58, and the third path P3 and the fourth path P4 communicate with each other by connecting them with the downwind turn-around pipe 68. As a result, the paths are formed so that, during operation, the refrigerant flows in modes such as those shown in FIGS. 13 to 16. However, each path in the indoor heat exchanger 25 can be allowed to communicate with each other in other modes.

For example, the indoor heat exchanger 25 can be formed like an indoor heat exchanger 250 shown in FIGS. 21 to 25. The indoor heat exchanger 250 is described below. In the description below, unless otherwise noted, explanations that are left out can be interpreted as being substantially the same as those of the indoor heat exchanger 25.

Figure 21:
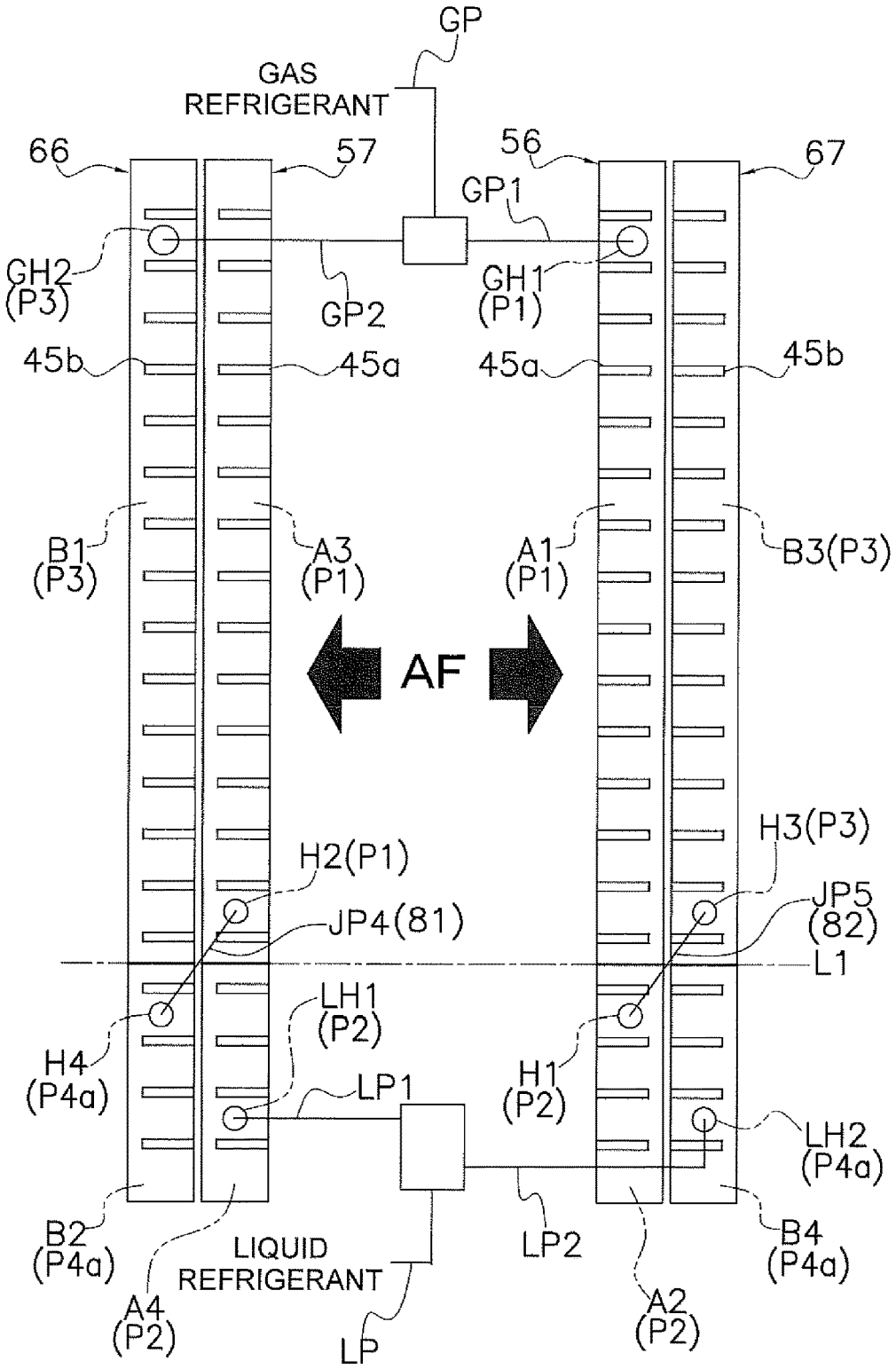
FIG. 21 is a schematic view schematically showing refrigerant paths that are formed in an indoor heat exchanger according to a reference example.

FIG. 21 is a schematic view schematically showing refrigerant paths that are formed in the indoor heat exchanger 250.

In the indoor heat exchanger 250, the upwind heat-exchanging unit 50 includes a first turn-around pipe 81 instead of the upwind turn-around pipe 58, and the downwind heat-exchanging unit 60 includes a second turn-around pipe 82 instead of the downwind turn-around pipe 68. In the indoor heat exchanger 250, the fourth connection hole H4 is formed in the downwind first header 66 instead of in the downwind second header 67 so as to communicate with the downwind second space B2. In the indoor heat exchanger 250, the second liquid-side inlets/outlets LH2 are formed in the downwind second header 67 instead of in the downwind first header 66 so as to communicate with the downwind fourth space B4.

The first turn-around pipe 81 forms a first turn-around flow path JP4. One end of the first turn-around pipe 81 is connected to the second connection holes H2 that are formed in the upwind second header 57, and the other end of the first turn-around pipe 81 is connected to the fourth connection hole H4 that is formed in the downwind first header 66. In the indoor heat exchanger 250, by disposing the first turn-around pipe 81 in this mode, the upwind third space A3 and the downwind second space B2 communicate with each other by the first turn-around flow path JP4.

The second turn-around pipe 82 forms a second turn-around flow path JP5. One end of the second turn-around pipe 82 is connected to the first connection holes H1 that are formed in the upwind first header 56, and the other end of the second turn-around pipe 82 is connected to the third connection hole H3 that is formed in the downwind second header 67. In the indoor heat exchanger 250, by disposing the second turn-around pipe 82 in this mode, the upwind second space A2 and the downwind third space B3 communicate with each other by the second turn-around flow path JP5.

In the indoor heat exchanger 250, a fourth path P4*a* is formed instead of the fourth path P4. Similarly to the fourth path P4, the fourth path P4*a* is formed below an alternate long and short dashed line L1 in the downwind heat-exchanging unit 60. The fourth path P4*a* is a refrigerant flow path that is formed by allowing the fourth connection hole H4 to communicate with the downwind second space B2, the downwind second space B2 to communicate with the downwind fourth space B4 via the heat-transfer-tube flow paths 451 (downwind heat transfer tubes 45*b*), and the downwind fourth space B4 *o* communicate with the second liquid-side inlets/outlets LH2. That is, the fourth path P4*a* is a refrigerant flow path that includes the fourth connection hole H4, the downwind second space B2 in the downwind first header 66, the heat-transfer-tube flow paths 451 in the downwind heat transfer tubes 45*b*, the downwind fourth space B4 in the downwind second header 67, and the second liquid-side inlets/outlets LH2.

The fourth path P4*a* communicates with the first path P1 via the first turn-around flow path JP4 (first turn-around pipe 81). Therefore, the fourth path P4*a* along with the first path P1 can be interpreted as being one path.

In the indoor heat exchanger 250, the second path P2 communicates with the third path P3 via the second turn-around flow path JP5 (second turn-around pipe 82). Therefore, the second path P2 along with the third path P3 can be interpreted as being one path.

Figure 22:
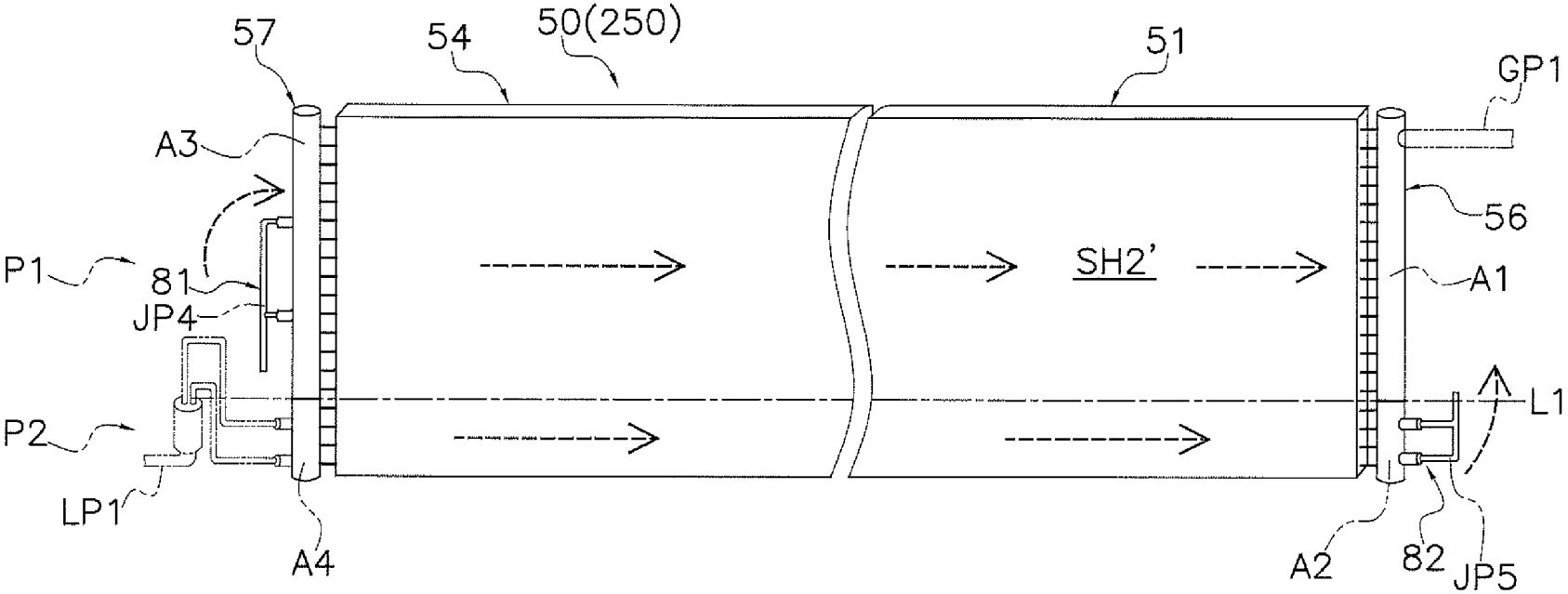
FIG. 22 is a schematic view schematically showing a flow of a refrigerant in an upwind heat-exchanging unit of the indoor heat exchanger according to the reference example when a cooling operation is performed.
Figure 23:
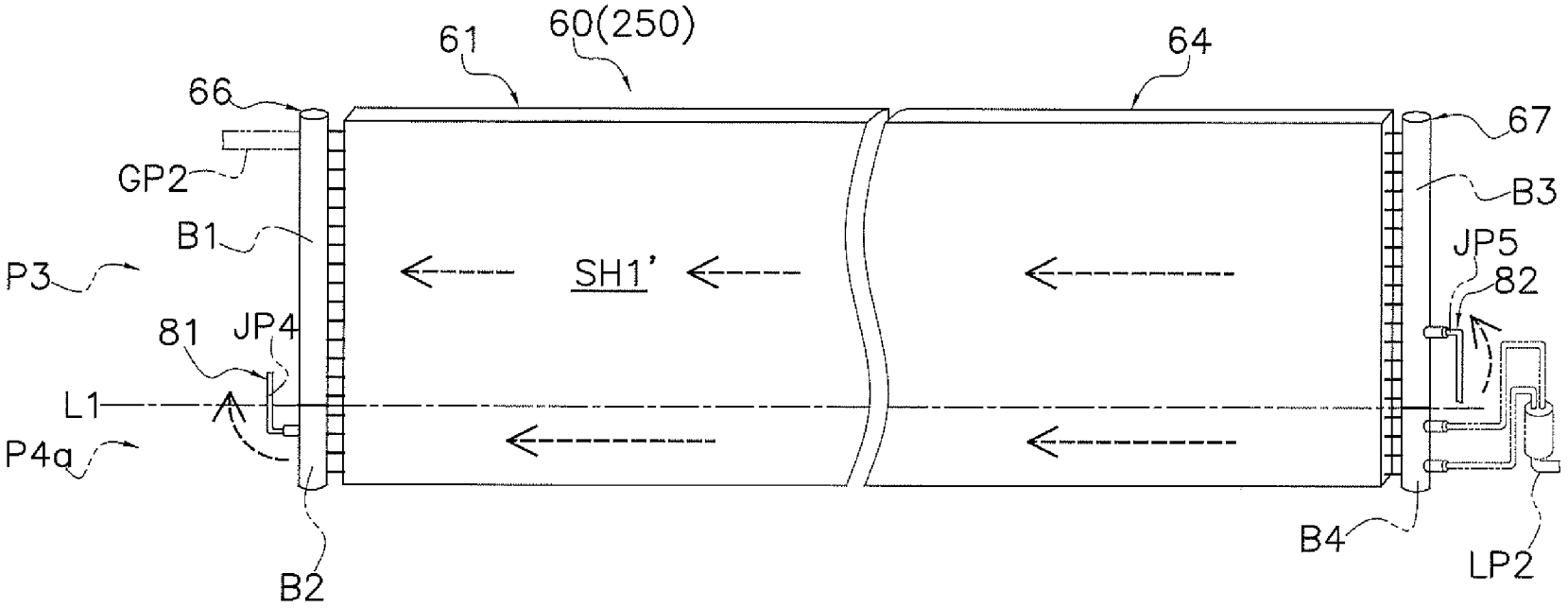
FIG. 23 is a schematic view schematically showing a flow of a refrigerant in a downwind heat-exchanging unit of the indoor heat exchanger according to the reference example when a cooling operation is performed.
Figure 24:
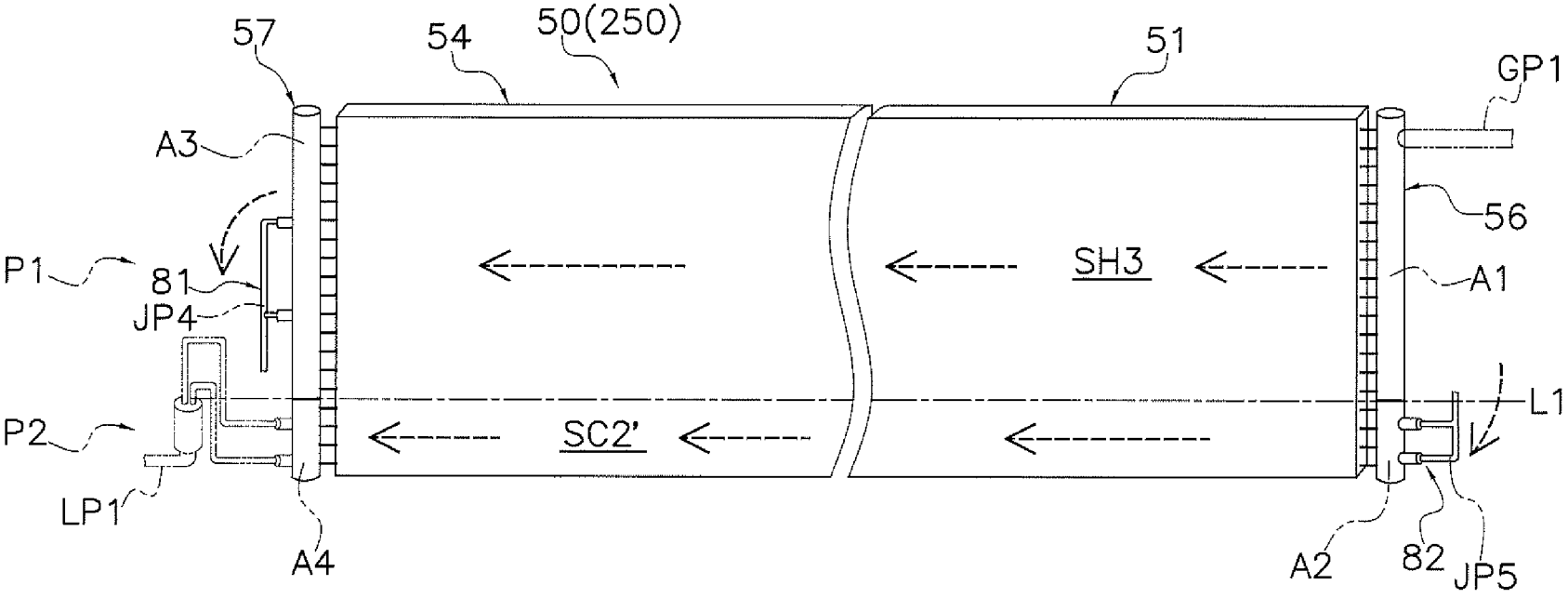
FIG. 24 is a schematic view schematically showing a flow of a refrigerant in the upwind heat-exchanging unit of the indoor heat exchanger according to the reference example when a heating operation is performed.
Figure 25:
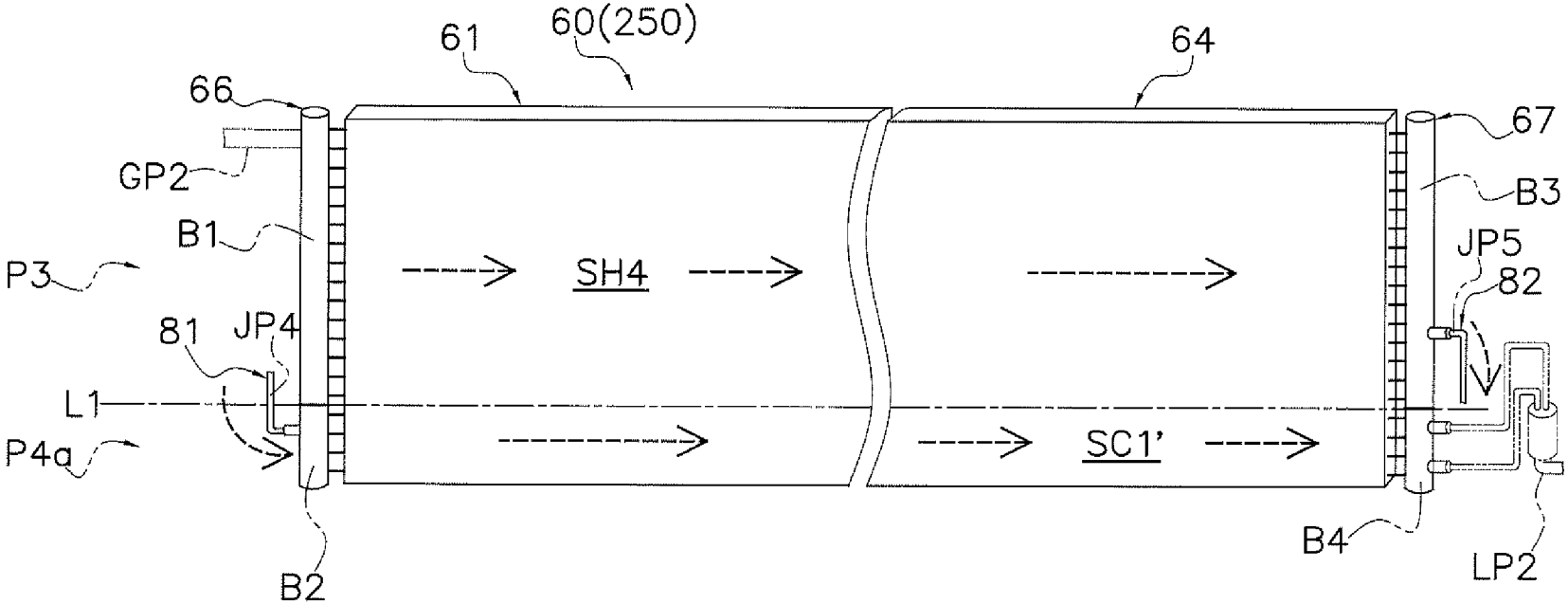
FIG. 25 is a schematic view schematically showing a flow of a refrigerant in the downwind heat-exchanging unit of the indoor heat exchanger according to the reference example when a heating operation is performed.

FIG. 22 is a schematic view schematically showing a flow of a refrigerant in the upwind heat-exchanging unit 50 of the indoor heat exchanger 250 when a cooling operation is performed. FIG. 23 is a schematic view schematically showing a flow of a refrigerant in the downwind heat-exchanging unit 60 of the indoor heat exchanger 250 when a cooling operation is performed. FIG. 24 is a schematic view schematically showing a flow of a refrigerant in the upwind heat-exchanging unit 50 of the indoor heat exchanger 250 when a heating operation is performed. FIG. 25 is a schematic view schematically showing a flow of a refrigerant in the downwind heat-exchanging unit 60 of the indoor heat exchanger 250 when a heating operation is performed.

When a cooling operation is performed, a refrigerant that has flown through the first liquid-side connection pipe LP1 flows into the second path P2 of the upwind heat-exchanging unit 50 via the first liquid-side inlets/outlets LH1. The refrigerant that has flown into the second path P2 passes through the second path P2 while exchanging heat with the indoor air flow AF and being heated, and flows into the third path P3 of the downwind heat-exchanging unit 60 via the second turn-around flow path JP5 (second turn-around pipe 82). The refrigerant that has flown into the third path P3 passes through the third path P3 while exchanging heat with the indoor air flow AF and being heated, and flows out to the second gas-side connection pipe GP2 via the second gas-side inlet/outlet GH2.

When a cooling operation is performed, a refrigerant that has flown through the second liquid-side connection pipe LP2 flows into the fourth path P4*a* of the downwind heat-exchanging unit 60 via the second liquid-side inlets/outlets LH2. The refrigerant that has flown into the fourth path P4*a* passes through the fourth path P4*a* while exchanging heat with the indoor air flow AF and being heated, and flows into the first path P1 of the upwind heat-exchanging unit 50 via the first turn-around flow path JP4 (first turn-around pipe 81). The refrigerant that has flown into the first path P1 passes through the first path P1 while exchanging heat with the indoor air flow AF and being heated, and flows out to the first gas-side connection pipe GP1 via the first gas-side inlet/outlet GH1.

In this way, when the cooling operation is performed, in the indoor heat exchanger 250, a refrigerant flow in which the refrigerant flows into the second path P2 and flows out via the third path P3 (that is, a refrigerant flow that is produced by the second path P2 and the third path P3) and a refrigerant flow in which the refrigerant flows into the fourth path P4*a* and flows out via the first path P1 (that is, a refrigerant flow that is produced by the fourth path P4*a* and the first path P1) are produced.

In the refrigerant flow that is produced by the second path P2 and the third path P3, the refrigerant flows through the first liquid-side inlets/outlets LH1, the upwind fourth space A4, the heat-transfer-tube flow paths 451 (upwind heat transfer tubes 45*a*) in the second path P2, the upwind second space A2, the second turn-around flow path JP5 (second turn-around pipe 82), the downwind third space B3, the heat-transfer-tube flow paths 451 (downwind heat transfer tubes 45*b*) in the third path P3, the downwind first space B1, and the second gas-side inlet/outlet GH2 in this order.

In the refrigerant flow that is produced by the fourth path P4*a* and the first path P1, the refrigerant flows through the second liquid-side inlets/outlets LH2, the downwind fourth space B4, the heat-transfer-tube flow paths 451 (downwind heat transfer tubes 45*b*) in the fourth path P4*a*, the downwind second space B2, the first turn-around flow path JP4 (first turn-around pipe 81), the upwind third space A3, the heat-transfer-tube flow paths 451 (upwind heat transfer tubes 45*a*) in the first path P1, the upwind first space A1, and the first gas-side inlet/outlet GH1 in this order.

When the cooling operation is performed, in the indoor heat exchanger 250, an area in which a refrigerant that is in a superheated state flows (superheating area SH1') is formed at the heat-transfer-tube flow paths 451 in the third path P3 (in particular, the heat-transfer-tube flow paths 451 that are included at the third path P3 of the downwind first heat-exchange surface 61). Regarding a refrigerant that flows into the upwind heat-exchanging unit 50 and is turned around and flows into the downwind heat-exchanging unit 60, the superheating area SH1' is an area in which a refrigerant in a superheated state flows.

An area in which a refrigerant that is in a superheated state flows (superheating area SH2') is formed at the heat-transfer-tube flow paths 451 in the first path P1 (in particular, the heat-transfer-tube flow paths 451 that are included at the first path P1 of the upwind first heat-exchange surface 51). Regarding a refrigerant that flows into the downwind heat-exchanging unit 60 and is turned around and flows into the upwind heat-exchanging unit 50, the superheating area SH2' is an area in which a refrigerant in a superheated state flows.

When a heating operation is performed, a gas refrigerant that is in a superheated state that has flown through the first gas-side connection pipe GP1 flows into the first path P1 of the upwind heat-exchanging unit 50 via the first gas-side inlet/outlet GH1. The refrigerant that has flown into the first path P1 passes through the first path P1 while exchanging heat with the indoor air flow AF and being cooled, and flows into the fourth path P4*a* of the downwind heat-exchanging unit 60 via the first turn-around flow path JP4 (first turn-around pipe 81). The refrigerant that has flown into the fourth path P4*a* passes through the fourth path P4*a* while exchanging heat with the indoor air flow AF and being in a subcooled state, and flows out to the second liquid-side connection pipe LP2 via the second liquid-side inlets/outlets LH2.

When a heating operation is performed, a gas refrigerant in a superheated state that has flown through the second gas-side connection pipe GP2 flows into the third path P3 of the downwind heat-exchanging unit 60 via the second gas-side inlet/outlet GH2. The refrigerant that has flown into the third path P3 passes through the third path P3 while exchanging heat with the indoor air flow AF and being cooled, and flows into the second path P2 of the upwind heat-exchanging unit 50 via the second turn-around flow path JP5 (second turn-around pipe 82). The refrigerant that has flown into the second path P2 passes through the second path P2 while exchanging heat with the indoor air flow AF and being in a subcooled state, and flows out to the first liquid-side connection pipe LP1 via the first liquid-side inlets/outlets LH1.

In this way, when the heating operation is performed, in the indoor heat exchanger 250, a refrigerant flow in which the refrigerant flows into the first path P1 and flows out via the fourth path P4*a* (that is, a refrigerant flow that is produced by the first path P1 and the fourth path P4*a*) and a refrigerant flow in which the refrigerant flows into the third path P3 and flows out via the second path P2 (that is, a refrigerant flow that is produced by the third path P3 and the second path P2) are produced.

In the refrigerant flow that is produced by the first path P1 and the fourth path P4*a*, the refrigerant flows through the first gas-side inlet/outlet GH1, the upwind first space A1, the heat-transfer-tube flow paths 451 (upwind heat transfer tubes 45*a*) in the first path P1, the upwind third space A3, the first turn-around flow path JP4 (first turn-around pipe 81), the downwind second space B2, the heat-transfer-tube flow paths 451 (downwind heat transfer tubes 45*b*) in the fourth path P4*a*, the downwind fourth space B4, and the second liquid-side inlets/outlets LH2 in this order.

In the refrigerant flow that is produced by the third path P3 and the second path P2, the refrigerant flows through the second gas-side inlet/outlet GH2, the downwind first space B1, the heat-transfer-tube flow paths 451 (downwind heat transfer tubes 45*b*) in the third path P3, the downwind third space B3, the second turn-around flow path JP5 (second turn-around pipe 82), the upwind second space A2, the heat-transfer-tube flow paths 451 (upwind heat transfer tubes 45*a*) in the second path P2, the upwind fourth space A4, and the first liquid-side inlets/outlets LH1 in this order.

When the heating operation is performed, in the indoor heat exchanger 250, in the same mode as the indoor heat exchanger 25, the first superheating area SH3 and the second superheating area SH4 are formed. When the heating operation is performed, in the indoor heat exchanger 250, an area in which a refrigerant that is in a subcooled state flows (second subcooling area SC2') is formed at the heat-transfer-tube flow paths 451 in the second path P2 (in particular, the heat-transfer-tube flow paths 451 that are included at the second path P2 of the upwind fourth heat-exchange surface 54). Regarding a refrigerant that flows into the downwind heat-exchanging unit 60 and is turned around and flows into the upwind heat-exchanging unit 50, the second subcooling area SC2' is an area in which a refrigerant in a subcooled state flows.

An area in which a refrigerant that is in a subcooled state flows (first subcooling area SC1') is formed at the heat-transfer-tube flow paths 451 in the fourth path P4*a* (in particular, the heat-transfer-tube flow paths 451 that are included at the fourth path P4*a* of the downwind fourth heat-exchange surface 64). Regarding a refrigerant that flows into the upwind heat-exchanging unit 50 and is turned around and flows into the downwind heat-exchanging unit 60, the first subcooling area SC1' is an area in which a refrigerant in a subcooled state flows.

At such an indoor heat exchanger 250, in the upwind heat-exchanging unit 50, since the first superheating area SH3 and the second subcooling area SC2' are not adjacent to each other one above another, the same operational effects as or similar operational effects to those described in (5-1) above can be realized.

In the indoor heat exchanger 250, the whole or a large part of the first superheating area SH3 of the upwind heat-exchanging unit 50 and the whole or a large part of the first subcooling area SC1' of the downwind heat-exchanging unit 60 do not overlap each other in the air flow direction dr3. Therefore, the same operational effects as or similar operational effects to those described in (5-2) above can be realized.

The indoor heat exchanger 250 can realize the same operational effects as or similar operational effects to those described in (5-3) to (5-8) above.

In the indoor heat exchanger 250, the first gas-side inlet/out GH1 may be formed in the upwind second header 57 so as to communicate with the upwind third space A3, the first liquid-side inlets/outlets LH1 may be formed in the upwind first header 56 so as to communicate with the upwind second space A2, the first connection holes H1 may be formed in the upwind second header 57 so as to communicate with the upwind fourth space A4, and the second connection holes H2 may be formed in the upwind first header 56 so as to communicate with the upwind first space A1. In such a case, by forming the second gas-side inlet/outlet GH2 in the downwind second header 67 so as to communicate with the downwind third space B3, the second liquid-side inlets/outlets LH2 in the downwind first header 66 so as to communicate with the downwind second space B2, the third connection hole H3 in the downwind first header 66 so as to communicate with the downwind first space B1, and the fourth connection hole H4 in the downwind second header 67 so as to communicate with the downwind fourth space B4, the same operational effects can be realized.

In the indoor heat exchanger 250, since uniformization of the heat load of the upwind heat-exchanging unit 50 and the heat load of the downwind heat-exchanging unit 60 is facilitated, it is possible to expect further improvement in performance.

In the indoor heat exchanger 250, as long as contradictions do not occur with regard to the operation effects, the content of Modification (6) above can be applied as appropriate.

One or more embodiments of the present invention are usable in a heat exchanger or a refrigeration apparatus.

REFERENCE SIGNS LIST

10 outdoor unit
13 outdoor heat exchanger
20 indoor unit
25, 25*a* indoor heat exchanger (heat exchanger)
28 indoor fan
30 casing
30*a* connection pipe insertion port
40 heat-exchange surface
45 heat transfer tube
45*a* upwind heat transfer tube (first flat tube)

45*b* downwind heat transfer tube (second flat tube)
45*c* most-upstream heat transfer tube (second flat tube)
48 heat transfer fin
50 upwind heat-exchanging unit (first heat-exchanging unit)
51 upwind first heat-exchange surface (first portion, third portion)
52 upwind second heat-exchange surface (second portion)
53 upwind third heat-exchange surface
54 upwind fourth heat-exchange surface (fourth portion)
55 upwind heat-exchange surface
56 upwind first header (first header)
57 upwind second header (second header)
58 upwind turn-around pipe (first communication path formation portion)
60 downwind heat-exchanging unit (second heat-exchanging unit)
61 downwind first heat-exchange surface
62 downwind second heat-exchange surface
63 downwind third heat-exchange surface
64 downwind fourth heat-exchange surface
65 downwind heat-exchange surface
66 downwind first header (third header)
67 downwind second header (fourth header)
68 downwind turn-around pipe (second communication path formation portion)
70 most-upstream heat-exchanging unit (second heat-exchanging unit)
71 most-upstream first heat-exchange surface
72 most-upstream second heat-exchange surface
73 most-upstream third heat-exchange surface
74 most-upstream fourth heat-exchange surface
75 most-upstream heat-exchange surface
76 most-upstream first header (third header)
77 most-upstream second header (fourth header)
78 most-upstream turn-around pipe (second communication path formation portion)
81 first turn-around pipe
82 second turn-around pipe
100 air conditioner (refrigeration apparatus)
451 heat-transfer-tube flow path
561, 571, 661, 671, 761, 771 horizontal partition plate
A1 upwind first space (first space)
A2 upwind second space (second space)
A3 upwind third space (third space)
A4 upwind fourth space (fourth space)
AF indoor air flow
B1 downwind first space (fifth space)
B2 downwind second space (sixth space)
B3 downwind third space (seventh space)
B4 downwind fourth space (eighth space)
C1 most-upstream first space (fifth space)
C2 most-upstream second space (sixth space)
C3 most-upstream third space (seventh space)
C4 most-upstream fourth space (eighth space)
GH gas-side inlet/outlet
GH1 first gas-side inlet/outlet (gas refrigerant inlet/outlet)
GH2 second gas-side inlet/outlet (second gas refrigerant inlet/outlet)
GH3 third gas-side inlet/outlet (second gas refrigerant inlet/outlet)
GP gas-side connection pipe (refrigerant connection pipe)
GP1 first gas-side connection pipe (refrigerant connection pipe)
GP2 second gas-side connection pipe (refrigerant connection pipe)
H1 to H6 first connection hole to sixth connection hole
JP1 upwind turn-around flow path (first communication path)
JP2 downwind turn-around flow path (second communication path)
JP3 most-upstream turn-around flow path (second communication path)
LH liquid-side inlet/outlet
LH1 first liquid-side inlet/outlet (liquid refrigerant inlet/outlet)
LH2 second liquid-side inlet/outlet (second liquid refrigerant inlet/outlet)
LH3 third liquid-side inlet/outlet (second liquid refrigerant inlet/outlet)
LP liquid-side connection pipe (refrigerant connection pipe)
LP1 first liquid-side connection pipe (refrigerant connection pipe)
LP2 second liquid-side connection pipe (refrigerant connection pipe)
P1 to P6 first path to sixth path
RC refrigerant circuit
SC1 first subcooling area
SC2, SC3 second subcooling area
SH3 first superheating area
SH4, SH6 second superheating area
dr1 heat-transfer-tube extension direction
dr2 heat-transfer-tube lamination direction
dr3 air flow direction Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger in which a refrigerant and air flow exchange heat, the heat exchanger comprising:
- a first heat-exchanging unit comprising:
  - a first header comprising a first gas refrigerant inlet/outlet;
  - a second header comprising a first liquid refrigerant inlet/outlet;
  - a plurality of first flat tubes disposed side by side in a longitudinal direction of the first header and the second header, wherein
    - a first end of each of the first flat tubes is connected to the first header, and
    - a second end of each of the first flat tubes is connected to the second header; and
  - a first communication path formation portion that is connected to the first header and the second header and that forms a first communication path, wherein the first header and the second header communicate with each other via the first communication path; and
- a second heat-exchanging unit comprising:
  - a third header comprising a second gas refrigerant inlet/outlet and a second liquid refrigerant inlet/outlet;
  - a fourth header;
  - a plurality of second flat tubes disposed side by side in a longitudinal direction of the third header and the fourth header, wherein
    - a first end of each of the second flat tubes is connected to the third header, and
    - a second end of each of the second flat tubes is connected to the fourth header; and a second communication path formation portion that forms a second communication path, wherein the second heat-exchanging unit is disposed beside the first heat-exchanging unit on an upwind side or on a downwind side of the first heat-exchanging unit, when a gas refrigerant in a superheated state that has flown in from the first gas refrigerant inlet/outlet exchanges heat with the air flow and flows out from the first liquid refrigerant inlet/outlet as a liquid refrigerant in a subcooled state, a first superheated area in which the gas refrigerant flows and a first subcooling area in which the liquid refrigerant flows are formed in the first heat-exchanging unit, when the gas refrigerant in the superheated state has flown in from the second gas refrigerant inlet/outlet and exchanged heat with the air flow and flows out from the second liquid refrigerant inlet/outlet as the liquid refrigerant in the subcooled state, a second superheated area in which the gas refrigerant flows and a second subcooling area in which the liquid refrigerant flows are formed in the second heat-exchanging unit, the first header contains:

a first space that communicates with the first superheated area; and a second space partitioned from the first space, the second header contains:

a third space that communicates with the first space via the first flat tubes; and a fourth space partitioned from the third space and that communicates with the first subcooling area, the third header contains:

a fifth space that communicates with the second gas refrigerant inlet/outlet; and a sixth space partitioned from the fifth space and that communicates with the second liquid refrigerant inlet/outlet, the fourth header contains:

a seventh space that communicates with the fifth space via the second flat tubes; and an eighth space that communicates with the sixth space via the second flat tubes, the second space and the third space communicate with each other via the first communication path, and the seventh space and the eighth space communicate with each other via the second communication path.

2. The heat exchanger according to claim 1, wherein a direction of flow of the refrigerant in the second subcooling area is same as a direction of flow of the refrigerant in the first subcooling area.

3. The heat exchanger according to claim 2, wherein a direction of flow of the refrigerant that flows through the second superheated area is opposite to a direction of flow of the refrigerant that flows through the first superheated area.

4. The heat exchanger according to claim 1, wherein, in an installed state:

a longitudinal direction of the first flat tubes is a horizontal direction, the longitudinal direction of the first header and the second header is a vertical direction, and the first gas refrigerant inlet/outlet is disposed above the first liquid refrigerant inlet/outlet.

5. The heat exchanger according to claim 1, wherein, in an installed state, the first heat-exchanging unit further comprises:

a first portion in which the first flat tubes extend in a first direction; and a second portion in which the first flat tubes extend in a second direction that intersects the first direction.

6. The heat exchanger according to claim 1, wherein, when viewed in a direction in which the first header and the second header extend:

the first heat-exchanging unit is bent or curved at three or more locations and has a square shape, the first header is disposed at a first end portion of the first heat-exchanging unit, and the second header is disposed at a second end portion of the first heat-exchanging unit.

7. A refrigeration apparatus comprising:

a casing that constitutes an outer contour; and the heat exchanger according to claim 1, wherein a connection pipe insertion hole for inserting a refrigerant connection pipe is disposed in the casing, the first heat-exchanging unit further comprises:

a third portion in which the first flat tubes extend in a third direction; and a fourth portion in which the first flat tubes extend in a fourth direction that differs from the third direction, in the first heat-exchanging unit, one of the first header and the second header is disposed at a terminating end of the third portion and another of the first header and the second header is disposed at a leading end of the fourth portion that is disposed apart from the terminating end of the third portion, the terminating end of the third portion is disposed closer to the connection pipe insertion hole than another end of the third portion, and the leading end of the fourth portion is disposed closer to the connection pipe insertion hole than another end of the fourth portion.

* * * * *